US006001544A

United States Patent [19]

Makuta et al.

[11] Patent Number: 6,001,544

[45] Date of Patent: Dec. 14, 1999

[54] METHOD FOR FORMING COLOR IMAGE USING SILVER HALIDE COLOR PHOTOGRAPHIC MATERIAL

[75] Inventors: Toshiyuki Makuta; Kazuo Sanada; Tsutomu Takatsuka, all of Kanagawa, Japan

[73] Assignee: Fuji Photo Film Co., Ltd., Kanagawa, Japan

[21] Appl. No.: 09/162,162

[22] Filed: Sep. 29, 1998

[30] Foreign Application Priority Data

Sep. 30, 1997 [JP] Japan ..... 9-281207

[51] Int. Cl.[6] ..... G03C 7/407

[52] U.S. Cl. ..... 430/405; 430/488

[58] Field of Search ..... 430/357, 405, 430/488, 566

[56] References Cited

U.S. PATENT DOCUMENTS

| | | | |
|---|---|---|---|
| 4,021,240 | 5/1977 | Cerquone et al. | 430/203 |
| 5,557,362 | 9/1996 | Ueda | 396/627 |
| 5,817,449 | 10/1998 | Nakamura | 430/448 |

FOREIGN PATENT DOCUMENTS

| | | |
|---|---|---|
| 0 545 491 A1 | 6/1963 | European Pat. Off. . |
| 0 727 708 A1 | 8/1996 | European Pat. Off. . |
| 9-179272 | 7/1997 | Japan . |

*Primary Examiner*—Hoa Van Le

*Attorney, Agent, or Firm*—Sughrue, Mion, Zinn, Macpeak & Seas, PLLC

[57] ABSTRACT

Disclosed is a method for forming a color image which comprises color development processing a silver halide color photographic material with an alkaline processing solution substantially free of a color-forming developing agent by using a coating apparatus comprising a plurality of nozzle pores for coating by jetting droplets of the processing solution, wherein three droplets in contiguous to each other jetted from the nozzle pores are coated so as not to leave space among the three droplets coated on said photographic material, wherein said photographic material comprises a support having provided thereon at least one photographic constituting layer, said at least one photographic constituting layer containing at least one dye-forming coupler and at least one color-forming reducing agent selected from the group consisting of color-forming reducing agents represented by formulas (I), (II) and (III) defined in the specification.

15 Claims, 12 Drawing Sheets

METHOD FOR FORMING COLOR IMAGE USING SILVER HALIDE COLOR PHOTOGRAPHIC MATERIAL

FIELD OF THE INVENTION

The present invention relates to a technique of color photography. More specifically, the present invention relates to a method for forming a color image contributing to the reduction of the amount of a waste solution and fluctuations by processing which comprises processing with a processing solution coating apparatus capable of coating a small volume of a coating solution uniformly using a silver halide color photographic material excellent in a color developing property (color-forming property), a storage stability, a color image stability and a hue which can be used in simplified rapid processing.

BACKGROUND OF THE INVENTION

In a color photographic material, in general, by color developing the exposed photographic material, the oxidized p-phenylenediamine derivatives and couplers are reacted and images are formed. In this method, colors are reproduced by a subtracting color process, and to reproduce blue, green and red colors, yellow, magenta and cyan color images which are complementary relationship, respectively, are formed.

Color development is achieved by immersing the exposed color photographic material in an alkali aqueous solution containing a p-phenylenediamine derivative (a color developing solution). However, an alkali solution of a p-phenylenediamine derivative is unstable and liable to be deteriorated with the lapse of time. Therefore, no problems arise when a plenty amount of materials are processed and a color developing replenisher is replenished frequently, but when the processing amount of materials is a little and the replenishing amount of a replenisher is a little, the color developing solution cannot endure the long time use and must be replaced. Further, when the processing amount is much, a large volume of a waste color developing solution containing a p-phenylenediamine derivative is discharged. The disposal of the waste color developing solution containing a p-phenylenediamine derivative is troublesome and the disposal of the waste color developing solution discharged in a large amount has been a serious problem.

If a p-phenylenediamine derivative in the color developing solution is excluded from the processing solution, such problems as the deterioration of a color developing solution with the lapse of time and the troublesome disposal of a waste solution can be resolved. However, if a p-phenylenediamine derivative is excluded from a processing solution, coloring (color forming) does not occur as a matter of course. For effecting coloring with an alkali solution from which a p-phenylenediamine derivative is excluded, it is enough for a photographic material to contain a p-phenylenediamine derivative or a compound having the similar function to a p-phenylenediamine derivative. For example, there is a method of incorporating an aromatic primary amine or the precursors thereof in a photographic material. As such aromatic primary amine developing agents and the precursors thereof capable of incorporation, e.g., compounds disclosed in U.S. Pat. Nos. 2,507,114, 3,764,328, 4,060,418, JP-A-56-6235 and JP-A-58-192031 (the term "JP-A" as used herein means an "unexamined published Japanese patent application") can be cited. However, as these aromatic primary amines and the precursors thereof are unstable, they have a drawback such that stains are generated during storage of an unprocessed photographic material for a long period of time or during color development. Another effective means is a method of incorporating a stable color-forming reducing agent, e.g., hydrazine compounds disclosed in EP-A-545491, EP-A-565165, JP-A-8-286340, JP-A-8-292529, JP-A-8-297354, JP-A-8-320542 and JP-A-8-292531, or sulfonamidophenols disclosed in U.S. Pat. No. 4,021,240, *Research Disclosure,* No. 15108 (November, 1976) into a hydrophilic colloid layer. Two types of compounds of a hydrophilic compound and an oil-soluble compound can be cited as these color-forming reducing agents. When a color-forming reducing agent is a hydrophilic compound, an unreacted color-forming reducing agent dissolves out into the processing solution during processing, which becomes the prime cause of fluctuations by processing, and when it is an oil-soluble compound, an oxidation-reduction reaction with silver halide does not occur in processing with an ordinary alkali solution, and a water-soluble or alkali-soluble auxiliary developing agent is necessary to cause an oxidation-reduction reaction. In this case, if an auxiliary developing agent is added to a processing solution, the processing solution is deteriorated with the lapse of time as in the case when a p-phenylenediamine derivative is added to a processing solution, while when it is incorporated into a hydrophilic colloid layer of a photographic material, which causes fluctuations by processing due to the dissolution of the auxiliary developing agent to the processing solution.

Further, various components, such as antihalation dyes, antifoggants, sodium bromide, sodium chloride, etc., dissolve out from the photographic material into the processing solution during processing, which also causes fluctuations by processing.

For the avoidance of fluctuations by processing due to contamination of these materials into a processing solution, it is preferred that the processing solution is used only once (hereinafter sometimes referred to as used-only-once processing). However, when the used-only-once processing comprising immersing a photographic material in a processing solution preserved in a tank is carried out, the disposal of the waste solution discharged in a large amount becomes a serious problem.

For reducing the amount of a processing solution, methods of carrying out slit development are disclosed in JP-A-63-235940, JP-A-64-26855, JP-A-2-118633 and JP-A-2-137843. According to these methods, it is possible to effect the used-only-once processing with a reduced amount of a processing solution, however, to make the amount of the waste solution equal to that in the case where replenishing processing is performed using a tank, the slit width should be several ten micrometers, and it is very difficult to pass a photographic material through such a slit.

As opposed to these methods, there is a processing method of coating a small amount of a coating solution uniformly on the surface of a photographic material. However, even in this method, the coating part of a coating apparatus is gradually contaminated when the coating part and the photographic material is contacted, which also causes fluctuations by processing.

Accordingly, the development of an image forming system exhibiting less fluctuations by processing which can cope with slackened processing has been desired.

A coating apparatus for coating water to a substance by non-contact system is disclosed in JP-A-9-179272. The coating apparatus disclosed in JP-A-9-179272 is used for supplying water to generate alkali from an alkali generator when heat development processing is carried out. This coating apparatus is characterized in that a liquid such as water is coated by jetting from a superfine nozzle. In using this coating apparatus, no problems arise with a liquid such as water which hardly contains a solute but with a solution having dissolved therein a large quantity of solutes, a problem arises such that clogging of a nozzle occurs when solvents have been volatilized. Further, when the amount of the organic compounds contained in the processing solution becomes large, jetting from the nozzle deflects and results in uneven coating. Therefore, if a processing solution is coated using this coating apparatus, the processing solution preferably contains solutes as little as possible.

Under such present conditions, the realization of an image forming system as a total system comprising a photographic material, a processing solution and a processing apparatus which can cope with even slackened processing, causes less fluctuations by processing and generates less waste solution has been desired.

SUMMARY OF THE INVENTION

An object of the present invention is to provide a method for forming a color image contributing to the reduction of the amount of a waste solution and fluctuations by processing which comprises processing with a processing solution coating apparatus capable of coating a small volume of a coating solution uniformly using a silver halide color photographic material excellent in a color developing property, a storage stability, a color image stability and a hue which can be used in simple rapid processing.

The above object of the present invention has been achieved by the following methods:

(1) A method for forming a color image which comprises color development processing a silver halide color photographic material with an alkaline processing solution substantially free of a color-forming developing agent by using a coating apparatus comprising a plurality of nozzle pores for coating by jetting droplets of the processing solution, wherein three droplets in contiguous to each other jetted from the nozzle pores are coated so as not to leave space among the three droplets coated on said photographic material, wherein said photographic material comprises a support having provided thereon at least one photographic constituting layer, said at least one photographic constituting layer containing at least one dye-forming coupler and at least one color-forming reducing agent selected from the group consisting of color-forming reducing agents represented by formulas (I) and (II):

(I)

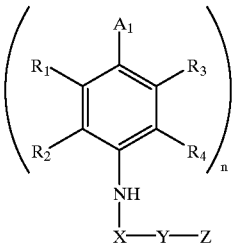

-continued (II)

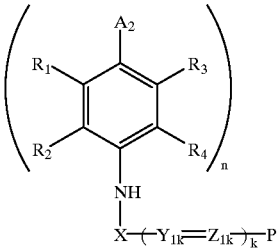

wherein $R_1$, $R_2$, $R_3$ and $R_4$ each represents a hydrogen atom or a substituent; $A_1$ and $A_2$ each represents a hydroxyl group or a substituted amino group; X represents a divalent or more linking group selected from the group consisting of —CO—, —SO—, —$SO_2$—, and —PO<; $Y_{1k}$ and $Z_{1k}$ each represents a nitrogen atom or a group represented by —$CR_5$=, wherein $R_5$ represents a hydrogen atom or a substituent; k represents 0 or an integer of 1 or more; P represents a proton dissociable group or a group capable of becoming a cation, and has a function of forming a dye from a coupler including a substituent bonded to the coupling site thereof by the breaking (scission) of the N—X bond caused by electron transfer from P and the elimination of the substituent after an oxidation product formed by the oxidation-reduction reaction of the compound represented by formula (II) with the exposed silver halide is coupled with the coupler; Y represents a divalent linking group; Z represents a nucleophilic group which can attack X when the compound represented by formula (I) is oxidized; and n is 1 or 2 when X represents —PO<, and n is 1 when X represents other group; and at least two atoms or substituents selected arbitrarily from $R_1$ and $R_2$, $R_3$ and $R_4$, and $Y_{1k}$, $Z_{1k}$ and P may be respectively independently bonded to form a ring.

(2) A method for forming a color image which comprises color development processing a silver halide color photographic material with an alkaline processing solution substantially free of a color-forming developing agent by using a coating apparatus comprising a plurality of nozzle pores for coating by jetting droplets of the processing solution, wherein three droplets in contiguous to each other jetted from the nozzle pores are coated so as not to leave space among the three droplets coated on said photographic material, wherein said photographic material comprises a support having provided thereon at least one photographic constituting layer, said at least one photographic constituting layer containing at least one dye-forming coupler and at least one color-forming reducing agent represented by formula (III):

$$R^{11}—NHNH—X^0—R^{12} \quad (III)$$

wherein $R^{11}$ represents an aryl group which may have a substituent or a heterocyclic group which may have a substituent; $R^{12}$ represents an alkyl group which may have a substituent, an alkenyl group which may have a substituent, an alkynyl group which may have a substituent, an aryl group which may have a substituent or a heterocyclic group which may have a substituent; $X^0$ represents —$SO_2$—, —CO—, —COCO—, —CO—O—, —CONH($R^{13}$)—, —COCO—O—, —COCO—N($R^{13}$)— or —$SO_2$—NH($R^{13}$)—; $R^{13}$ represents a hydrogen atom, an alkyl group which may have a substituent, an alkenyl group which may have a substituent, an alkynyl group which may have a substituent, an aryl group which may have a substituent or a heterocyclic group which may have a substituent.

(3) The method for forming a color image described in the above item (2), wherein the compound represented by formula (III) is represented by formula (IV) or (V):

(IV)

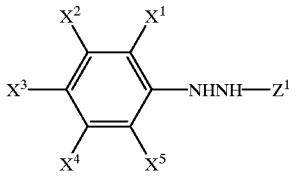

(V)

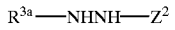

wherein $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$ and $X^5$ each represents a hydrogen atom or a substituent, provided that the sum of Hammett's substituent constant σp values of $X^1$, $X^3$ and $X^5$ and Hammett's substituent constant σm values of $X^2$ and $X^4$ is from 0.80 to 3.80; and $R^{3a}$ represents a heterocyclic group.

(4) The method for forming a color image described in the above item (3), wherein the compound represented by formula (IV) or (V) is represented by formula (VI) or (VII):

(VI)

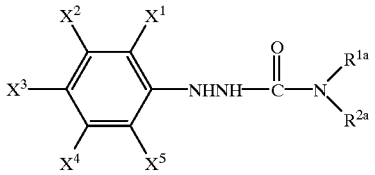

(VII)

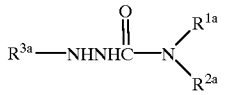

wherein $R^{1a}$ and $R^{2a}$ each represents a hydrogen atom or a substituent; $X^1$, $X^2$, $X^3$, $X^4$ and $X^5$ each represents a hydrogen atom or a substituent, provided that the sum of Hammett's substituent constant σp values of $X^1$, $X^3$ and $X^5$ and Hammett's substituent constant σm values of $X^2$ and $X^4$ is from 0.80 to 3.80; and $R^{3a}$ represents a heterocyclic group.

(5) The method for forming a color image described in the above item (4), wherein the compound represented by formula (VI) or (VII) is represented by formula (VIII) or (IX):

(VIII)

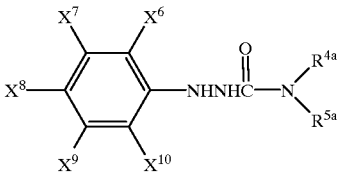

(IX)

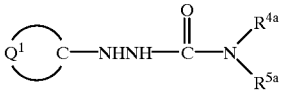

wherein $R^{4a}$ and $R^{5a}$ each represents a hydrogen atom or a substituent, and either $R^{4a}$ or $R^{5a}$ represents a hydrogen atom; $X^6$, $X^7$, $X^8$, $X^9$ and $X^{10}$ each represents a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, provided that the sum of Hammett's substituent constant σp values of $X^6$, $X^8$ and $X^{10}$ and Hammett's substituent constant of values of $X^7$ and $X^9$ is from 1.20 to 3.80; and $Q^1$ and C each represents a nonmetallic atomic group necessary to form a nitrogen-containing 5- to 8-membered heterocyclic ring.

(6) The method for forming a color image described in the above item (1), (2), (3), (4) or (5), wherein said coating apparatus has a pitch P among nozzle pores contiguous to each other of (29 3)·D/2 or less, wherein diameter D of one droplet of the alkaline processing solution coated on the photographic material is obtained by the following equation taking the volume of one droplet of the alkaline processing solution jetted from a plurality of nozzle pores as V, and the contact angle of the droplet at the time when the alkaline processing solution is coated on the photographic material as θ:

$$D = 2 \cdot \mathrm{Sin}\theta\left\{\frac{3 \cdot V}{\pi \cdot [2^{-3} \cdot \cos\theta + (\cos\theta)^3]}\right\}^{1/3}$$

(7) The method for forming a color image described in the above item (1), (2), (3), (4), (5) or (6), wherein the liquid film thickness of the alkaline processing solution coated on the photographic material is 50 μm or less.

(8) The method for forming a color image described in the above item (1), (2), (3), (4), (5), (6) or (7), wherein the processing is carried out using the photographic material having the total coating amount of silver of all the coated layers of from 0.003 to 0.3 g/m$^2$ in terms of silver with the alkaline processing solution substantially free of a color-forming developing agent but containing hydrogen peroxide.

(9) The method for forming a color image described in the above item (1), (2), (3), (4), (5), (6), (7) or (8), wherein the exposure time per one pixel is from $10^{-8}$ to $10^{-4}$ sec. and exposure is carried out by scanning exposure in which adjacent rasters are overlapped.

DETAILED DESCRIPTION OF THE INVENTION

Figure 1:
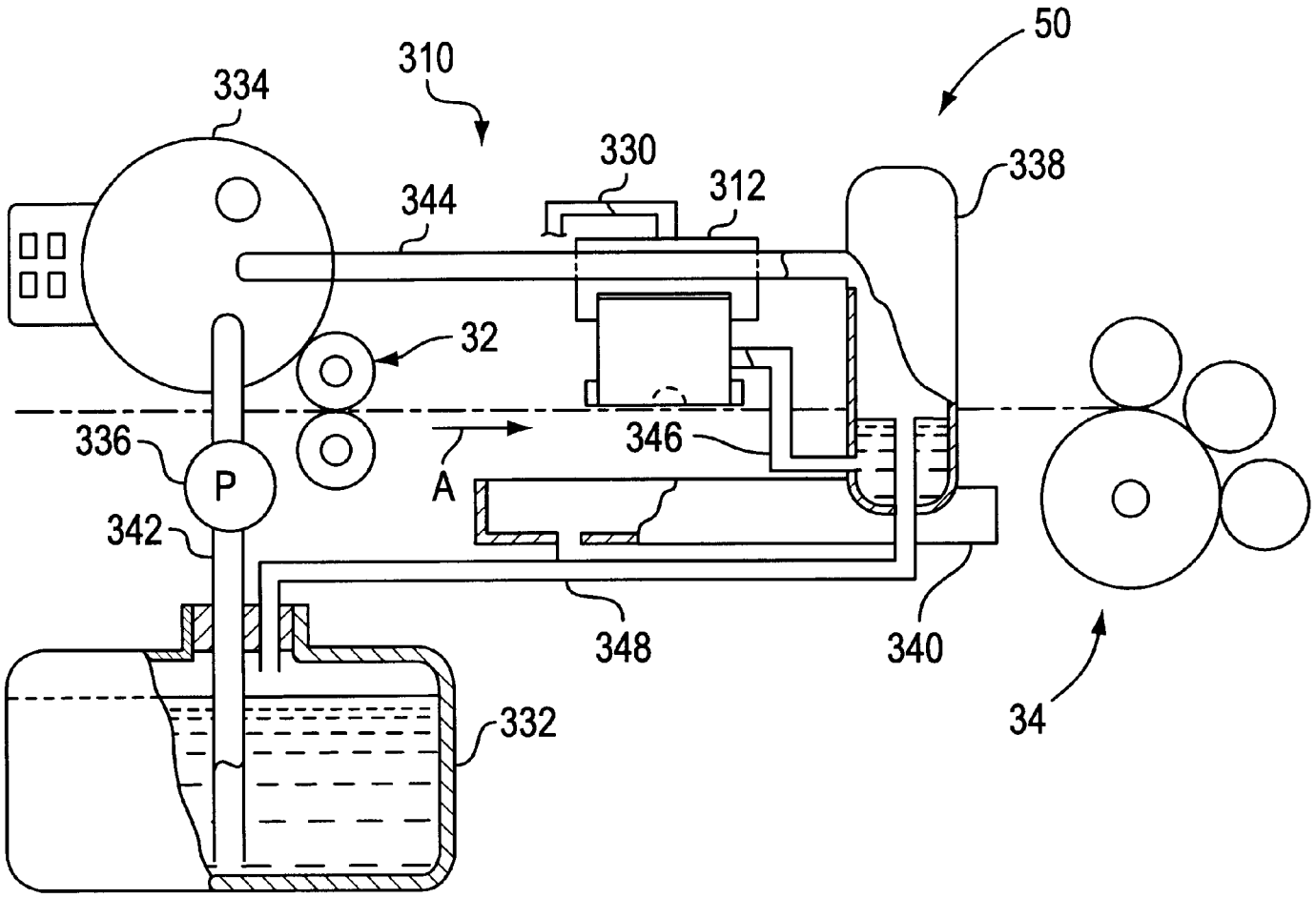
FIG. 1 is a schematic block diagram of the entire structure of the coating apparatus according to the first embodiment of the present invention.

The present invention is described in detail below.

The compound represented by formula (I) or (II) is described in detail below.

The following described alkyl group (alkyl residue), aryl group (aryl residue), amino group (amino residue), and the like may further be substituted with a substituent.

Compounds represented by formula (I) or (II) represent developing agents, which are classified into aminophenol derivatives and phenylenediamine derivatives. In formula (I) or (II), $R_1$, $R_2$, $R_3$ and $R_4$ each represents a hydrogen atom or a substituent. Examples of substituents include, for example, a halogen atom (e.g., chlorine, bromine), an alkyl group (e.g., methyl, ethyl, isopropyl, n-butyl, t-butyl), an aryl group (e.g., phenyl, tolyl, xylyl), a carbonamido group (e.g., acetylamino, propionylamino, butyroylamino, benzoylamino), a sulfonamido group (e.g., methanesulfonylamino, ethanesulfonylamino, benzenesulfonylamino, toluenesulfonylamino), an alkoxy group (e.g., methoxy, ethoxy), an aryloxy group (e.g., phenoxy), an alkylthio group (e.g., methylthio, ethylthio, butylthio), an arylthio group (e.g., phenylthio, tolylthio), a carbamoyl group (e.g., methylcarbamoyl, dimethylcarbamoyl, ethylcarbamoyl, diethylcarbamoyl, dibutylcarbamoyl, piperidinocarbamoyl, morpholinocarbamoyl, phenylcarbamoyl, methylphenylcarbamoyl, ethylphenylcarbamoyl, benzylphenylcarbamoyl), a sulfamoyl group (e.g., methylsulfamoyl, dimethylsulfamoyl, ethylsulfamoyl, diethylsulfamoyl, dibutylsulfamoyl, piperidinosulfamoyl, morpholinosulfamoyl, phenylsulfamoyl, methylphenylsulfamoyl, ethylphenylsulfamoyl, benzylphenylsulfamoyl), a cyano group, a sulfonyl group (e.g., methanesulfonyl, ethanesulfonyl, phenylsulfonyl, 4-chlorophenylsulfonyl, p-toluenesulfonyl), an alkoxycarbonyl group (e.g., methoxycarbonyl, ethoxycarbonyl, butoxycarbonyl), an aryloxycarbonyl group (e.g., phenoxycarbonyl), an acyl group (e.g., acetyl, propionyl, butyroyl, benzoyl, alkylbenzoyl), a ureido group (e.g., methylaminocarbonamido, diethylaminocarbonamido), a urethane group (e.g., methoxycarbonamido, butoxycarbonamido), an acyloxy group (e.g., acetyloxy, propionyloxy, butyroyloxy), etc. Of $R_1$, $R_2$, $R_3$ and $R_4$, $R_2$ and/or $R_4$ preferably represent(s) a hydrogen atom. When $A_1$ or $A_2$ represents a hydroxyl group, the sum of Hammett's substituent constant $\sigma p$ values of $R_1$, $R_2$, $R_3$ and $R_4$ is preferably 0 or more, and when $A_1$ or $A_2$ represents a substituted amino group, the sum of Hammett's substituent constant $\sigma p$ values of $R_1$, $R_2$, $R_3$ and $R_4$ is preferably 0 or less.

$A_1$ and $A_2$ each represents a hydroxyl group or a substituted amino group (e.g., dimethylamino, diethylamino, ethylhydroxyethylamino), and $A_2$ preferably represents a hydroxyl group. X represents a divalent or more linking group selected from the group consisting of —CO—, —SO—, —$SO_2$—, and —PO<. $Y_{1k}$ and $Z_{1k}$ each represents a nitrogen atom or a group represented by —$CR_5$= (wherein $R_5$ represents a hydrogen atom or a substituent). Substituents described in $R_1$, $R_2$, $R_3$ and $R_4$ can be exemplified as substituents for $R_5$. P represents a proton dissociable group or a group capable of becoming a cation, which has a function of forming a dye from a coupler including a substituent bonded to the coupling site thereof by the breaking of the N—X bond caused by electron transfer from P as a trigger and the elimination of the substituent after an oxidation product formed by the oxidation-reduction reaction of the compound represented by formula (II) with the exposed silver halide is coupled with the coupler. Specifically, after the coupling reaction, the electron transfer occurs from the proton-dissociated anion or the lone pair of the atom capable of becoming a cation on P toward the coupling site, and the N—X bond is broken by forming a double bond between X and $Y_{1k}$ (or between X and P when k represents 0), and further the substituent of the coupler is eliminated as an anion simultaneously with the formation of a double bond between the coupling site of the coupler and the N atom. The dye formation and the substituent elimination are caused due to this series of electron transfer mechanism. As atoms having such a function in P, an oxygen atom, a sulfur atom, a selenium atom, and a nitrogen atom and a carbon atom substituted with an electron attractive group can be exemplified as a proton dissociable atom, and as an atom capable of becoming a cation, a nitrogen atom and a sulfur atom can be cited.

P is a group of substituents bonded to the above-described atoms. Examples of substituents bonded to such atoms include an alkyl group (e.g., methyl, ethyl, isopropyl, n-butyl, t-butyl), an aryl group (e.g., phenyl, tolyl, xylyl), a carbonamido group (e.g., acetylamino, propionylamino, butyroylamino, benzoylamino), a sulfonamido group (e.g., methanesulfonylamino, ethanesulfonylamino, benzenesulfonylamino, toluenesulfonylamino), an alkoxy group (e.g., methoxy, ethoxy), an aryloxy group (e.g., phenoxy), an alkylthio group (e.g., methylthio, ethylthio, butylthio), an arylthio group (e.g., phenylthio, tolylthio), a carbamoyl group (e.g., methylcarbamoyl, dimethylcarbamoyl, ethylcarbamoyl, diethylcarbamoyl, dibutylcarbamoyl, piperidylcarbamoyl, morpholylcarbamoyl, phenylcarbamoyl, methylphenylcarbamoyl, ethylphenylcarbamoyl, benzylphenylcarbamoyl), a sulfamoyl group (e.g., methylsulfamoyl, dimethylsulfamoyl, ethylsulfamoyl, diethylsulfamoyl, dibutylsulfamoyl, piperidylsulfamoyl, morpholylsulfamoyl, phenylsulfamoyl, methylphenylsulfamoyl, ethylphenylsulfamoyl, benzylphenylsulfamoyl), a cyano group, a sulfonyl group (e.g., methanesulfonyl, ethanesulfonyl, phenylsulfonyl, 4-chlorophenylsulfonyl, p-toluenesulfonyl), an alkoxycarbonyl group (e.g., methoxycarbonyl, ethoxycarbonyl, butoxycarbonyl), an aryloxycarbonyl group (e.g., phenoxycarbonyl), an acyl group (e.g., acetyl, propionyl, butyroyl, benzoyl, alkylbenzoyl), an acyloxy group (e.g., acetyloxy, propionyloxy, butyroyloxy), a ureido group, a urethane group, etc. Of these, an alkyl group, an aryl group and a heterocyclic group are preferred.

Z represents a nucleophilic group which has a function of forming a dye by attacking the carbon atom, the sulfur atom or the phosphorus atom of X after the oxidation product formed by the reduction reaction of the compound with the exposed silver halide is coupled with the coupler. As is common in the field of the organic chemistry, those exhibiting a nucleophilic property in a nucleophilic group are atoms having a lone pair (e.g., a nitrogen atom, a phosphorus atom, an oxygen atom, a sulfur atom, a selenium atom, etc.) and anions (e.g., a nitrogen anion, an oxygen anion, a carbon anion, a sulfur anion). As examples of such nucleophilic groups, the following partial structures or groups having dissociated products thereof can be exemplified.

Examples of partial structures having a nucleophilic property which are contained in Z (atoms marked with a double underline have a nucleophilic property)

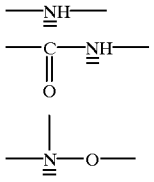

-continued

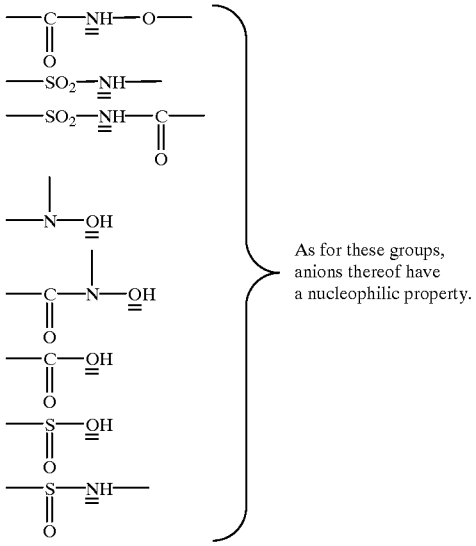

Specific examples of Z include the above-described groups one end of which is bonded with a hydrogen atom or with any of substituents described for the above P.

Y represents a divalent linking group. This linking group is a group which links Z at a favorable position capable of intramolecularly nucleophilically attacking X through Y. In practice it is preferred that atoms are linked so as to be able to constitute a 5- or 6-membered ring in atom number in the transition state when the nucleophilic group nucleophilically attacks X.

Preferred examples of such a linking group Y include, e.g., a 1,2- or 1,3-alkylene group, a 1,2-cycloalkylene group, a 2-vinylene group, a 1,2-arylene group, a 1,8-naphthylene group, etc.

k preferably represents an integer of 0 to 5, more preferably an integer of 0 to 2. Two or more atoms or substituents selected arbitrarily from $R_1$ and $R_2$, $R_3$ and $R_4$, and $Y_{1k}$, $Z_{1k}$ and P may be respectively independently bonded to form a ring.

Specific examples of the compounds represented by formula (I) or (II) according to the present invention are shown below but the present invention is not limited thereto.

D-1

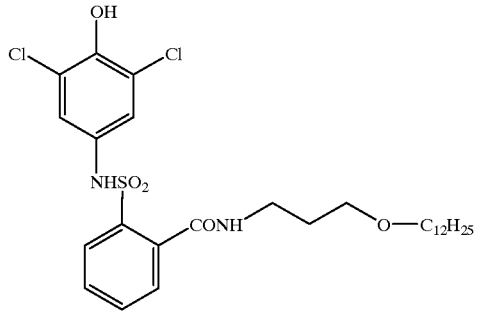

-continued
D-2
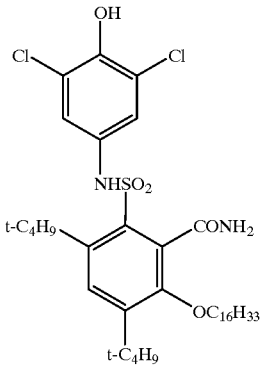
D-3
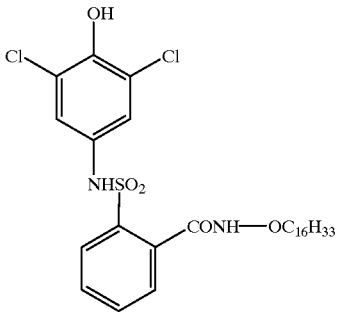
D-4
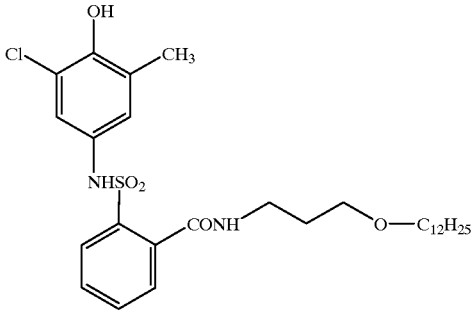
D-5
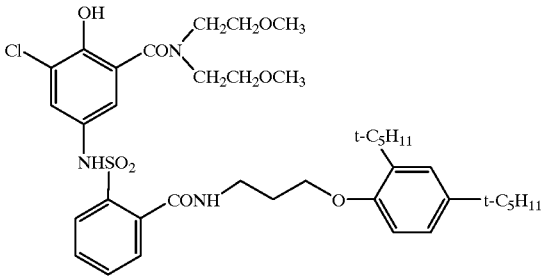
-continued
D-6
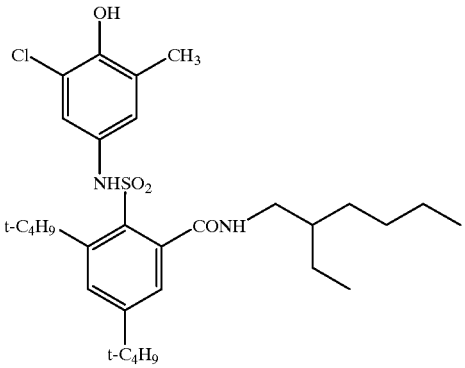
D-7
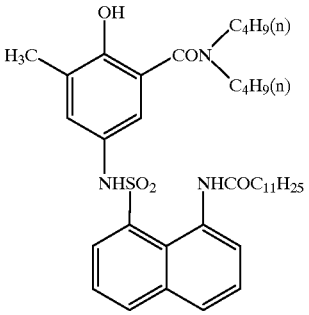
D-8
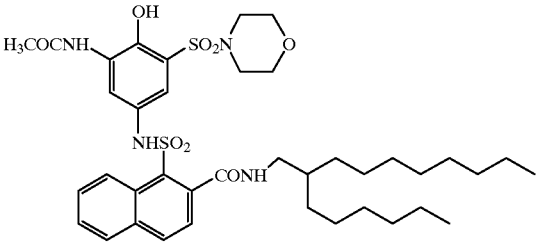
D-9
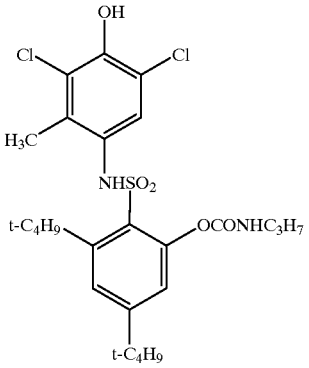
D-10
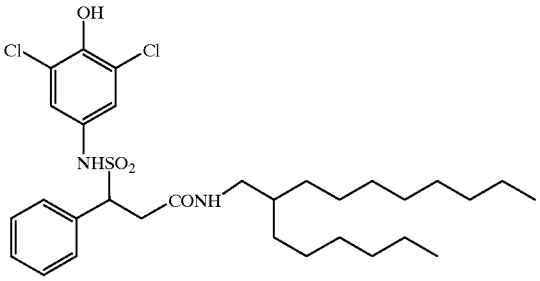

-continued
D-11
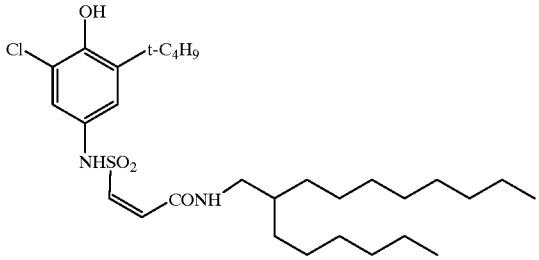
D-12
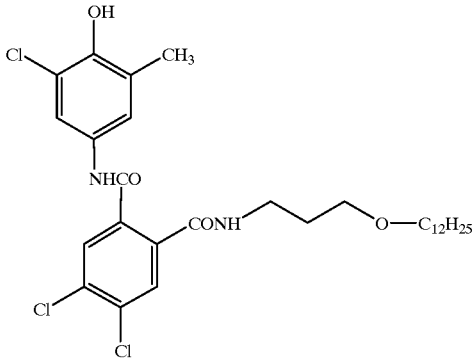
D-13
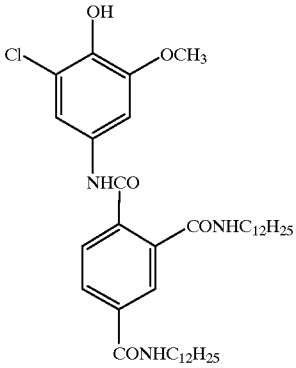
D-14
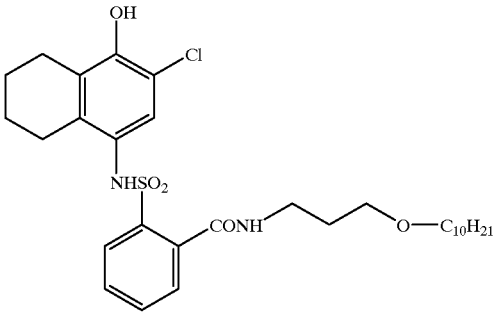
-continued
D-15
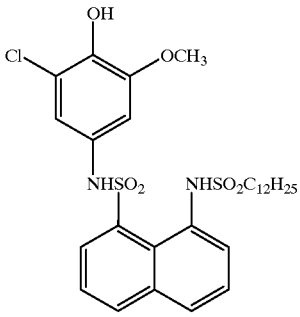
D-16
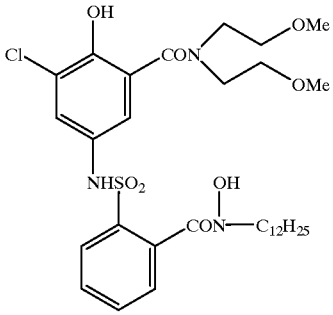
D-17
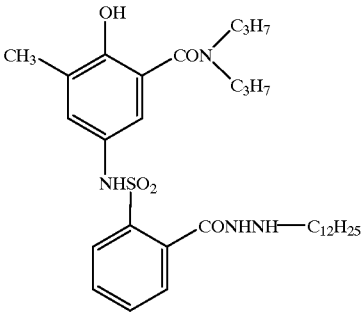
D-18
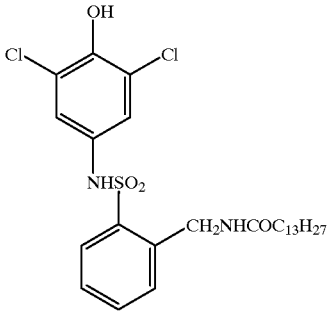

-continued
D-19
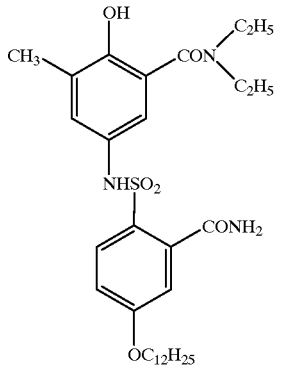
D-20
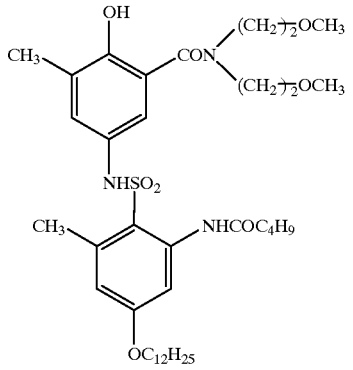
D-21
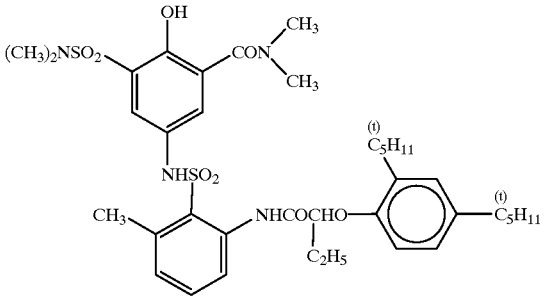
D-101
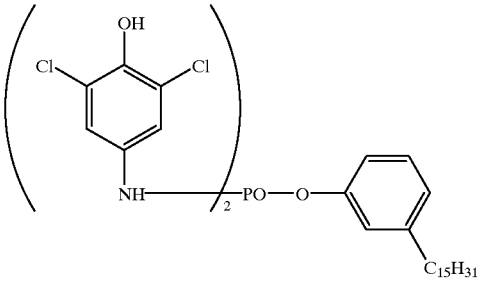
D-102
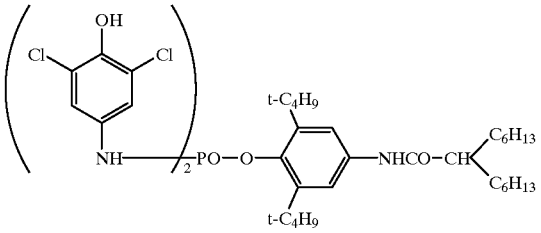
-continued
D-103
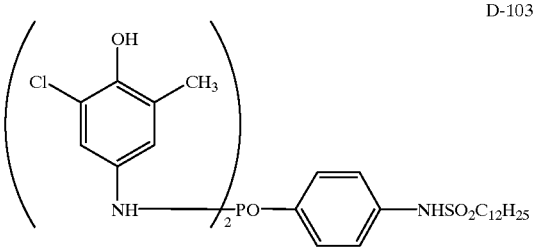
D-104
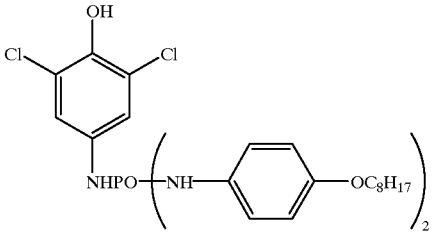
D-105
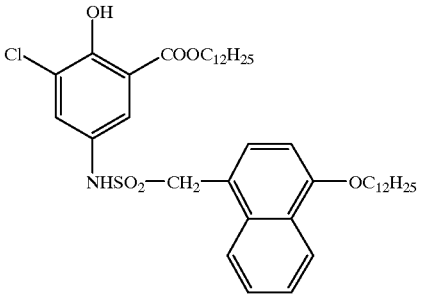
D-106
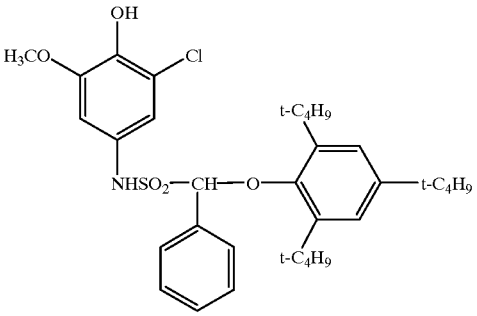
D-107
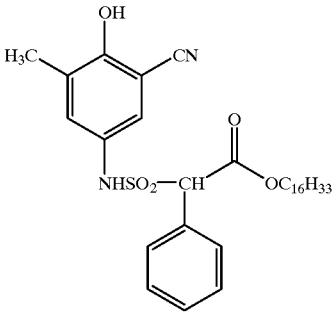

-continued

D-108

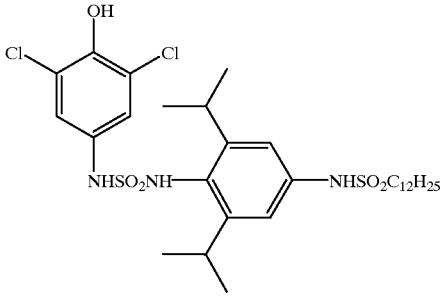

D-109

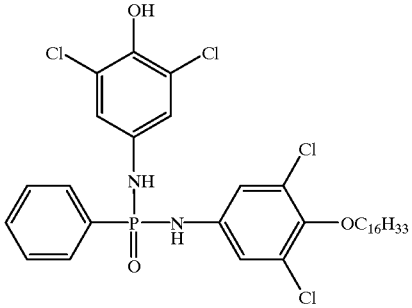

D-110

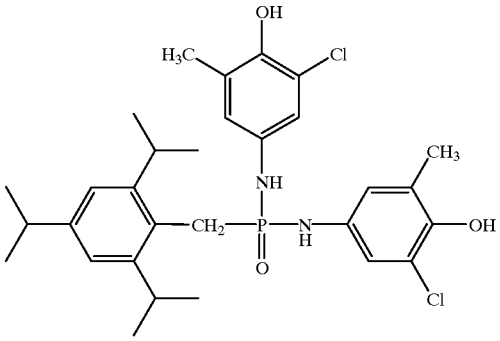

D-111

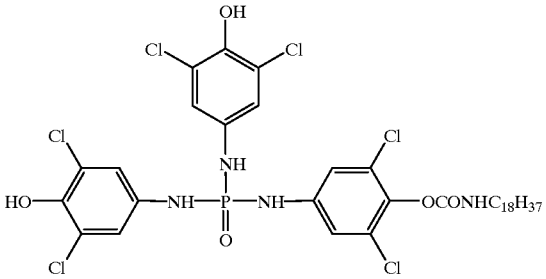

D-112

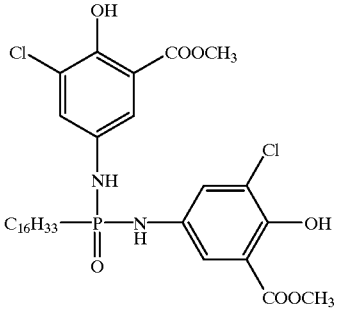

-continued

D-113

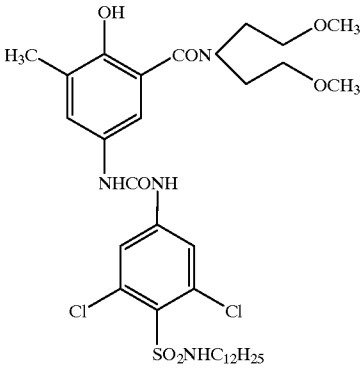

The structure of the color-forming reducing agent represented by formula (III) is described in detail below.

In formula (III), $R^{11}$ represents an aryl group which may have a substituent, or a heterocyclic group which may have a substituent. The aryl group represented by $R^{11}$ is preferably an aryl group having from 6 to 14 carbon atoms, e.g., phenyl and naphthyl. The heterocyclic group represented by $R^{11}$ is preferably a saturated or unsaturated 5-, 6- or 7-membered ring having at least one of nitrogen, oxygen, sulfur and selenium. A benzene ring or a inheterocyclic ring may be condensed with them. The heterocyclic ring represented by $R^{11}$ include, e.g., furanyl, thienyl, oxazolyl, thiazolyl, imidazolyl, triazolyl, pyrrolidinyl, benzoxazolyl, benzothiazolyl, pyridyl, pyridazyl, pyrimidinyl, pyrazinyl, triazinyl, quinolinyl, isoquinolinyl, phthalazinyl, quinoxalinyl, quinazolinyl, plinyl, pteridinyl, azepinyl, and benzoxepinyl.

Examples of substituents for $R^{11}$ include an alkyl group, an alkenyl group, an alkynyl group, an aryl group, a heterocyclic group, an alkoxy group, an aryloxy group, a heterocyclic oxy group, an alkylthio group, an arylthio group, a heterocyclic thio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amido group, an alkoxycarbonylamino group, an aryloxycarbonylamino group, a ureido group, a sulfonamido group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxyl group, a sulfo group, a phosphono group, a hydroxyl group, a mercapto group, an imido group and an azo group.

$R^{12}$ represents an alkyl group which may have a substituent, an alkenyl group which may have a substituent, an alkynyl group which may have a substituent, an aryl group which may have a substituent or a heterocyclic group which may have a substituent.

The alkyl group represented by $R^{12}$ is preferably a straight chain, branched or cyclic alkyl group having from 1 to 16 carbon atoms, e.g., methyl, ethyl, hexyl, dodecyl, 2-octyl, t-butyl, cyclopentyl or cyclooctyl. The alkenyl group represented by $R^{12}$ is preferably an acyclic or cyclic alkenyl group having from 2 to 16 carbon atoms, e.g., vinyl, 1-octenyl or cyclohexenyl.

The alkynyl group represented by $R^{12}$ is preferably an alkynyl group having from 2 to 16 carbon atoms, e.g., 1-butynyl or phenylethynyl. The aryl group and the heterocyclic group represented by $R^{12}$ include those described for $R^{11}$. Examples of the substituents for $R^{12}$ include those described for $R^{11}$.

$X^0$ represents —$SO_2$—, —CO—, —COCO—, —CO—O—, —CON($R^{13}$)—, —COCO—O—, —COCO—N($R^{13}$)— or —$SO_2$—N($R^{13}$)—, where $R^{13}$ represents a hydrogen atom or a substituent described for $R^{12}$.

Of these, —CO—, —CON($R^{13}$)— and —CO—O— are preferred, and —CON($R^{13}$)— is particularly preferred for the excellent coloring ability (color-forming ability).

The compound represented by formula (III) is preferably represented by formula (IV) or (V), more preferably represented by formula (VI) or (VII), and most preferably represented by formula (VIII) or (IX).

The compounds represented by formulae (IV) to (IX) are described in detail below.

In formulae (IV) and (V), $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group. The acyl group represented by $Z^1$ is preferably an acyl group having from 1 to 50, more preferably from 2 to 40, carbon atoms, e.g., acetyl, 2-methylpropanoyl, cyclohexylcarbonyl, n-octanoyl, 2-hexyldecanoyl, dodecanoyl, chloroacetyl, trifluoroacetyl, benzoyl, 4-dodecyloxybenzoyl, 2-hydroxymethylbenzoyl or 3-(N-hydroxy-N-methylaminocarbonyl)-propanoyl.

The case in which $Z^1$ and $Z^2$ represent a carbamoyl group is described in formulae (VIII) to (IX) below.

The alkoxycarbonyl group and the aryloxycarbonyl group represented by $Z^1$ and $Z^2$ are preferably an alkoxycarbonyl group and an aryloxycarbonyl having from 2 to 50, more preferably from 2 to 40, carbon atoms, e.g., methoxycarbonyl, ethoxycarbonyl, isobutyloxycarbonyl, cyclohexyloxycarbonyl, dodecyloxycarbonyl, benzyloxycarbonyl, phenoxycarbonyl, 4-octyloxyphenoxycarbonyl, 2-hydroxymethylphenoxycarbonyl, or 2-dodecyloxyphenoxycarbonyl.

$X^1$, $X^2$, $X^3$, $X^4$ and $X^5$ each represents a hydrogen atom or a substituent. Examples of substituents include a straight chain or branched, acyclic or cyclic alkyl group having from 1 to 50 carbon atoms (e.g., trifluoromethyl, methyl, ethyl, propyl, heptafluoropropyl, isopropyl, butyl, t-butyl, t-pentyl, cyclopentyl, cyclohexyl, octyl, 2-ethylhexyl, dodecyl), a straight chain or branched, acyclic or cyclic alkenyl group having from 2 to 50 carbon atoms (e.g., vinyl, 1-methylvinyl, cyclohexen-1-yl), an alkynyl group having from 2 to 50 carbon atoms (e.g., ethynyl, 1-propynyl), an aryl group having from 6 to 50 carbon atoms (e.g., phenyl, naphthyl, anthryl), an acyloxy group having from 1 to 50 carbon atoms (e.g., acetoxy, tetradecanoyloxy, benzoyloxy), a carbamoyloxy group having from 1 to 50 carbon atoms (e.g., N,N-dimethylcarbamoyloxy), a carbonamido group having from 1 to 50 carbon atoms (e.g., formamido, N-methylacetamido, acetamido, N-methylformamido, benzamido), a sulfonamido group having from 1 to 50 carbon atoms (e.g., methanesulfonamido, dodecanesulfonamido, benzenesulfonamido, p-toluenesulfonamido), a carbamoyl group having from 1 to 50 carbon atoms (e.g., N-methylcarbamoyl, N,N-diethylcarbamoyl, N-mesylcarbamoyl), a sulfamoyl group having from 0 to 50 carbon atoms (e.g., N-butylsulfamoyl, N,N-diethylsulfamoyl, N-methyl-N-(4-methoxyphenyl) sulfamoyl), an alkoxy group having from 1 to 50 carbon atoms (e.g., methoxy, propoxy, isopropoxy, octyloxy, t-octyloxy, dodecyloxy, 2-(2,4-di-t-pentylphenoxy)ethoxy), an aryloxy group having from 6 to 50 carbon atoms (e.g., phenoxy, 4-methoxyphenoxy, naphthoxy), an aryloxycarbonyl having from 7 to 50 carbon atoms (e.g., phenoxycarbonyl, naphthoxycarbonyl), an alkoxycarbonyl group having from 2 to 50 carbon atoms (e.g., methoxycarbonyl, t-butoxycarbonyl), an N-acylsulfamoyl group having from 1 to 50 carbon atoms (e.g., N-tetradecanoylsulfamoyl, N-benzoylsulfamoyl), an alkylsulfonyl group having from 1 to 50 carbon atoms (e.g., methanesulfonyl, octylsulfonyl, 2-methoxyethylsulfonyl, 2-hexyldecylsulfonyl), an arylsulfonyl group having from 6 to 50 carbon atoms (e.g., benzenesulfonyl, p-toluenesulfonyl, 4-phenylsulfonylphenylsulfonyl), an alkoxycarbonylamino group having from 2 to 50 carbon atoms (e.g., ethoxycarbonylamino), an aryloxycarbonylamino group having from 7 to 50 carbon atoms (e.g., phenoxycarbonylamino, naphthoxycarbonylamino), an amino group having from 0 to 50 carbon atoms (e.g., amino, methylamino, diethylamino, isopropylamino, anilino, morpholino), a cyano group, a nitro group, a carboxyl group, a hydroxyl group, a sulfo group, a mercapto group, an alkylsulfinyl group having from 1 to 50 carbon atoms (e.g., methanesulfinyl, octanesulfinyl), an arylsulfinyl group having from 6 to 50 carbon atoms (e.g., benzenesulfinyl, 4-chlorophenylsulfinyl, p-toluenesulfinyl), an alkylthio group having from 1 to 50 carbon atoms (e.g., methylthio, octylthio, cyclohexylthio), an arylthio group having from 6 to 50 carbon atoms (e.g., phenylthio, naphthylthio), a ureido group having from 1 to 50 carbon atoms (e.g., 3-methylureido, 3,3-dimethylureido, 1,3-diphenylureido), a heterocyclic group having from 2 to 50 carbon atoms (a 3- to 12-membered monocyclic or condensed ring containing at least one nitrogen, oxygen or sulfur as a hetero atom, e.g., 2-furyl, 2-pyranyl, 2-pyridyl, 2-thienyl, 2-imidazolyl, morpholino, 2-quinolyl, 2-benzimidazolyl, 2-benzothiazolyl, 2-benzoxazolyl), an acyl group having from 1 to 50 carbon atoms (e.g., acetyl, benzoyl, trifluoroacetyl), a sulfamoylamino group having from 0 to 50 carbon atoms (e.g., N-butylsulfamoylamino, N-phenylsulfamoylamino), a silyl group having from 3 to 50 carbon atoms (e.g., trimethylsilyl, dimethyl-t-butylsilyl, triphenylsilyl), and a halogen atom (e.g., fluorine, chlorine, bromine). These substituents may further have a substituent (s), and substituents as described above can be exemplified as examples of such substituents. $X^1$, $X^2$, $X^3$, $X^4$ and $X^5$ may be connected to each other to form a condensed ring. The condensed ring is preferably a 5- to 7-membered ring, more preferably a 5- or 6-membered ring.

Carbon atoms of the substituents are preferably from 1 to 50, more preferably from 1 to 42, and most preferably from 1 to 34.

With respect to $X^1$, $X^2$, $X^3$, $X^4$ and $X^5$ in formula (IV), the sum of Hammett's substituent constant $\sigma p$ values of $X^1$, $X^3$ and $X^5$ and Hammett's substituent constant $\sigma m$ values of $X^2$ and $X^4$ is from 0.80 to 3.80. In formula (VIII), $X^6$, $X^7$, $X^8$, $X^9$ and $X^{10}$ each represents a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group; each of these substituents may further have a substituent, and they may be connected to each other to form a ring. Specific examples of substituents thereof are the same as those described as substituents for $X^1$, $X^2$, $X^3$, $X^4$ and $X^5$, provided that in formula (VIII) the sum of Hammett's substituent constant σp values of $X^6$, $X^8$ and $X^{10}$ and Hammett's substituent constant σm values of $X^7$ and $X^9$ is from 1.20 to 3.80, preferably from 1.50 to 3.80, and more preferably from 1.70 to 3.80.

If the sum of σp values and σm values is less than 0.80, coloring (color forming) is insufficient, on the contrary if it exceeds 3.80, the compound per se is difficult to synthesize or hard to obtain.

Hammett's substituent constant σp value and σm value are described in detail, for example, in Naoki Inamoto, *Hammett Soku—Kozo to Hannosei* (*Hammett's Rule—Structure and Reactivity,* published by Maruzen, Tokyo, *Shin-Jikken Kaaaku Koza* 14, *Yuki Kaaobutsu no Gosei to Hanno* (*V*) (*New Experimental Chemistry Course* 14. *Syntheses and Reactions of Organic Compounds* (*V*)), p. 2605, compiled by Nippon Kagaku Kai, published by Maruzen, Tokyo, Tadao Nakaya, *Riron Yuki Kagaku Kaisetsu* (*Interpretation of Theoretical Organic Chemistry,* p. 217, published by Tokyo Kagaku Dojin, and *Chemical Review,* Vol. 91, pp. 165 to 195 (1991).

$R^{1a}$ and $R^{2a}$ in formulae (VI) and (VII) and $R^{4a}$ and $R^{5a}$ in formulae (VIII) and (IX) each represents a hydrogen atom or a substituent. Specific examples of the substituents are the same as those described as substituents for $X^1$, $X^2$, $X^3$, $X^4$ and $X^5$, preferably a hydrogen atom, a substituted or unsubstituted alkyl group having from 1 to 50 carbon atoms, a substituted or unsubstituted aryl group having from 6 to 50 carbon atoms, or a substituted or unsubstituted heterocyclic group having from 1 to 50 carbon atoms, and more preferably at least either $R^{1a}$ or $R^{2a}$ and at least either $R^{4a}$ or $R^{5a}$ represent a hydrogen atom.

In formulae (V) and (VII), $R^{3a}$ represents a heterocyclic group. The heterocyclic group is preferably a heterocyclic group having from 1 to 50 carbon atoms, for example, a saturated or unsaturated 3- to 12-membered (preferably a 3- to 8-membered) monocyclic or condensed ring containing one or more of a nitrogen atom, an oxygen atom or a sulfur atom as a hetero atom. Specific examples of the heterocyclic rings include furan, pyran, pyridine, thiophene, imidazole, quinoline, benzimidazole, benzothiazole, benzoxazole, pyrimidine, pyrazine, 1,2,4-thiadiazole, pyrrole, oxazole, thiazole, quinazoline, isothiazole, pyridazine, indole, pyrazole, triazole, and quinoxaline. These heterocyclic rings may have a substituent. Those having one or more electron attractive group(s) are preferred. The electron attractive group herein means a group having a positive value of Hammett's σp value.

For the incorporation of color-forming reducing agents according to the present invention into a photographic material, it is preferred that at least one group represented by $Z^1$, $Z^2$, $R^{1a}$, $R^{2a}$, $R^{3a}$, $R^{4a}$, $R^{5a}$, $X^1$, $X^2$, $X^3$, $X^4$, $X^5$, $X^6$, $X^7$, $X^8$, $X^9$ or $X^{10}$ has a ballast group.

Examples of heterocyclic rings completed by $Q^1$ are shown in exemplified Compounds I-16 to I-74.

Specific examples of the color-forming reducing agents represented by formula (III) are shown below but the scope of the present invention is not limited thereto.

I-1

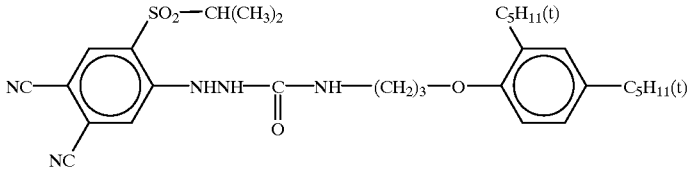

I-2

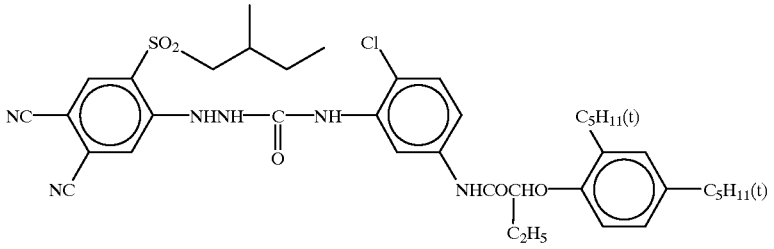

I-3

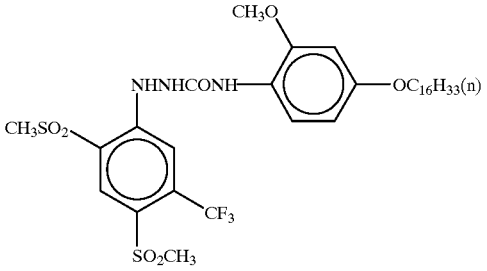

-continued
I-4
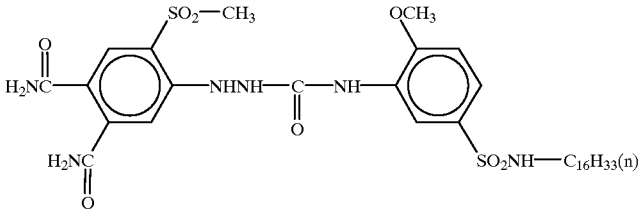
I-5
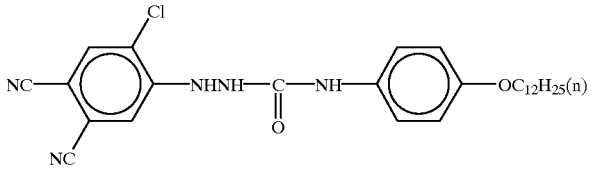
I-6
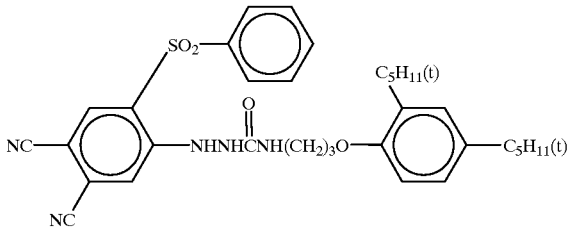
I-7
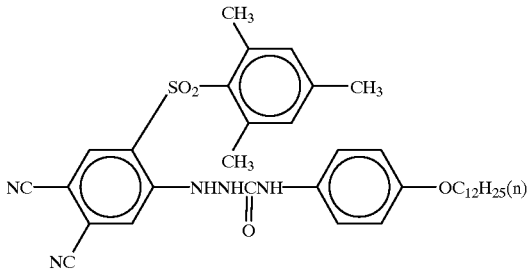
I-8
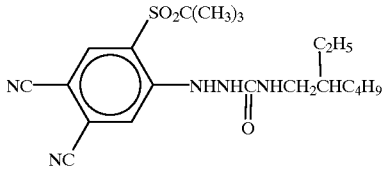
I-9
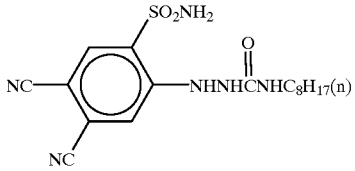
I-10
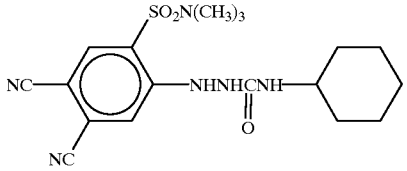

-continued
I-11
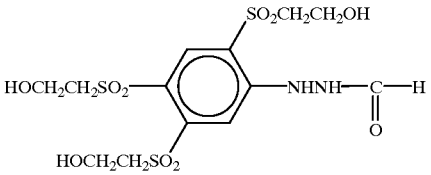
I-12
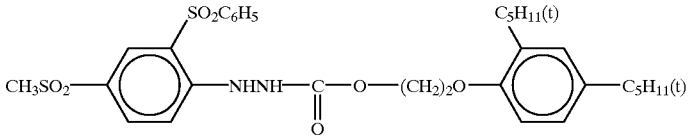
I-13
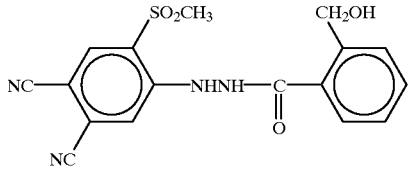
I-14
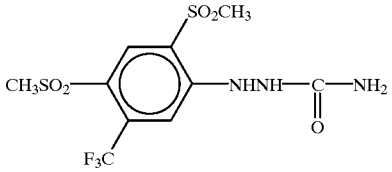
I-15
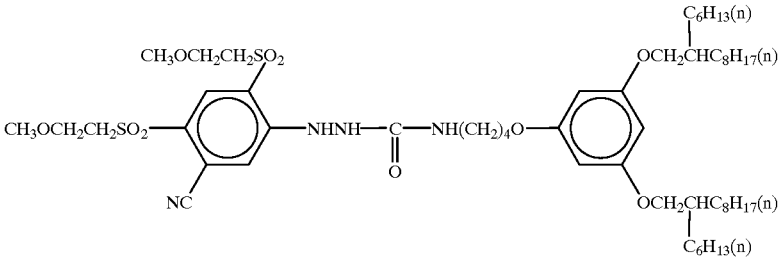
I-16
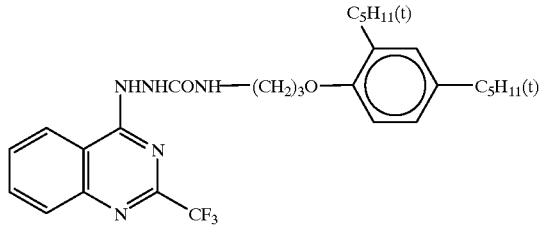
I-17
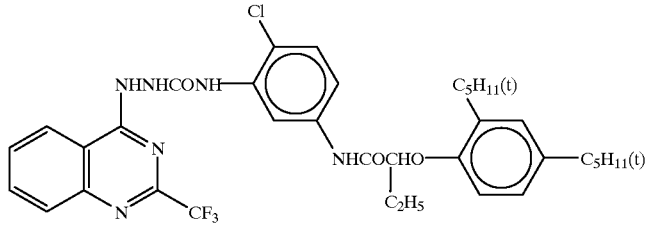

-continued
I-18
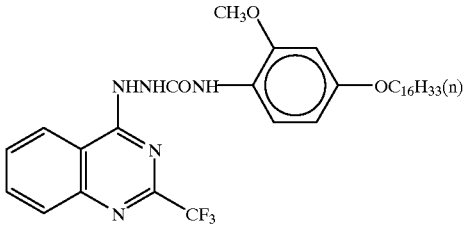
I-19
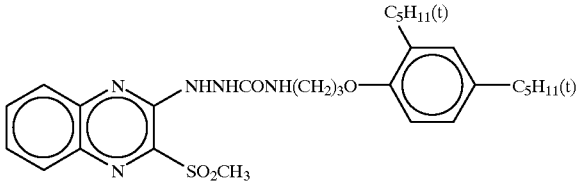
I-20
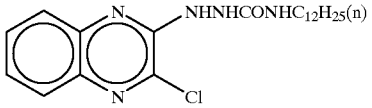
I-21
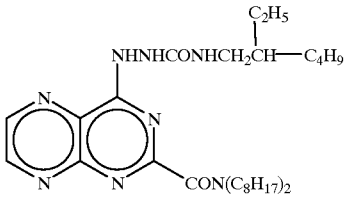
I-22
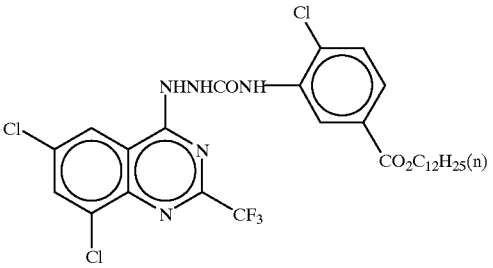
I-23
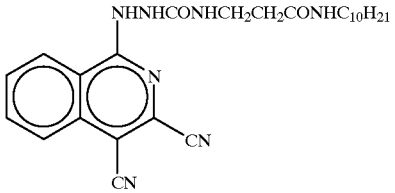
I-24
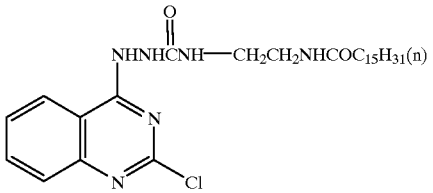

-continued
I-25
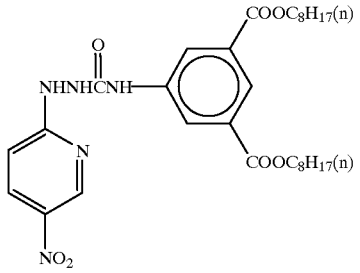
I-26
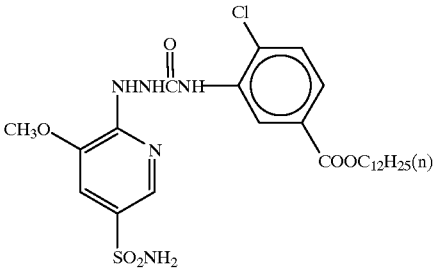
I-27
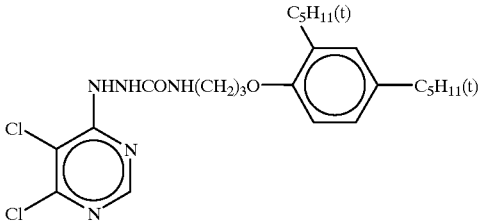
I-28
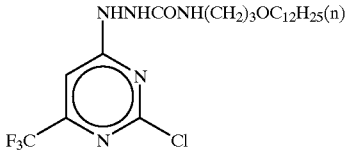
I-29
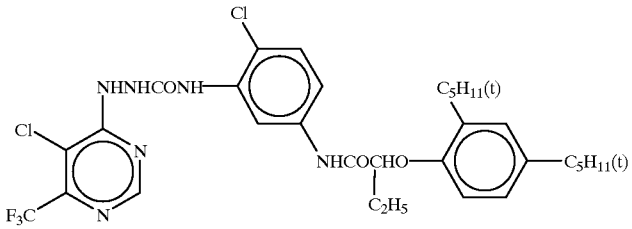
I-30
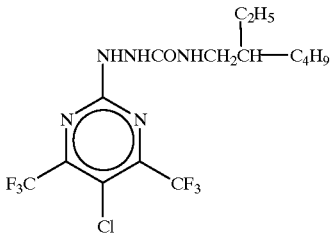

-continued
I-31
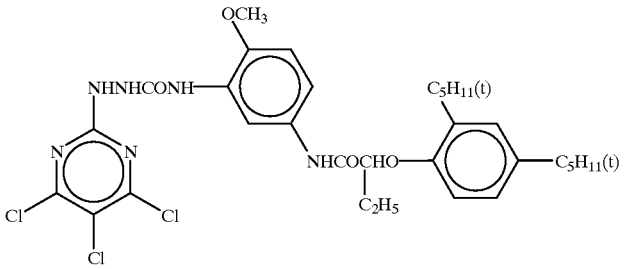
I-32
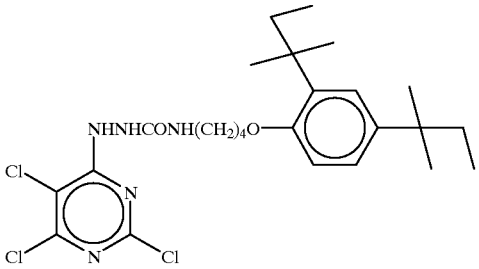
I-33
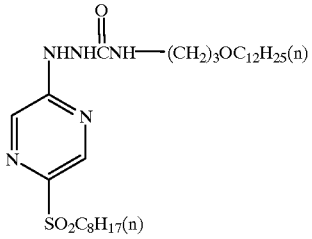
I-34
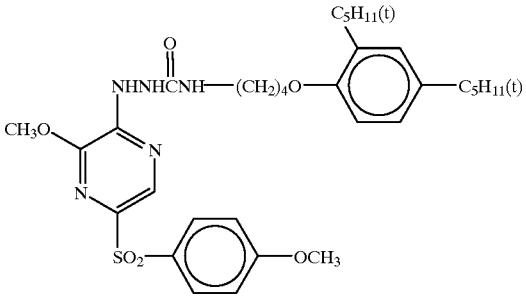
I-35
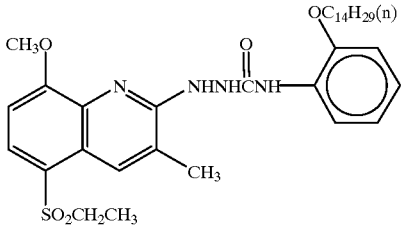
I-36
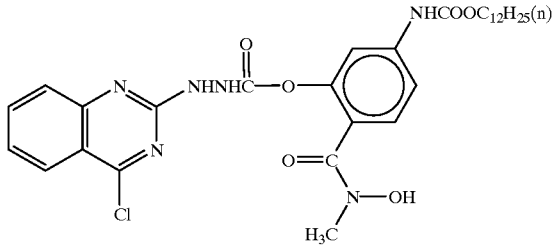

-continued
I-37
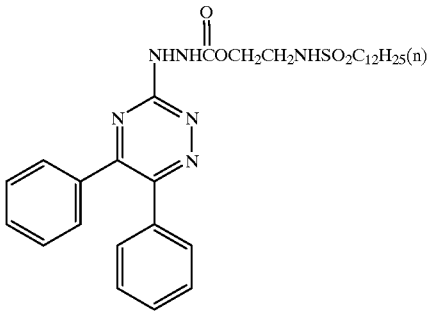
I-38
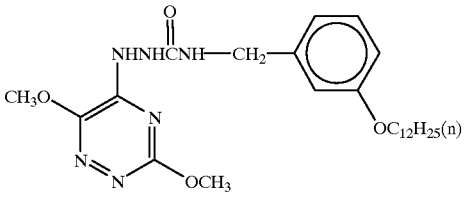
I-39
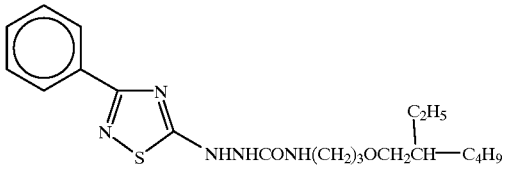
I-40
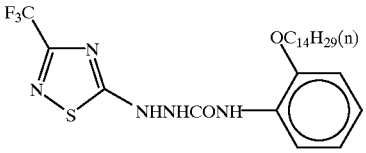
I-41
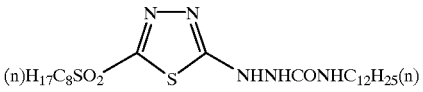
I-42
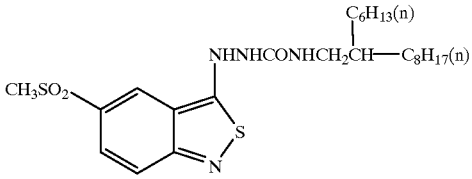
I-43
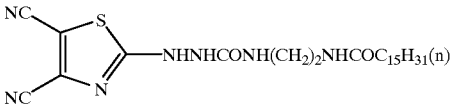
I-44
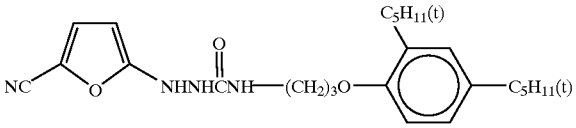

-continued
I-45
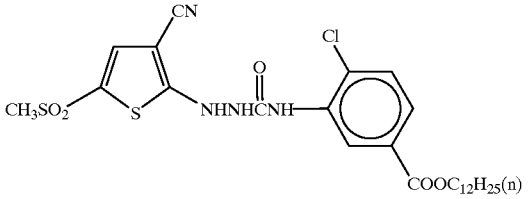
I-46
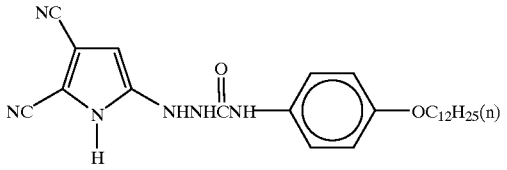
I-47
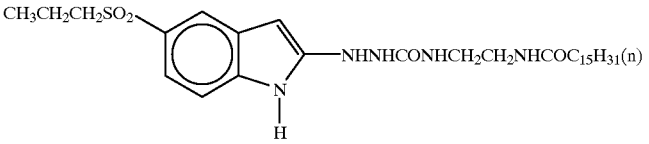
I-48
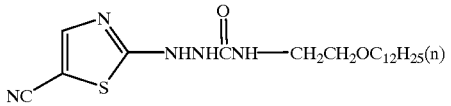
I-49
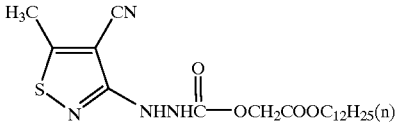
I-50
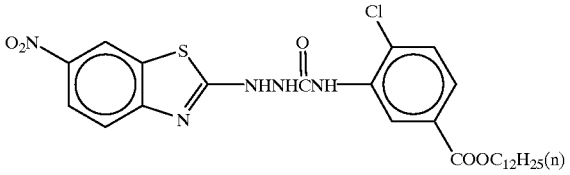
I-51
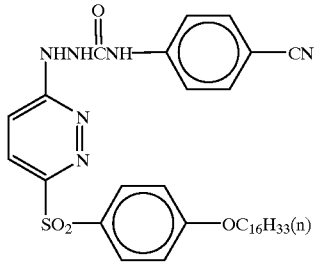
I-52
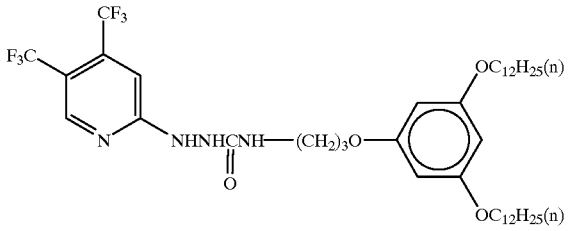

-continued
I-53
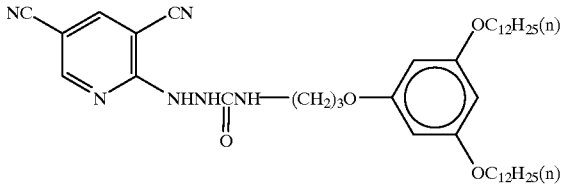
I-54
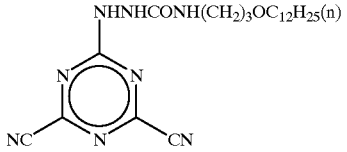
I-55
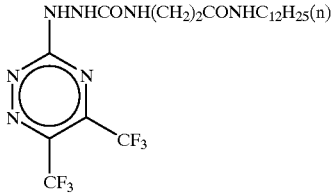
I-56
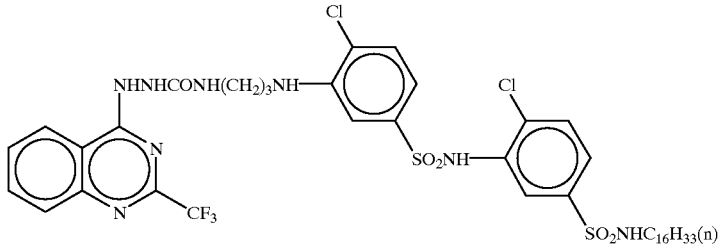
I-57
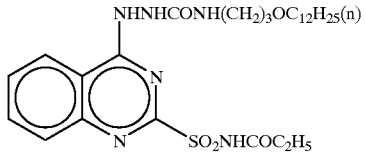
I-58
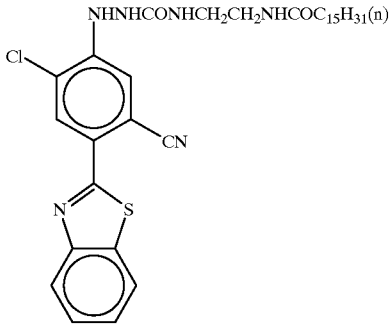
I-59
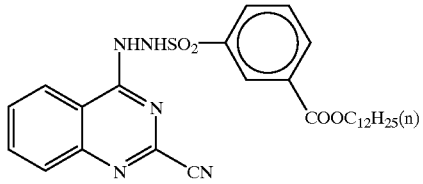

-continued
I-60
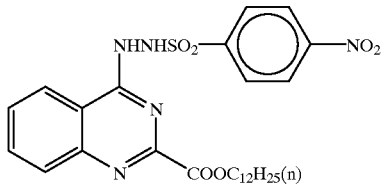
I-61
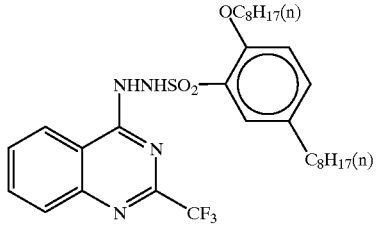
I-62
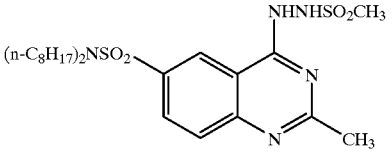
I-63
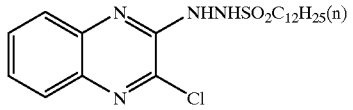
I-64
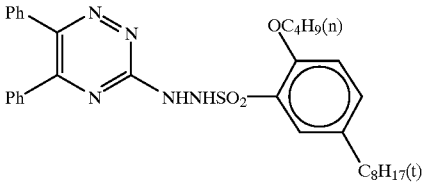
I-65
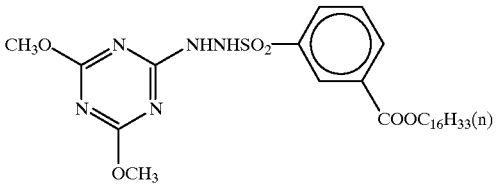
I-66
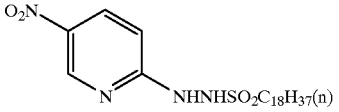
I-67
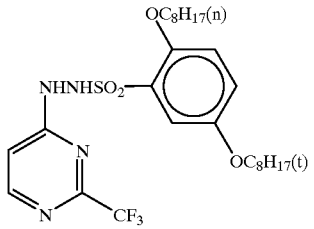

-continued
I-68
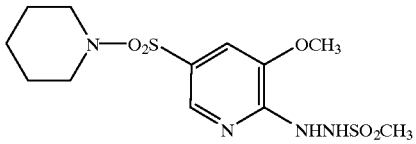
I-69
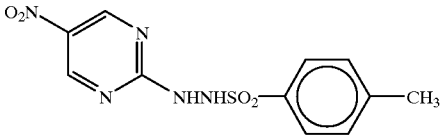
I-70
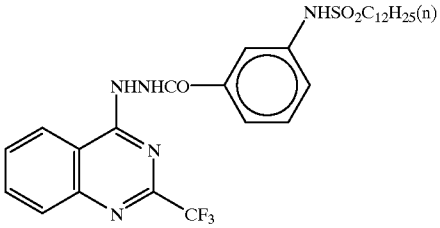
I-71
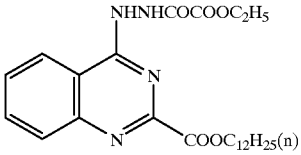
I-72
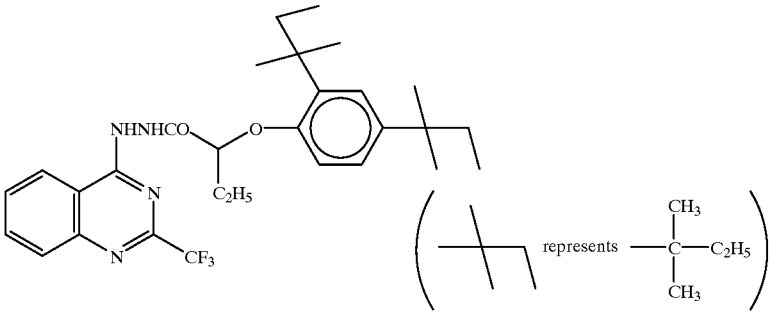
I-73
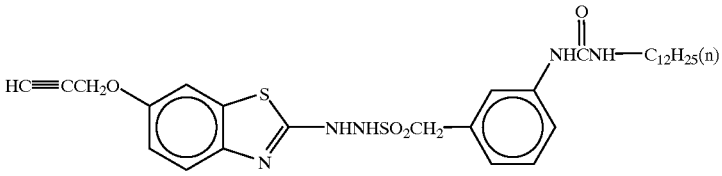
I-74
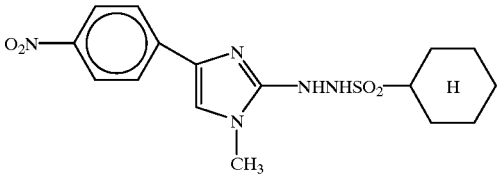

-continued
I-75
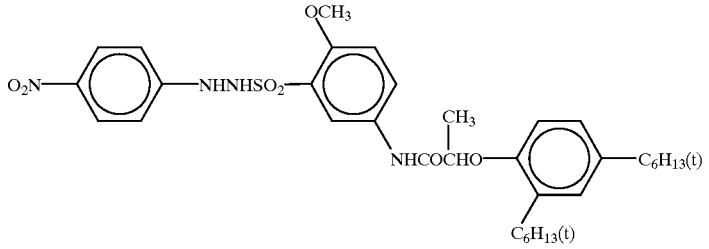
I-76
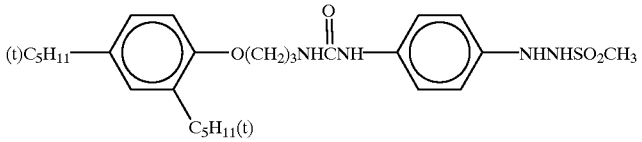
I-77
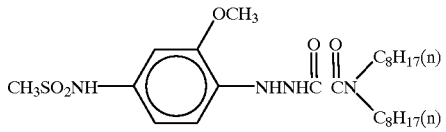
I-78
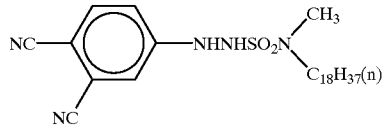
I-79
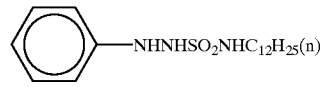
I-80
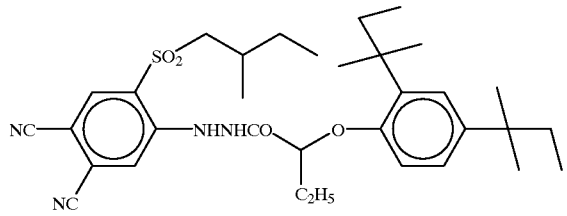
I-81
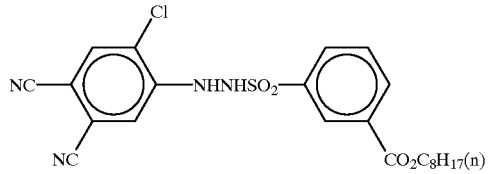
I-82
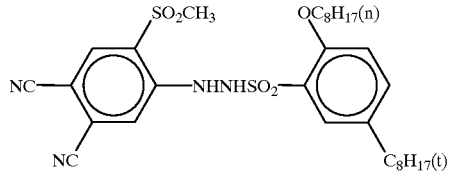

-continued

I-83

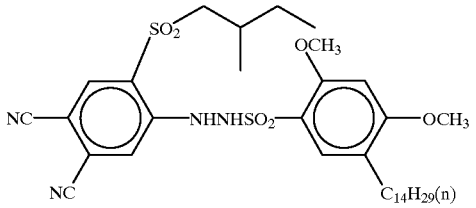

I-84

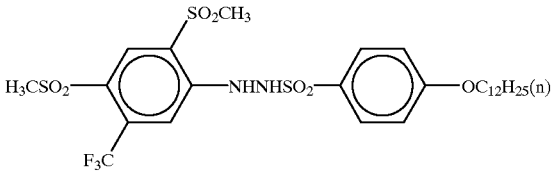

In the present invention, it is possible to use the compound represented by formula (I) or (II) with the compound represented by formula (III) in the same photographic material.

In such a case, these compounds may be used separately in different layers or may be used in the same layer of the photographic material. The ratio of each compound is not limited and may be used in any ratio.

The couplers which are preferably used in the present invention are the compounds having the structures represented by the following formulae (1) to (12). These compounds are generally called active methylene, pyrazolone, pyrazoloazole, phenol, naphthol, pyrrolotriazole, which are well-known compounds in the art.

(1)

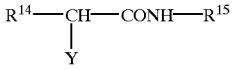

(2)

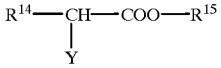

(3)

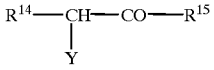

(4)

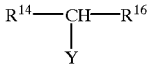

(5)

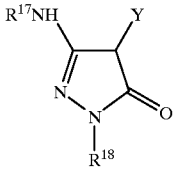

(6)

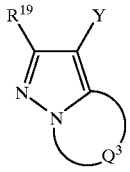

-continued (7)

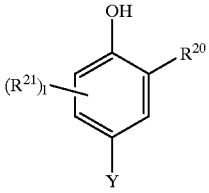

(8)

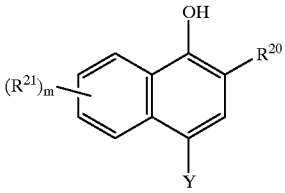

(9)

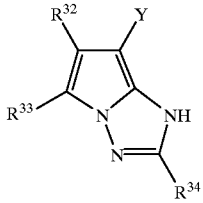

(10)

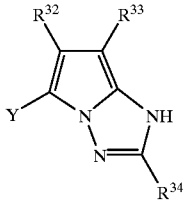

(11)

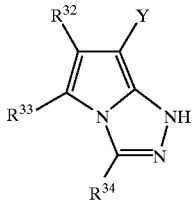

-continued (12)

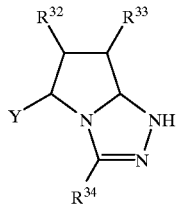

The compounds represented by formulae (1) to (4) are called active methylene couplers, wherein $R^{14}$ represents an acyl group which may have a substituent, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group.

In formulae (1) to (3), $R^{15}$ represents an alkyl group which may have a substituent, an aryl group or a heterocyclic residue. In formula (4), $R^{16}$ represents an aryl group which may have a substituent or a heterocyclic residue. The above-described substituents for $X^1$ to $X^5$ can be cited as examples of substituents for $R^{14}$, $R^{15}$ and $R^{16}$.

In formulae (1) to (4), Y represents a hydrogen atom or a group capable of elimination by a coupling reaction with the oxidation product of a color-forming reducing agent. Examples of Y include a heterocyclic group (a saturated or unsaturated 5-to 7-membered monocyclic or condensed ring containing at least one of a nitrogen atom, an oxygen atom or a sulfur atom as a hetero atom, e.g., succinimido, maleinimido, phthalimido, diglycolimido, pyrrole, pyrazole, imidazole, 1,2,4-triazole, tetrazole, indole, benzopyrazole, benzimidazole, benzotriazole, imidazoline-2,4-dione, oxazolidine-2,4-dione, thiazolidine-2,4-dione, imidazolidin-2-one, oxazolin-2-one, thiazolin-2-one, benzimidazolin-2-one, benzoxazolin-2-one, benzothiazolin-2-one, 2-pyrrolin-5-one, 2-imidazolin-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine, 2-imino-1,3,4-thiazolidin-4-one), a halogen atom (e.g., chlorine, bromine), an aryloxy group (e.g., phenoxy, 1-naphthoxy), a heterocyclic oxy group (e.g., pyridyloxy, pyrazolyloxy), an acyloxy group (e.g., acetoxy, benzoyloxy), an alkoxy group (e.g., methoxy, dodecyloxy), a carbamoyloxy group (e.g., N,N-diethylcarbamoyloxy, morpholinocarbonyloxy), an aryloxycarbonyloxy group (e.g., mophenoxycarbonyloxy), an alkoxycarbonyloxy group (e.g., methoxycarbonyloxy, ethoxycarbonyloxy), an arylthio group (e.g., phenylthio, naphthylthio), a heterocyclic thio group (e.g., tetrazolylthio, 1,3,4-thiadiazolylthio, 1,3,4-oxadiazolylthio, benzimidazolylthio), an alkylthio group (e.g., methylthio, octylthio, hexadecylthio), an alkylsulfonyloxy group (e.g., methanesulfonyloxy), an arylsulfonyloxy group (e.g., benzenesulfonyloxy, toluenesulfonyloxy), a carbonamido group (e.g., acetamido, trifluoroacetamido), a sulfonamido group (e.g., methanesulfonamido, benzenesulfonamido), an alkylsulfonyl group (e.g., methanesulfonyl), an arylsulfonyl group (e.g., benzenesulfonyl), an alkylsulfinyl group (e.g., methanesulfinyl), an arylsulfinyl group (e.g., benzenesulfinyl), an arylazo group (e.g., phenylazo, naphthylazo) and a carbamoylamino group (e.g., N-methylcarbamoylamino).

Y may be substituted with a substituent, and substituents described for $X^1$ to $X^5$ can be cited as examples of substituents for Y.

Y preferably represents a halogen atom, an aryloxy group, a heterocyclic oxy group, an acyloxy group, an aryloxycarbonyloxy group, an alkoxycarbonyloxy group, or a carbamoyloxy group.

In formulae (1) to (4), $R^{14}$ and $R^{15}$, and $R^{14}$ and $R^{16}$ may be connected to each other to form a ring.

The compounds represented by formula (5) are called 5-pyrazolone couplers, wherein $R^{17}$ represents an alkyl group, an aryl group, an acyl group, or a carbamoyl group. $R^{18}$ represents a phenyl group or a phenyl group substituted with one or more of a halogen atom, an alkyl group, a cyano group, an alkoxy group, an alkoxycarbonyl group and an acylamino group.

Of the 5-pyrazolone couplers represented by formula (5), those in which $R^{17}$ represents an aryl group or an acyl group, and $R^{18}$ represents a phenyl group substituted with one or more of a halogen atom(s) are preferred.

These groups are described in detail below. $R^{17}$ represents an aryl group such as phenyl, 2-chlorophenyl, 2-methoxyphenyl, 2-chloro-5-tetradecanamidophenyl, 2-chloro-5-(3-octadecenyl-1-succinimido)phenyl, 2-chloro-5-octadecylsulfonamidophenyl, or 2-chloro-5-[2-(4-hydroxy-3-t-butylphenoxy)tetradecanamido]phenyl, or an acyl group such as acetyl, 2-(2,4-di-t-pentylphenoxy) butanoyl, benzoyl, or 3-(2,4-di-t-amylphenoxyacetamido) benzoyl. These groups may further have a substituent, e.g., an organic substituent linked via a carbon atom, an oxygen atom, a nitrogen atom or a sulfur atom, or a halogen atom. Y has the same meaning as described above.

$R^{18}$ preferably represents a substituted phenyl group such as 2,4,6-trichlorophenyl, 2,5-dichlorophenyl or 2-chlorophenyl.

The compounds represented by formula (6) are called pyrazoloazole couplers, wherein $R^{19}$ represents a hydrogen atom or a substituent. $Q^3$ represents a nonmetallic atomic group necessary to form a 5-membered azole ring containing from 2 to 4 nitrogen atoms, and the azole ring may have a substituent (including a condensed ring).

Of the pyrazoloazole couplers represented by formula (6), in view of the spectral absorption characteristics of a colored dye, imidazo[1,2-b]pyrazoles disclosed in U.S. Pat. No. 4,500,630, pyrazolo[1,5-b]-1,2,4-triazoles disclosed in U.S. Pat. No. 4,500,654, and pyrazolo[5,1-c]-1,2,4-triazoles disclosed in U.S. Pat. No. 3,725,067 are preferred.

Details of the substituents of the azole ring represented by the substituent $R^{19}$ and $Q^3$ are disclosed, for example, in U.S. Pat. No. 4,540,654, the second column, line 41 to the eighth column, line 27. Preferred examples include the pyrazoloazole coupler in which a branched alkyl group is directly bonded to the 2-, 3- or 6-position of the pyrazolotriazole group as disclosed in JP-A-61-65245, the pyrazoloazole coupler having a sulfonamido group in the molecule disclosed in JP-A-61-65245, the pyrazoloazole coupler having an alkoxyphenylsulfonamido ballast group as disclosed in JP-A-61-147254, the pyrazolotriazole coupler having an alkoxy group or an aryloxy group at the 6-position as disclosed in JP-A-62-209457 and JP-A-63-307453, and the pyrazolotriazole coupler having a carbonamido group in the molecule as disclosed in JP-A-2-201443. Y has the same meaning as described above.

The compounds represented by formulae (7) and (8) are called phenol couplers and naphthol couplers, respectively, wherein $R^{20}$ represents a hydrogen atom or a group selected from the group consisting of $—CONR^{22}R^{23}—$, $—SO_2NR^{22}R^{23}$, $—NHCOR^{22}$, $—NHCONR^{22}R^{23}$, and $—NHSO_2NR^{22}R^{23}$, wherein $R^{22}$ and $R^{23}$ represent a hydrogen atom or a substituent. In formulae (7) and (8), $R^{21}$ represents a substituent, 1 represents 0 or an integer of 1 or 2, and m represents 0 or an integer of 1, 2, 3 or 4. When 1 and m each represents 2 or more, a plurality of $R^{21}$'s may be different. The substituents for $X^1$ to $X^5$ in formulae (II) and (IV) described above can be cited as the substituents for $R^{21}$, $R^{22}$ and $R^{23}$. Y has the same meaning as described above.

Preferred examples of the phenol couplers represented by formula (7) include the 2-alkylamino-5-alkylphenol couplers disclosed in U.S. Pat. Nos. 2,369,929, 2,801,171, 2,772,162, 2,895,826 and 3,772,002; the 2,5-diacylaminophenol couplers disclosed in U.S. Pat. Nos. 2,772,162, 3,758,308, 4,126,396, 4,334,011, 4,327,173, West German Patent 3,329,729, and JP-A-59-166956; and the 2-phenylureido-5-acylaminophenol couplers disclosed in U.S. Pat. Nos. 3,446,622, 4,333,999, 4,451,559, and 4,427,767. Y has the same meaning as described above.

Preferred examples of the naphthol couplers represented by formula (8) include the 2-carbamoyl-1-naphthol couplers disclosed in U.S. Pat. Nos. 2,474,293, 4,052,212, 4,146,396, 4,282,233, and 4,296,200; and the 2-carbamoyl-5-amido-1-naphthol couplers disclosed in U.S. Pat. No. 4,690,889. Y has the same meaning as described above.

The compounds represented by formulae (9) to (12) are called pyrrolotriazole couplers, wherein $R^{32}$, $R^{33}$ and $R^{34}$ each represents a hydrogen atom or a substituent. Y has the same meaning as described above. The substituents for $R^{32}$, $R^{33}$ and $R^{34}$ are the same as those described above as the substituents for $X^1$ to $X^5$. Preferred examples of the pyrrolotriazole couplers represented by formulae (9) to (12) include the couplers as disclosed in EP-A-488248, EP-A-491197 and European Patent 545300, in which at least either $R^{32}$ or $R^{33}$ represents an electron attractive group. Y has the same meaning as described above.

In addition to the above, couplers having the structures such as condensed ring phenol, imidazole, pyrrole, 3-hydroxypyridine, active methylenes other than those described above, active methine, a 5,5-condensed heterocyclic ring, and a 5,6-condensed heterocyclic ring can be used.

As condensed phenol couplers, the couplers disclosed in U.S. Pat. Nos. 4,327,173, 4,564,586 and 4,904,575 can be used.

As imidazole couplers, the couplers disclosed in U.S. Pat. Nos. 4,818,672 and 5,051,347 can be used.

As 3-hydroxypyridine couplers, the couplers disclosed in JP-A-1-315736 can be used.

As active methylene and active methine couplers, the couplers disclosed in U.S. Pat. Nos. 5,104,783 and 5,162,196 can be used.

As 5,5-condensed heterocyclic ring couplers, the pyrrolopyrazole couplers disclosed in U.S. Pat. No. 5,164,289, and the pyrroloimidazole couplers disclosed in JP-A-4-174429 can be used.

As 5,6-condensed heterocyclic ring couplers, the pyrazolopyrimidine couplers disclosed in U.S. Pat. No. 4,950,585, the pyrrolotriazine couplers disclosed in JP-A-4-204730 and the couplers disclosed in European Patent 556700 can be used.

Besides the above-described couplers, the couplers disclosed in West German Patents 3,819,051A, 3,823,049, U.S. Pat. Nos. 4,840,883, 5,024,930, 5,051,347, 4,481,268, EP-A-304856, European Patent 329036, EP-A-354549, EP-A-374781, EP-A-379110, EP-A-386930, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732 can also be used in the present invention.

Specific examples of the couplers which can be used in the present invention are shown below, but the present invention is not limited thereto.

(C-1)

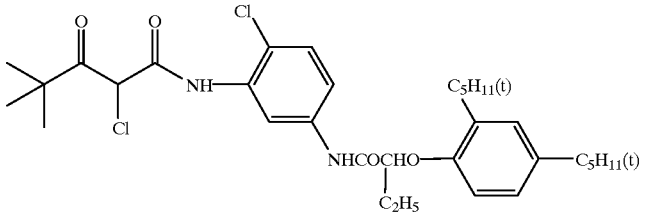

(C-2)

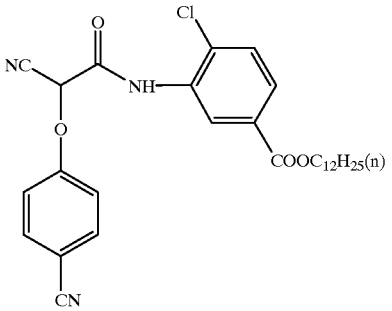

-continued
(C-3)
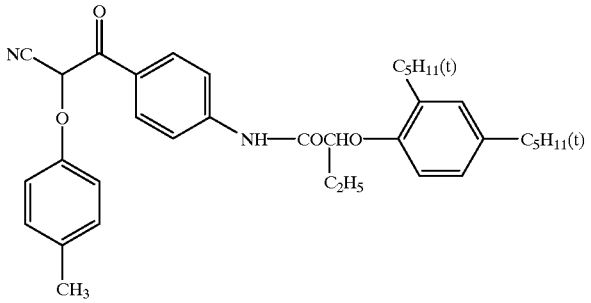
(C-4)
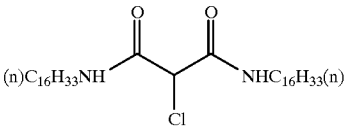
(C-5)
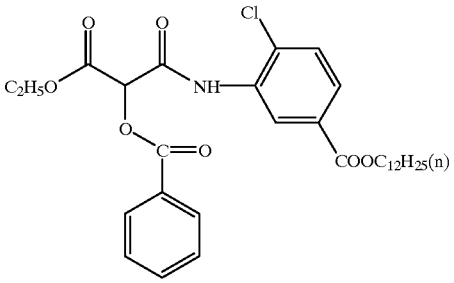
(C-6)
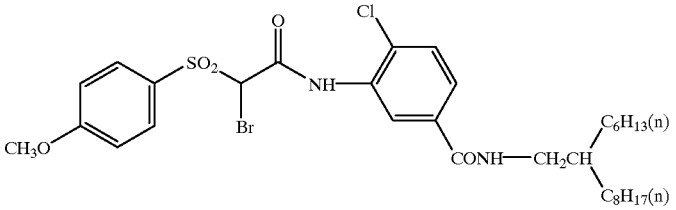
(C-7)
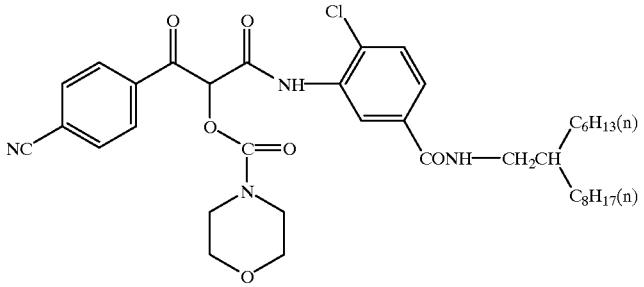
(C-8)
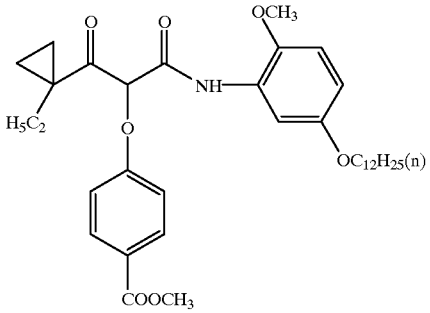

-continued
(C-9)
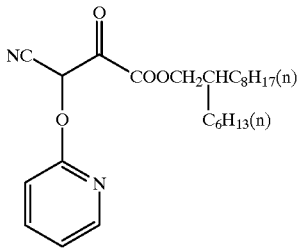
(C-10)
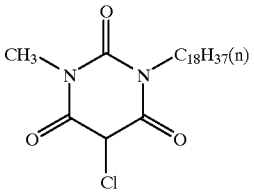
(C-11)
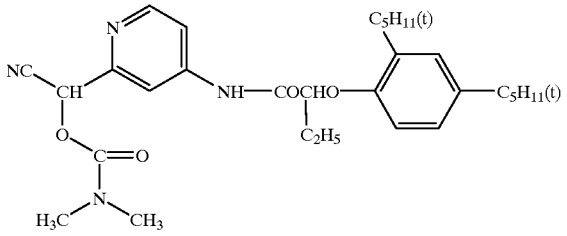
(C-12)
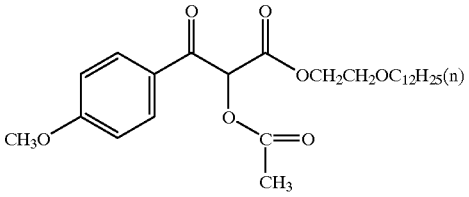
(C-13)
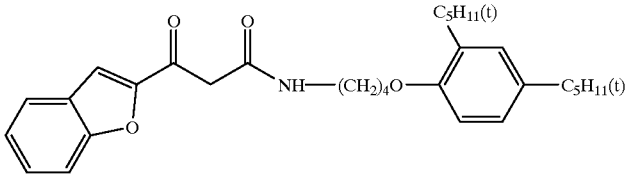
(C-14)
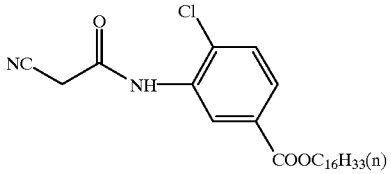
(C-15)
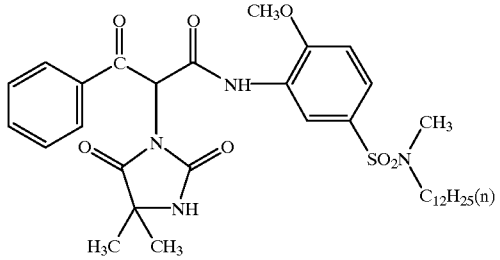

-continued
(C-16)
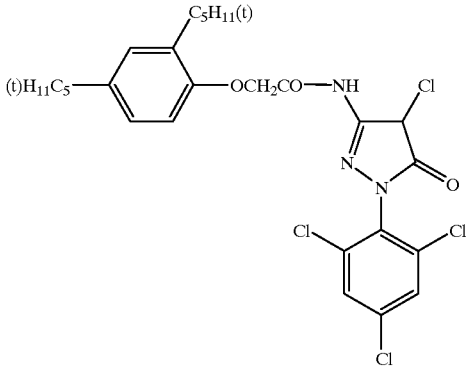
(C-17)
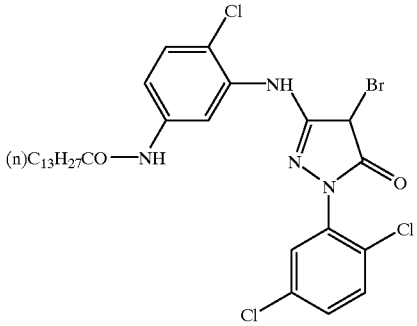
(C-18)
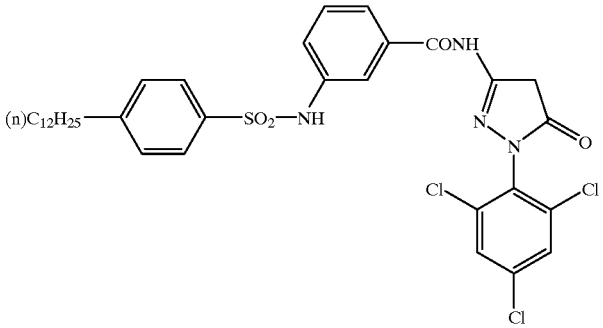
(C-19)
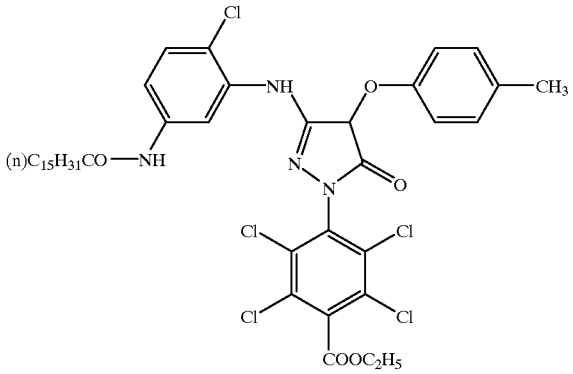

-continued
(C-20)
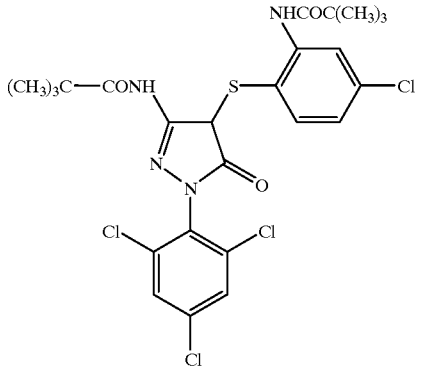
(C-21)
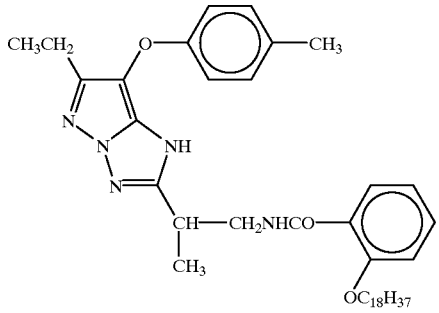
(C-22)
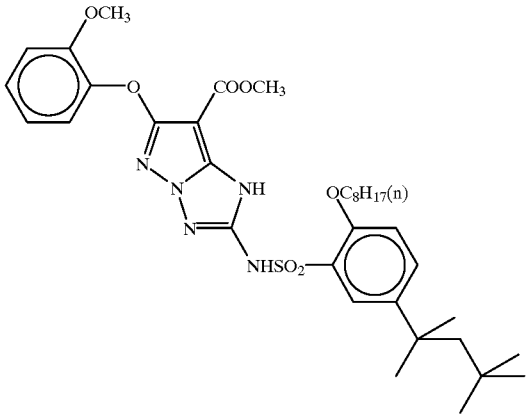
(C-23)
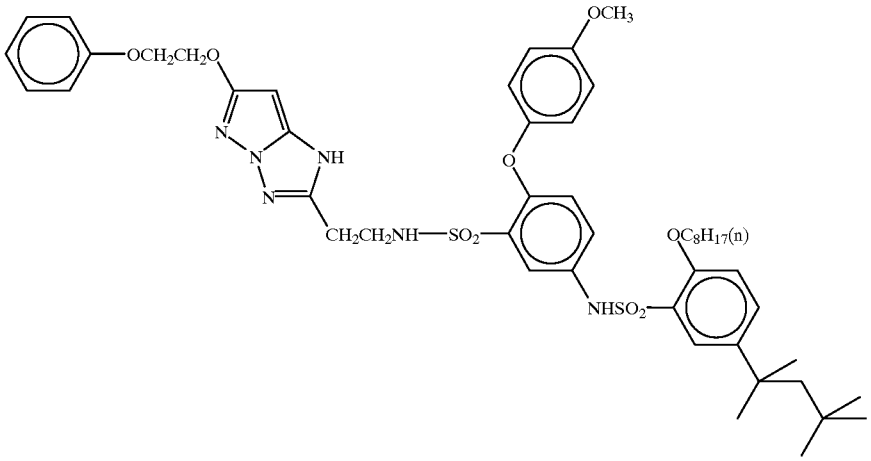

-continued
(C-24)
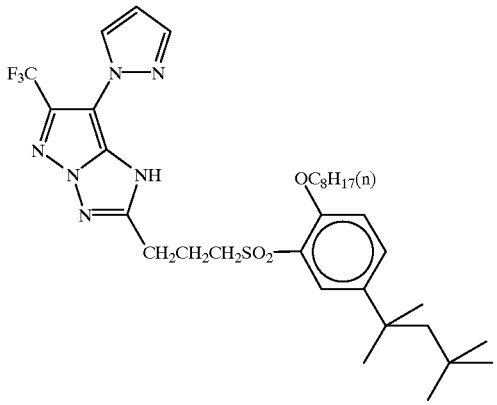
(C-25)
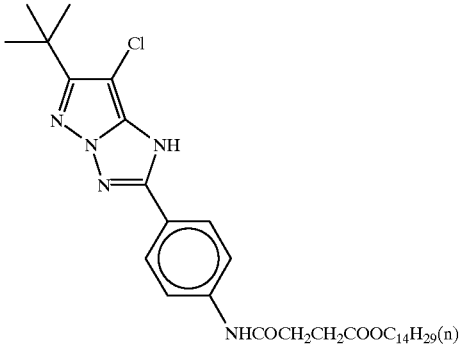
(C-26)
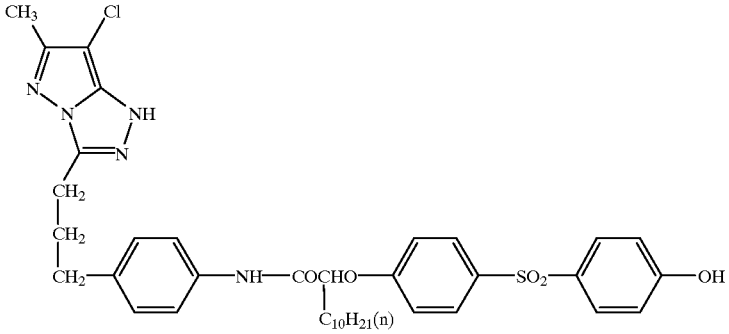

-continued
(C-27)
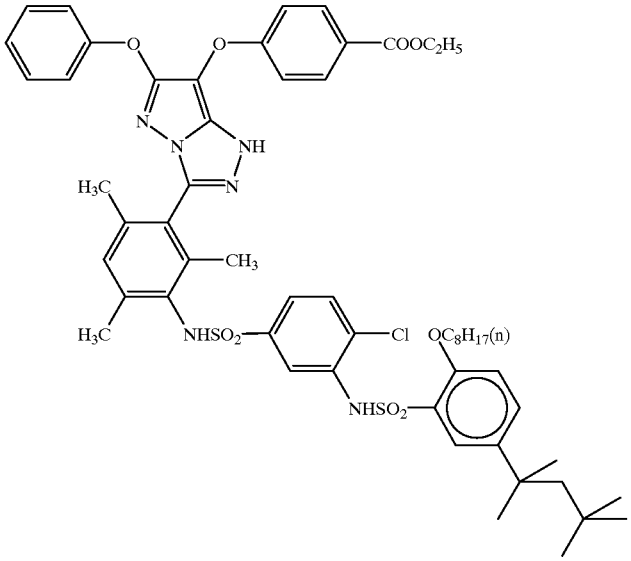
(C-28)
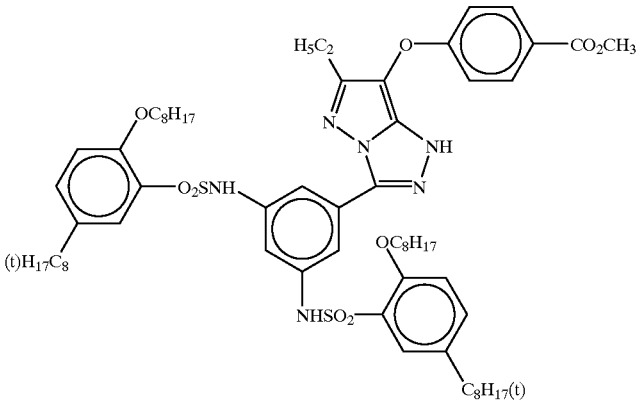
(C-29)
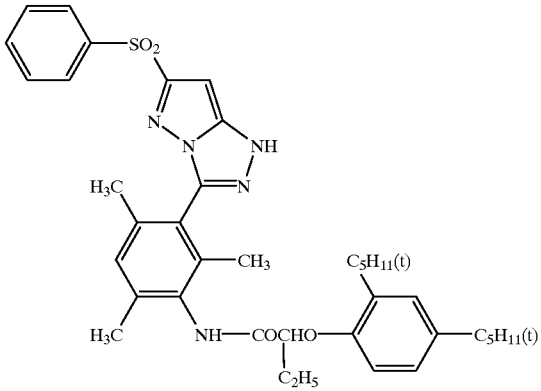

-continued
(C-30)
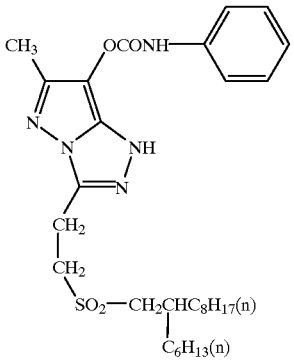
(C-31)
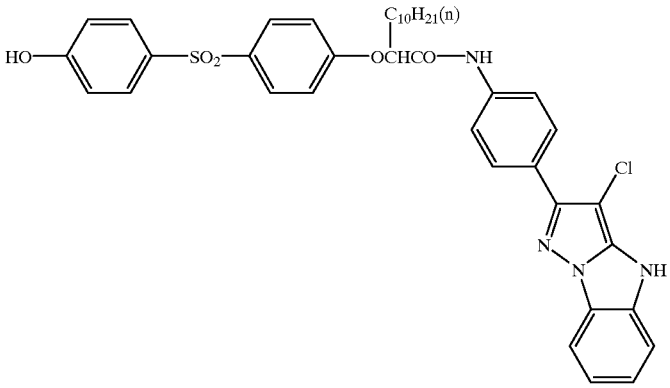
(C-32)
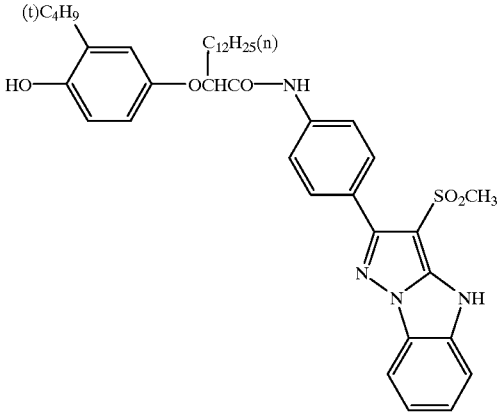
(C-33)
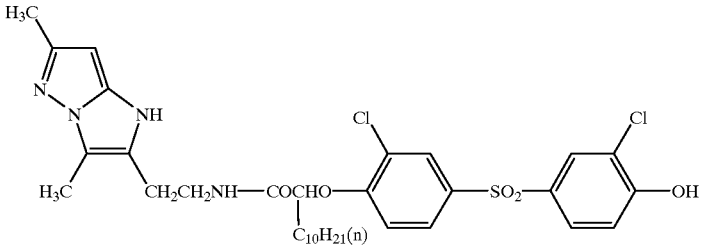

-continued
(C-34)
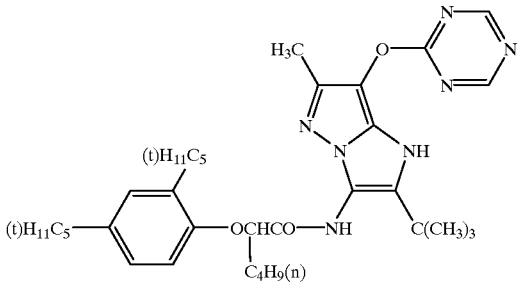
(C-35)
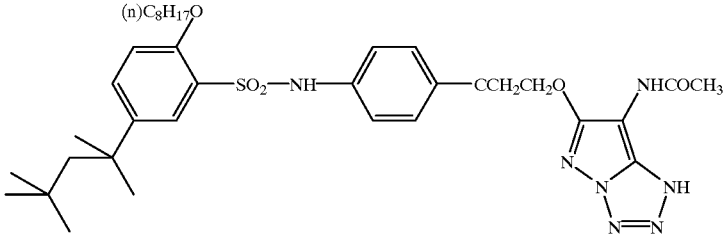
(C-36)
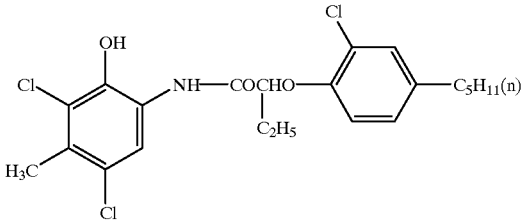
(C-37)
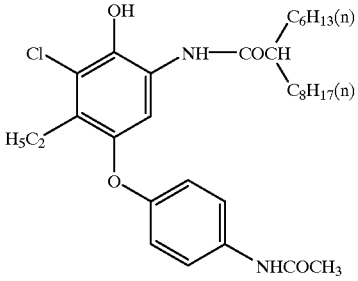
(C-38)
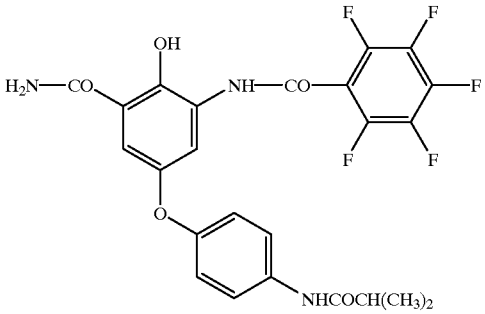
(C-39)
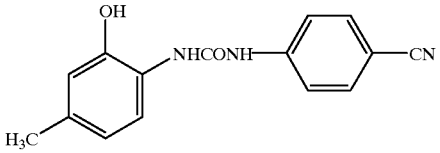

-continued
(C-40)
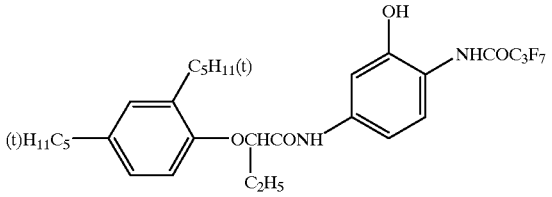
(C-41)
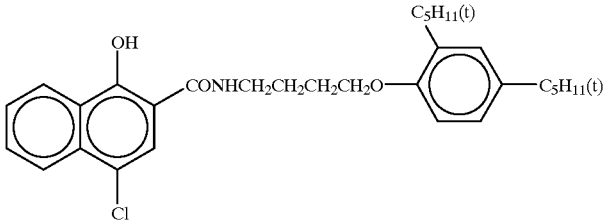
(C-42)
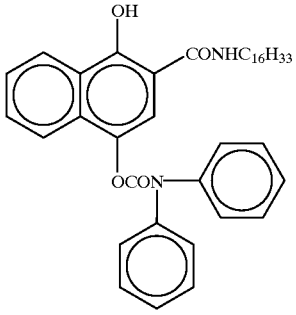
(C-43)
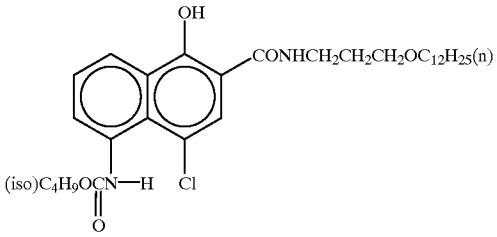
(C-44)
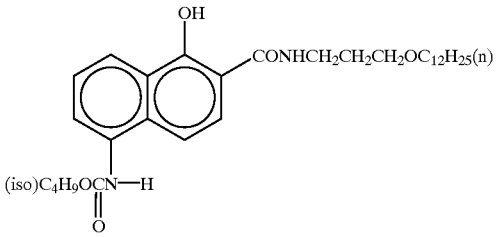

-continued
(C-45)
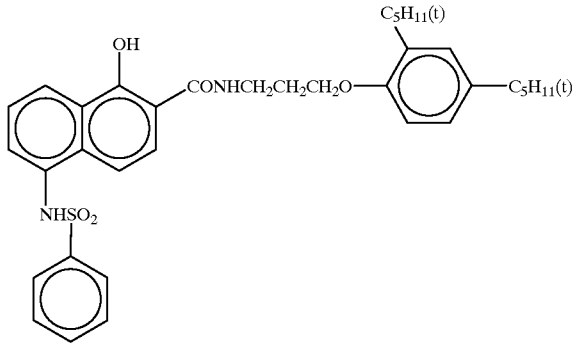
(C-46)
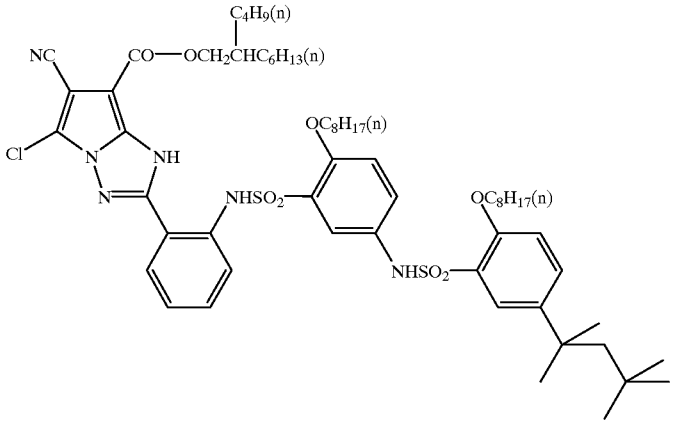
(C-47)
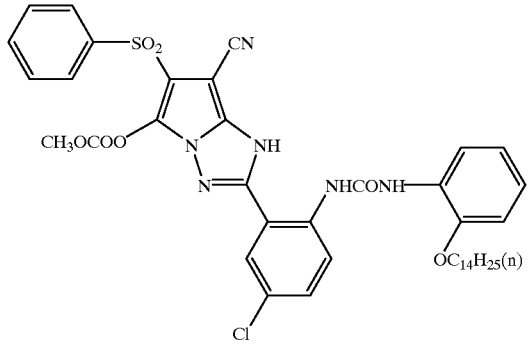
(C-48)
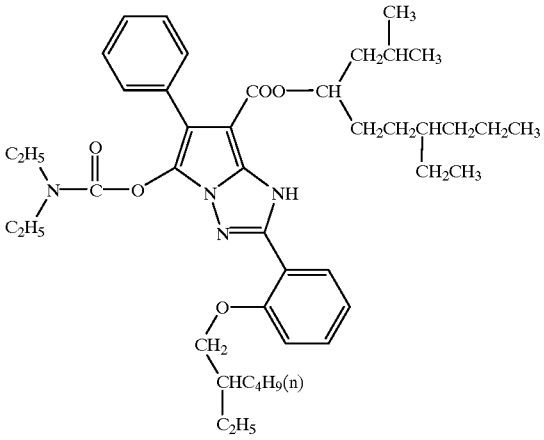

-continued
(C-49)
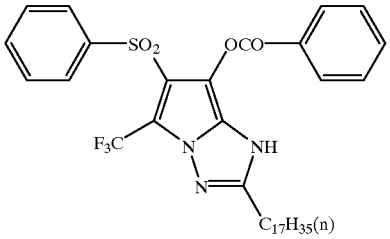
(C-50)
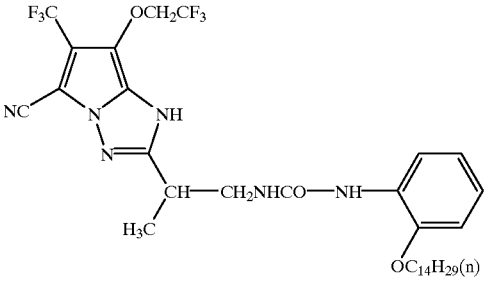
(C-51)
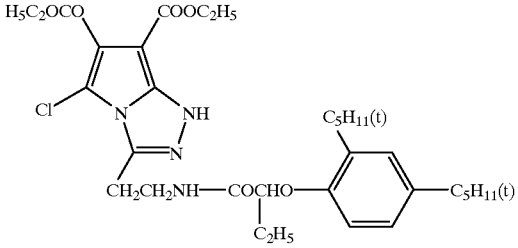
(C-52)
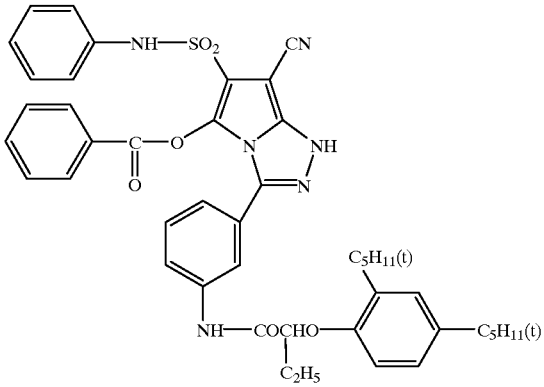

-continued
(C-53)
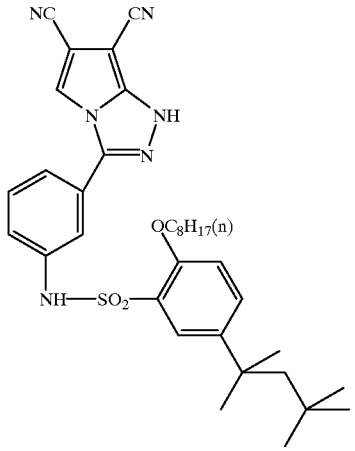
(C-54)
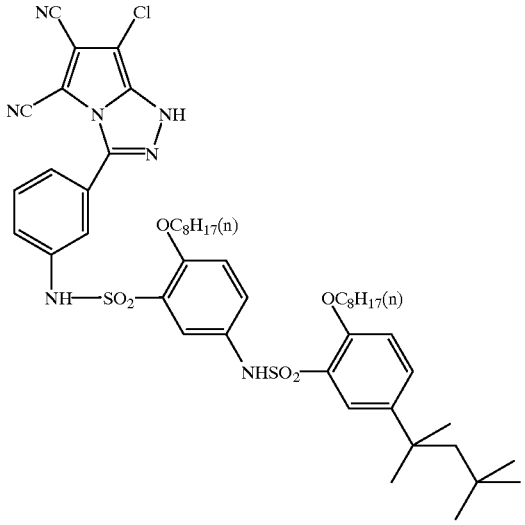
(C-55)
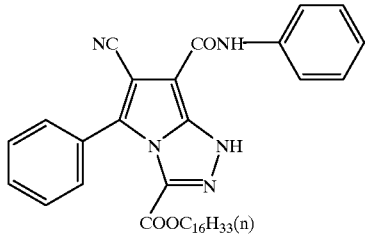
(C-56)
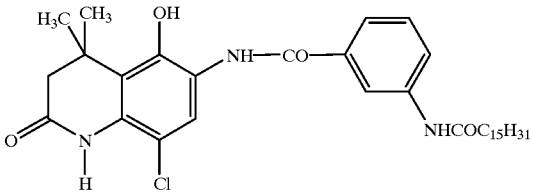

-continued
(C-57)
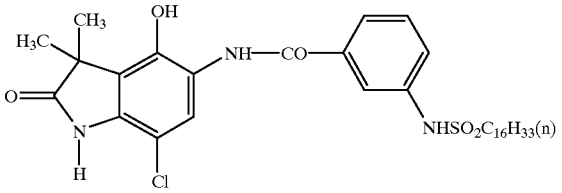
(C-58)
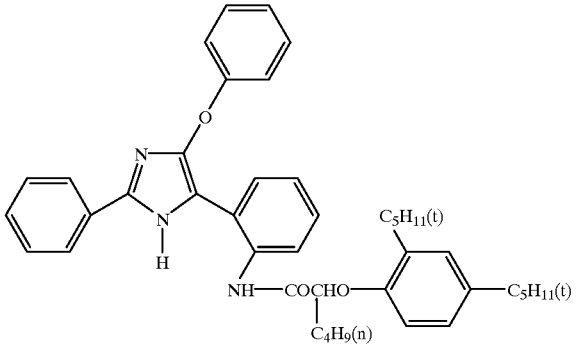
(C-59)
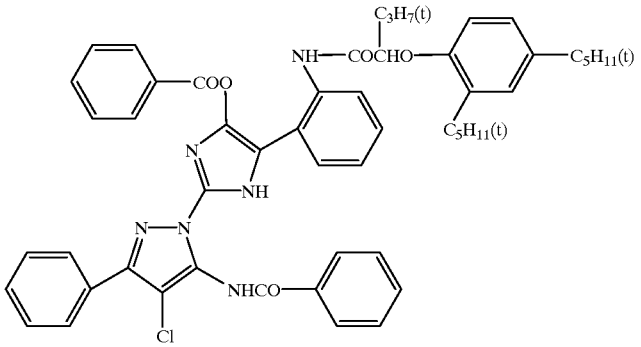
(C-60)
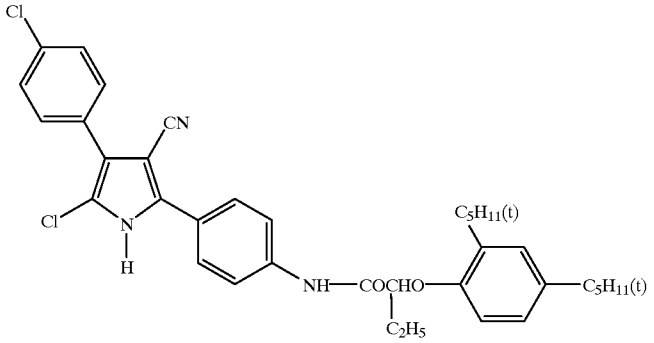
(C-61)
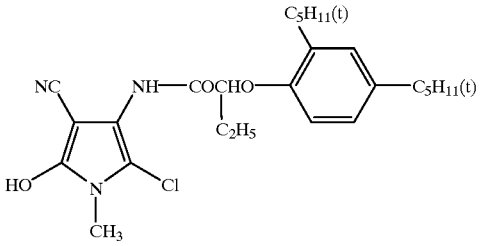

-continued
(C-62)
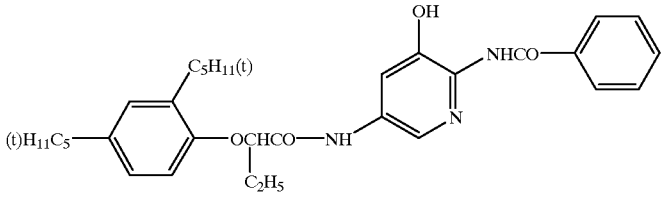
(C-63)
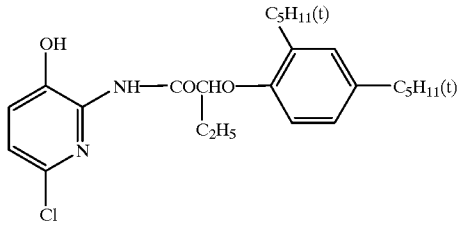
(C-64)
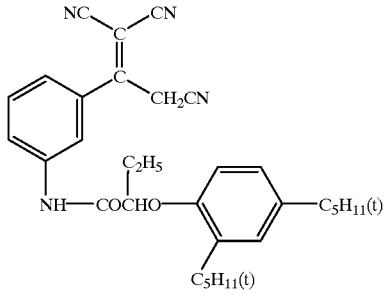
(C-65)
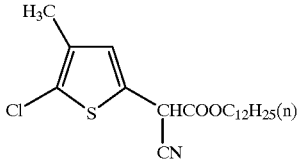
(C-66)
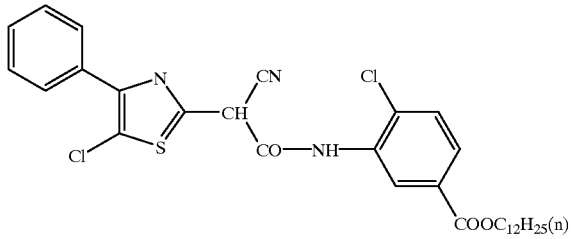
(C-67)
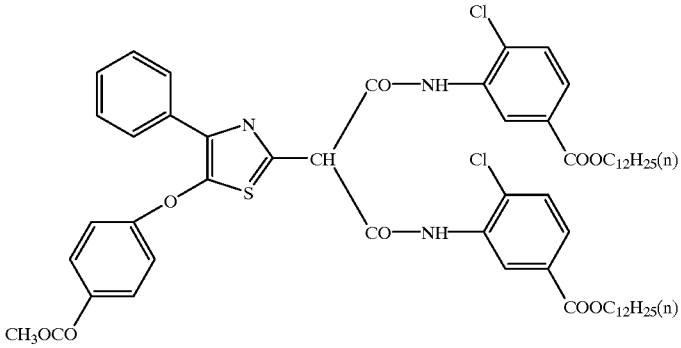

-continued
(C-68)
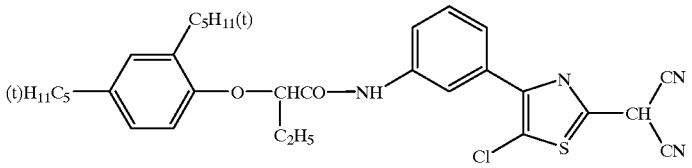
(C-69)
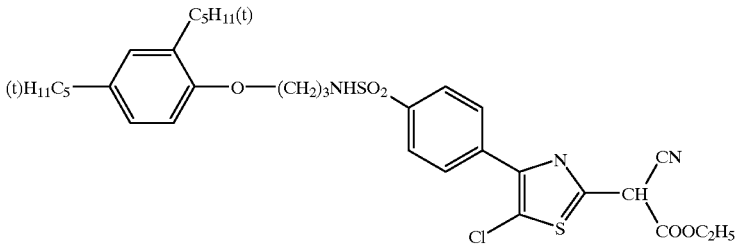
(C-70)
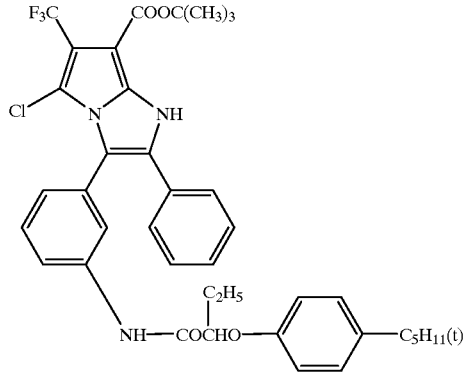
(C-71)
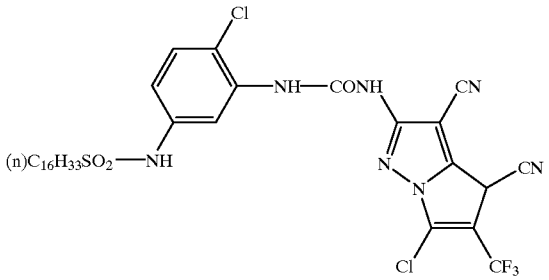
(C-72)
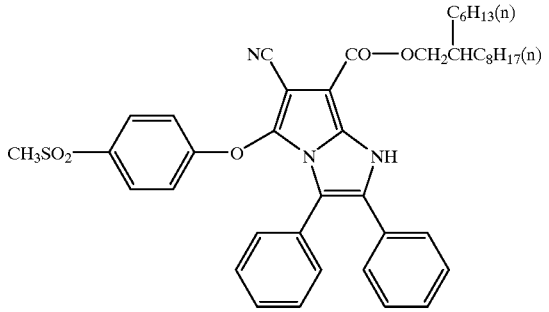

-continued
(C-73)
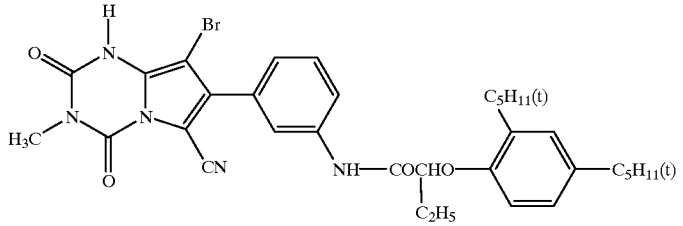
(C-74)
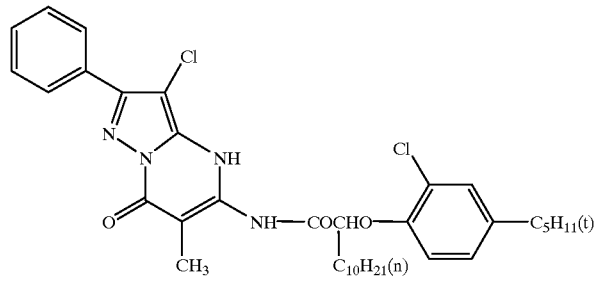
(C-75)
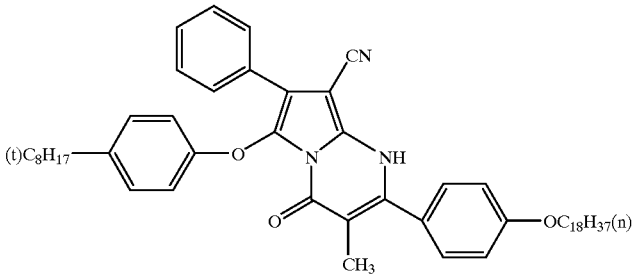
(C-76)
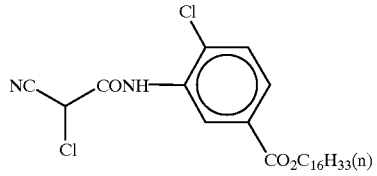
(C-77)
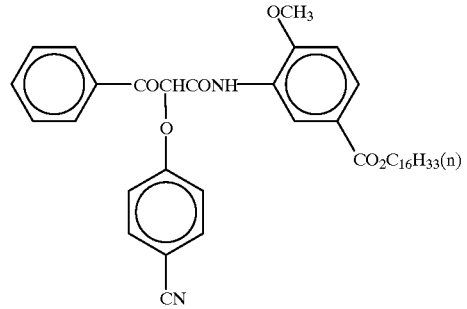
(C-78)
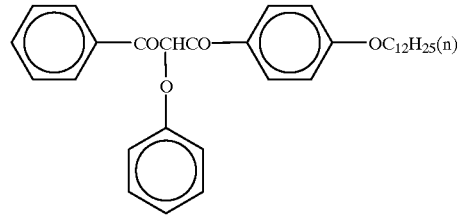

-continued
(C-79)
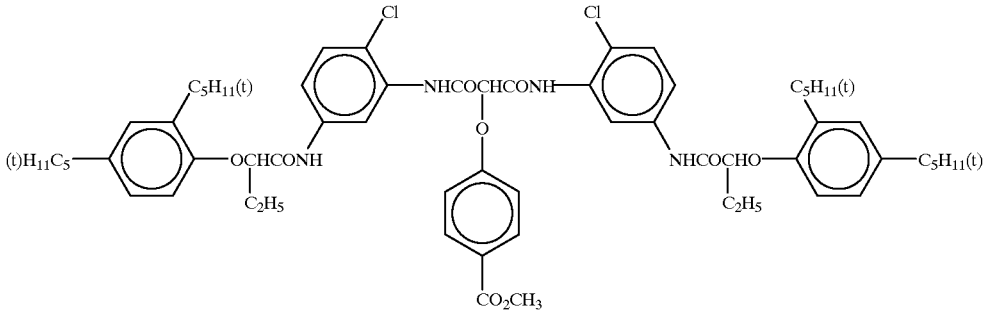
(C-80)
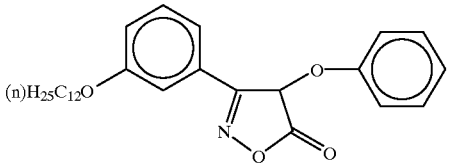
(C-81)
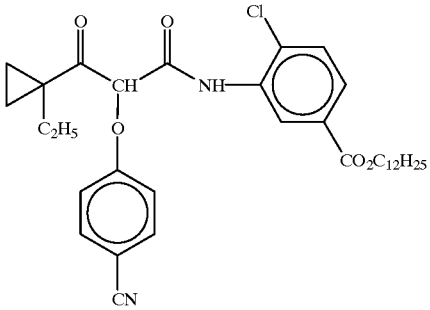
(C-82)
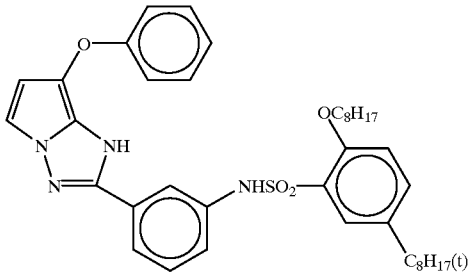

-continued (C-83)

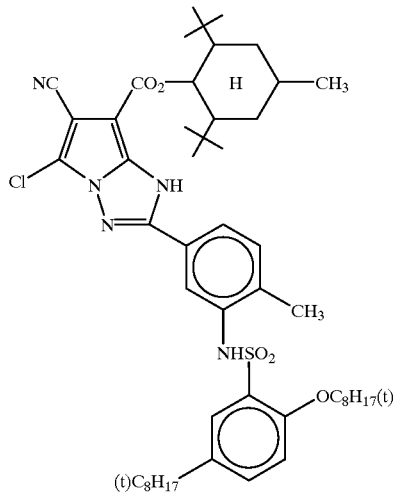

The color-forming reducing agent according to the present invention is preferably used, for obtaining sufficient color density, in an amount of from 0.01 to 10 mmol/$m^2$, more preferably from 0.05 to 5 mmol/$m^2$, and particularly preferably from 0.1 to 1 mmol/$m^2$, per one color-forming layer. The use of the color-forming reducing agent within this range is preferred because sufficient color density can be obtained.

The amount of the coupler in the color-forming layer in which the color-forming reducing agent of the present invention is used is preferably from 0.05 to 20 times, more preferably from 0.1 to 10 times, and particularly preferably from 0.2 to 5 times, of the color-forming reducing agent in terms of mol. The use of the coupler within this range is preferred because sufficient color density can be obtained.

The color photographic material for use in the present invention fundamentally comprises a support having coated thereon a photographic constitutional layer comprising at least one hydrophilic colloid layer, and light-sensitive silver halide, a dye-forming coupler and a color-forming reducing agent are added to any of the photographic constitutional layer.

It is the most typical mode for a dye-forming coupler and a color-forming reducing agent to be contained in the same layer but they can be added to different layers separately so long as the reaction can be caused. These components are preferably contained in a silver halide emulsion layer of a photographic material or a layer adjacent thereto, particularly preferably both of them are added to a silver halide emulsion layer.

The color-forming reducing agent and the coupler according to the present invention can be introduced into a photographic material by means of various well-known dispersing methods. An oil-in-water dispersing method comprising dissolving the compounds in a high boiling point organic solvent (a low boiling point organic solvent may be used in combination, if necessary), emulsifying and dispersing the solution in an aqueous solution of gelatin, then adding the dispersion to a silver halide emulsion is preferably used. The high boiling point organic solvents which can be used in the present invention are compounds having a melting point of 100° C. or less, a boiling point of 140° C. or more, immiscible with water and being good solvents for the color-forming reducing agent and the coupler. The melting point of the high boiling point organic solvents is preferably 80° C. or less. The boiling point of the high boiling point organic solvents is preferably 160° C. or more, more preferably 170° C. or more. Such high boiling point organic solvents are described in detail in JP-A-62-215272, p. 137, right lower column to p. 144, right upper column. The high boiling point organic solvents having an electron donative parameter ΔV of 80 or more which are disclosed in JP-A-8-320542 are preferably used in the present invention in view of capable of dissociating at low pH the dye formed from the color-forming reducing agent and the coupler. In the present invention, the amount used of the high boiling point organic solvent is not limited at all but is preferably in the amount of ratio by weight of the high boiling point organic solvent/the color-forming reducing agent of preferably 20 or less, more preferably from 0.02 to 5, and particularly preferably from 0.2 to 4.

Well-known polymer dispersion methods can be used in the present invention. Specific examples of the processes and effects of the latex dispersion method, which is one of the polymer dispersion methods, and examples of latexes for impregnation are disclosed, for example, in U.S. Pat. No. 4,199,363, West German Patent Application (OLS) Nos. 2,541,274 and 2,541,230, JP-B-53-41091 (the term "JP-B" as used herein means an "examined Japanese patent publication"), and European Patent 029104, and the dispersion method using a water-insoluble and organic solvent-soluble polymer is disclosed in WO 88/00723.

There is no particular limitation on the average particle size of the lipophilic fine particles containing the color-forming reducing agent of the present invention, but the average particle size of preferably from 0.05 to 0.3 μm, more preferably from 0.05 μm to 0.2 μm, is preferred in view of color-forming ability.

In general, the average particle size of the lipophilic fine particles can be reduced by various means such as the selection of the kinds of surfactants, increasing the use amount of surfactants, increasing the viscosity of a hydrophilic colloid solution, reducing the viscosity of the lipophilic organic layers by the combined use of a low boiling point organic solvent and the like, heightening a shearing force such as increasing the revolution of stirring blades of an emulsifying apparatus, or lengthening the emulsification time.

The particle size of lipophilic fine particles can be measured using, for example, an apparatus such as a nanosizer manufactured by Coulter Co., U.K.

In the present invention, when the dye formed from the color-forming reducing agent and the dye-forming coupler is a diffusible dye, it is preferred for the photographic material to contain a mordant. If the present invention is adapted to such a form, color development by immersing the material in an alkali solution is not necessary, as a result, image stability after processing is conspicuously improved. The mordant may be used in any layer but if it is used in the layer in which the color-forming reducing agent of the present invention is contained, the stability of the color-forming reducing agent is deteriorated. Accordingly, the mordant is preferably contained in the layer in which the color-forming reducing agent of the present invention is not contained. Further, the dye formed from the color-forming reducing agent and the dye-forming coupler is diffused in a gelatin film swollen in processing and colors the mordant. Diffusion distance is, therefore, preferably short for obtaining good sharpness. Accordingly, it is preferred that the mordant is added to the layer adjacent to the layer in which the color-forming reducing agent is contained.

As the dye formed from the color-forming reducing agent of the present invention and the dye-forming coupler of the present invention is a water-soluble dye, there is the possibility of flowing out of the dye into a processing solution. Therefore, for preventing such a circumstance, it is preferred that the layer in which the mordant is contained is provided on the opposite side of the support to the layer in which the color-forming reducing agent is contained. However, when the barrier layer as disclosed in JP-A-7-168335 is provided on the opposite side of the support to the layer in which the mordant is contained, the layer in which the mordant is contained may be preferably provided on the same side of the support as the layer in which the color-forming reducing agent is contained.

Further, the mordant according to the present invention may be added to a plurality of layers. In particular, when the color-forming reducing agent is contained in a plurality of layers, it is preferred that each layer adjacent thereto contains the mordant.

Any diffusible dye-forming coupler can be used in the present invention so long as the diffusible dye which is formed by the coupling reaction of the coupler with the color-forming reducing agent of the present invention reaches the mordant, but the diffusible dye formed preferably has one or more dissociable group having pKa (acid dissociation constant) of 12 or less, more preferably 8 or less, and particularly preferably 6 or less. The molecular weight of the diffusible dye formed is preferably from 200 to 2,000. Further, the dye preferably has (the molecular weight of the dye formed/the number of dissociable groups having pKa of 12 or less) of from 100 to 2,000, more preferably from 100 to 1,000. The pKa value used here is the value measured using 1/1 mixture of dimethylformamide/water as a solvent.

The solubility of the diffusible dye formed by coupling the diffusible dye-forming coupler with the color-forming reducing agent of the present invention in an alkali solution of pH 11 at 25° C. is preferably $1\times10^{-6}$ mol/liter or more, more preferably $1\times10^{-5}$ mol/liter or more, and particularly preferably $1\times10^{-4}$ mol/liter or more. The diffusion constant of the diffusible dye formed by coupling the diffusible dye-forming coupler with the color-forming reducing agent of the present invention is preferably $1\times10^{-8}$ $m^2/s^{-1}$ or more, more preferably $1\times10^{-7}$ $m^2/s^{-1}$ or more, and particularly preferably $1\times10^{-6}$ $m^2/s^{-1}$ or more, when dissolved in concentration of $1\times10^{-4}$ mol/liter in an alkali solution of pH 11 at 25° C.

Mordants which can be used in the present invention can be arbitrarily selected from among mordants generally used. Polymer mordants are particularly preferably used above all. Polymer mordants herein means polymers having a tertiary amino group, polymers having a nitrogen-containing heterocyclic moiety, and polymers containing quaternary cation groups of these.

Specific examples of homopolymers and copolymers containing a vinyl monomer unit having a tertiary imidazole group include mordanting layers disclosed in U.S. Pat. Nos. 4,282,305, 4,115,124, 3,148,061, JP-A-60-118834, JP-A-60-122941, JP-A-62-244043, and JP-A-62-244036, and the following.

Specific examples of homopolymers and copolymers containing a vinyl monomer unit having a quaternary imidazolium salt include mordants disclosed in British Patents 2,056,101, 2,093,041, 1,594,961, U.S. Pat. Nos. 4,124,386, 4,115,124, 4,450,224, and JP-A-48-28325, and the following.

Specific examples of homopolymers and copolymers containing a vinyl monomer unit having a quaternary ammonium salt include mordants disclosed in U.S. Pat. Nos. 3,709,690, 3,898,088, 3,958,995, JP-A-60-57836, JP-A-60-60643, JP-A-60-122940, JP-A-60-122942 and JP-A-60-235134, and the following.

In addition to the above, examples of mordants which can be used in the present invention include vinyl pyridine polymers and vinyl pyridinium cationic polymers disclosed in U.S. Pat. Nos. 2,548,564, 2,484,430, 3,148,161, and 3,756,814; polymer mordants crosslinkable with gelatin disclosed in U.S. Pat. Nos. 3,625,694, 3,859,096, 4,128,538 and British Patent 1,277,453; aqueous sol type mordants disclosed in U.S. Pat. Nos. 3,958,995, 2,721,852, 2,798,063, JP-A-54-115228, JP-A-54-145529, and JP-A-54-26027; water-insoluble mordants disclosed in U.S. Pat. No. 3,898,088; reactive mordants capable of covalent bonding with dyes disclosed in U.S. Pat. No. 4,168,976 (corresponding to JP-A-54-137333); and mordants disclosed in U.S. Pat. Nos. 3,709,690, 3,788,855, 3,642,482, 3,488,706, 3,557,066, 3,271,147, JP-A-50-71332, JP-A-53-30328, JP-A-52-155528, JP-A-53-125, and JP-A-53-1024.

In addition to the above, mordants disclosed in U.S. Pat. Nos. 2,675,316 and 2,882,156 can also be cited.

The molecular weight of the polymer mordant for use in the present invention is appropriately from 1,000 to 1,000,000 and, in particular, from 10,000 to 200,000 is preferred.

The above polymer mordants are generally mixed with hydrophilic colloid for use. Hydrophilic colloid, highly hygroscopic polymer or both of these can be used as hydrophilic colloid. Gelatin is representative. The mixing ratio of the polymer mordant to hydrophilic colloid and the coating amount of the polymer mordant can be easily selected by those skilled in the art according to the amount of the dye to be mordanted, the kind and the composition of the polymer mordant and the image forming process to be used. The mixing ratio of mordant/hydrophilic colloid is preferably from 20/80 to 80/20, and the coating amount of the mordant is generally from 0.2 to 15 $g/m^2$, preferably from 0.5 to 8 $g/m^2$.

In the present invention, it is preferred to use an auxiliary developing agent and a precursor thereof in the photographic material. These compounds are described below.

The auxiliary developing agent for use in the present invention is a compound having the function of accelerating electron transfer from the color-forming reducing agent to silver halide during development of silver halide grains, preferably a compound which can develop exposed silver halide grains and the oxidation product thereof can oxidize the color-forming-reducing agent (hereinafter referred to as "cross oxidation").

As the auxiliary developing agent for use in the present invention, pyrazolidones, dihydroxybenzenes, reductones, and aminophenols are preferably used, and pyrazolidones are particularly preferably used. Auxiliary developing agents preferably have low diffusibility in a hydrophilic colloid layer, e.g., the solubility in water at 25° C. is preferably 0.1% or less, more preferably 0.05% or less, and particularly preferably 0.01% or less.

The auxiliary developing agent precursor for use in the present invention is a compound which exists stably in a photographic material but it at once releases the above auxiliary developing agent when processed with a processing solution. Auxiliary developing agent precursors also preferably have low diffusibility in a hydrophilic colloid layer, e.g., the solubility in water at 25° C. is preferably 0.1% or less, more preferably 0.05% or less, and particularly preferably 0.01% or less. The solubility of the auxiliary developing agent released from the precursor is not particularly limited but the auxiliary developing agent also preferably has low solubility.

The auxiliary developing agent precursor according to the present invention is preferably represented by formula (A):

$$A—(L)_n—PUG \quad (A)$$

wherein A represents a block group and the bond with $(L)_n$—PUG is cleaved at development processing; L represents a linking group and the bond of L-PUG is cleaved after the cleavage of the bond of L with A in formula (A); n represents 0 or an integer of from 1 to 3; and PUG represents an auxiliary developing agent.

As an auxiliary developing agent, electron releasing compounds which conform to Kendall-Pelz's rule other than p-phenylenediamine compounds can be used, e.g., the above-described pyrazolidones are preferably used.

Well-known compounds as described below can be used as a block group represented by A, e.g., block groups such as an acyl group and a sulfonyl group as disclosed in U.S. Pat. No. 3,311,476, block groups making use of reverse of the Michael reaction as disclosed in JP-A-59-105642, block groups making use of quinonemethide compounds or compounds simulant of quinonemethides by intramolecular electron transfer as disclosed in JP-A-2-280140, block groups making use of the intramolecular nucleophilic substitution reaction as disclosed in JP-A-63-318555 (corresponding to European Patent 0295729), block groups making use of the addition reaction of α nucleophilic agent to conjugated unsaturated bond as disclosed in JP-A-4-186344, block groups making use of the β-elimination reaction as disclosed in JP-A-62-163051, block groups making use of the nucleophilic substitution reaction of diaryl methanes as disclosed in JP-A-61-188540, block groups making use of Lossen rearrangement as disclosed in JP-A-62-187850, block groups making use of the reaction of N-acyl material of thiazolidine-2-thione with amine as disclosed in JP-A-62-147457, and block groups having two electrophilic groups and react with two nucleophilic agents as disclosed in WO 93/03419.

The group represented by L is a linking group which can cleave $(L)_{n-1}$—PUG after being eliminated from the group represented by A at development processing. The group represented by L is not particularly limited so long as it has this function.

Specific examples of auxiliary developing agents or precursors thereof are shown below but the present invention should not be construed as being limited thereto.

(ETA-1)

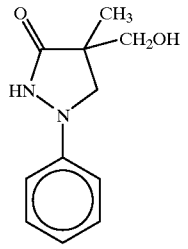

(ETA-2)

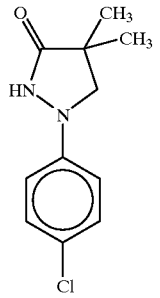

(ETA-3)

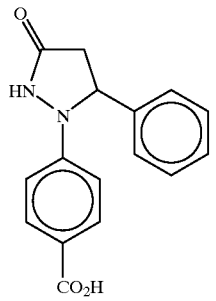

(ETA-4)

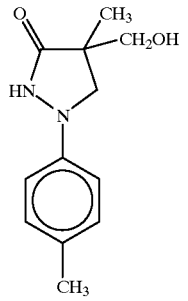

(ETA-5)

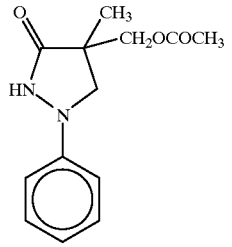

-continued
(ETA-6)
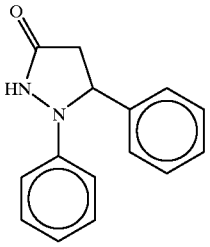
(ETA-7)
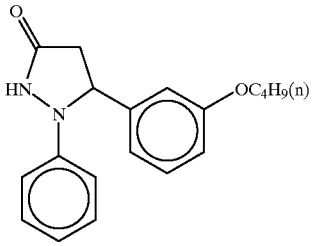
(ETA-8)
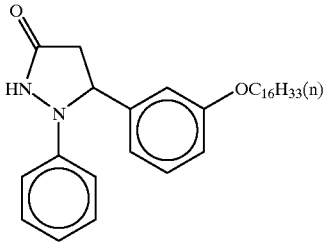
(ETA-9)
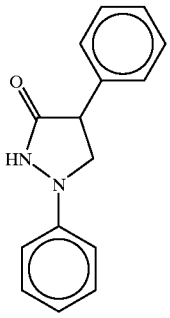
(ETA-10)
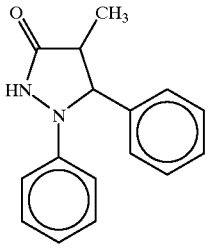
-continued
(ETA-11)
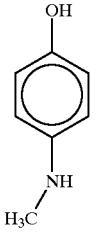
(ETA-12)
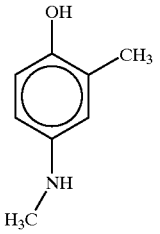
(ETA-13)
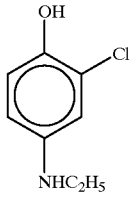
(ETA-14)
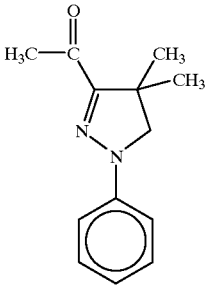
(ETA-15)
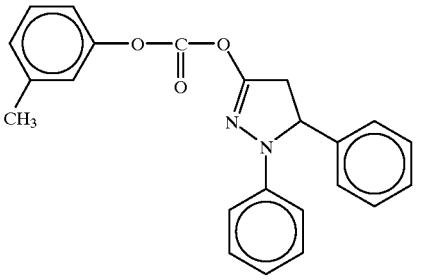
(ETA-16)
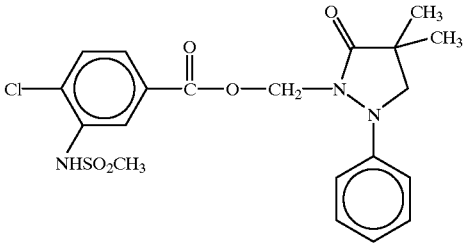

-continued (ETA-17)

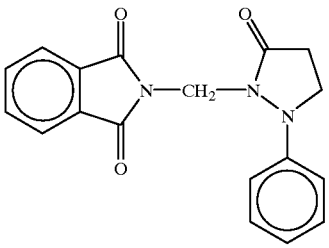

(ETA-18)

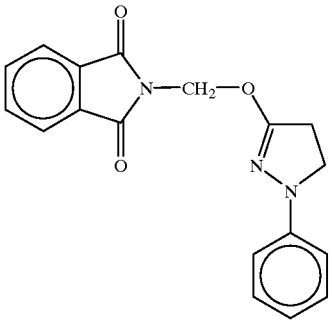

(ETA-19)

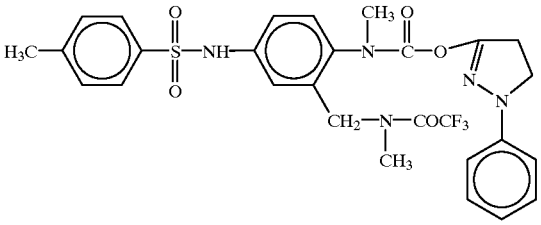

(ETA-20)

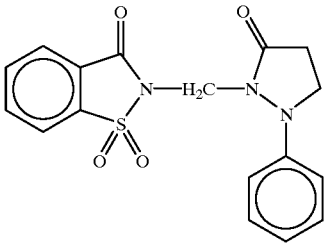

These compounds may be added to any layer, e.g., a light-sensitive layer, an interlayer, an undercoat layer, or a protective layer but when auxiliary developing agents are used, they are preferably used in a light-insensitive layer.

For the incorporation of these compounds into a photographic material, various methods can be used, e.g., a method of dissolving compounds in an organic solvent such as methanol which is miscible with water and adding directly to a hydrophilic colloid layer, a method of adding in the form of an aqueous solution or a colloidal dispersion in the presence of a surfactant, a method of dissolving compounds in a solvent which is substantially immiscible with water or in an oil, then dispersing in water or hydrophilic colloid and then adding to a photographic material, or a method of adding in the form of a solid fine particle dispersion. Conventionally known methods can be used alone or in combination. The preparation method of a solid fine particle dispersion is disclosed in detail in JP-A-2-235044, page 20.

The addition amount of these auxiliary developing agents or precursors thereof to a photographic material is from 1 to 200 mol %, preferably from 5 to 100 mol %, and more preferably from 10 to 50 mol %, based on the addition amount of the color-forming reducing agent.

Any transmitting type support and reflective type support, e.g., glass, paper, and plastic films, can be used in the present invention so long as a photographic emulsion layer can be coated thereon. As plastic films, polyester films such as polyethylene terephthalate, polyethylene naphthalate, cellulose triacetate or cellulose nitrate, polyamide films, polycarbonate films, and polystyrene films can be used in the present invention.

A reflective type support for use in the present invention is a support having high reflectivity for clearly viewing color images formed in the silver halide emulsion layer, for example, a support coated with a hydrophobic resin having dispersed therein a light reflective material such as titanium oxide, zinc oxide, calcium oxide, calcium sulfate, and a support comprised a hydrophobic resin per se having dispersed therein a light reflective material. Examples of such supports include polyethylene coated papers, polyester coated papers, polypropylene based synthetic papers, supports provided with a reflective layer or using in combination with a reflective material, e.g., a glass plate, polyester films such as polyethylene terephthalate, cellulose triacetate or cellulose nitrate, polyamide films, polycarbonate films, polystyrene films and vinyl chloride resins. Polyester coated papers comprising polyethylene terephthalate as a main component as disclosed in European Patent 0507489 are preferably used.

The reflective support for use in the present invention is a paper support both surfaces of which are coated with waterproof resin layers, and it is preferred that at least either waterproof resin layer contains fine particles of a white pigment. This white pigment is contained preferably in concentration of 12 wt % or more, more preferably 14 wt % or more. As a light reflective white pigment, it is preferred to knead sufficiently the white pigment in the presence of a surfactant and it is also preferred that surfaces of pigment particles are treated with a divalent to tetravalent alcohol.

In the present invention, a support having a surface of diffuse reflectivity of the second class is preferably used. Diffuse reflectivity of the second class means the diffuse reflectivity obtained by giving concave and convex to the surface having a mirror face to divide the mirror to fine mirrors facing different directions. The concave and convex of the surface of diffuse reflectivity of the second class have three dimensional average roughness to the center plane of from 0.1 to 2 $\mu$m, preferably from 0.1 to 1.2 $\mu$m. Such a support is described in detail in JP-A-2-239244.

For obtaining a wide range of colors on the chromaticity diagram using three primary colors of yellow, magenta and cyan, at least three silver halide emulsion layers having sensitivities in different spectral regions are used in combination. For example, three layers of a blue-sensitive layer, a green-sensitive layer and a red-sensitive layer, or three layers of a green-sensitive layer, a red-sensitive layer and an infrared-sensitive layer are coated on the above-described support-in combination. Each light-sensitive layer can be arranged in various arrangements known in general color photographic materials. Each light-sensitive layer may be divided to two or more layers, if necessary.

A photographic material can be provided with photographic constitutional layers comprising the above-described light-sensitive layer and various light-insensitive layers, e.g., a protective layer, an undercoat layer, an interlayer, an antihalation layer, a backing layer, etc. For further improving color separability, various filter dyes can be added to photographic constitutional layers.

Gelatin is advantageously used as a binder or protective colloid for the photographic material according to the present invention. Other hydrophilic colloid can be used alone or in combination with gelatin. The calcium content of gelatin is preferably 800 ppm or less, more preferably 200 ppm or less, and the iron content of gelatin is preferably 5 ppm or less, more preferably 3 ppm or less. For preventing various fungi and bacteria from proliferating in hydrophilic colloid layers to deteriorate images, fungicides disclosed in JP-A-63-271247 are preferably used.

When the photographic material of the present invention is subjected to printer exposure, it is preferred to use the band stop filter as disclosed in U.S. Pat. No. 4,880,726. Color mixing by light can be excluded and color reproducibility is remarkably improved due to this means.

The photographic material according to the present invention is also suitable for scanning exposure system using a cathode ray tube (CRT) in addition to the printing system using a general negative printer.

An exposing apparatus using a cathode ray tube is convenient and compact, and the cost can be reduced as compared with an apparatus using a laser. Further, it is easy to adjust an optical axis and color.

Various emitters which emit light in spectral region according to necessity are used in a cathode ray tube for image exposure. For example, any one, or two or more of a red emitter, a green emitter and a blue emitter are used by mixture. Spectral regions are not limited to the above-described red, green and blue, and phosphors which emit light in yellow, orange, purple or infrared region are also used. A cathode ray tube comprising emitters which emit white light by mixture is often used.

When a photographic material comprises a plurality of light-sensitive layers having different spectral sensitivity distributions and a cathode ray tube comprises phosphors which emit light in a plurality of spectral regions, a plurality of colors may be exposed at one time, i.e., image signals of a plurality of colors may be inputted to the cathode ray tube, followed by emission from the tube face. A method comprising inputting the image signal for each color successively, performing emission of each color successively, and carrying out exposure through a film which excludes colors other than the objective color (face-successive exposure) may be adopted. In general, for enhancing image quality, the face-successive exposure is preferred in that a cathode ray tube of high resolution can be used.

The photographic material of the present invention can preferably be used in digital scanning exposure using monochromatic high density light, such as a gas laser, a light emitting diode, a semiconductor laser, or a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the spectral sensitivity maximum of the photographic material of the present invention can be set arbitrarily according to the wavelength of the scanning exposure light source to be used. As oscillation wavelength of a laser can be made half using an SHG light source comprising a combination of non-linear optical crystal with a solid state laser using a semiconductor laser as an excitation light source or a semiconductor laser, blue light and green light can be obtained. Accordingly, it is possible to have the spectral sensitivity maximum of a photographic material in normal three regions of blue, green and red. For making an apparatus inexpensive, high stable and compact using a semiconductor laser as a light source, it is preferred that at least two layers have spectral sensitivity maximum in the region of 670 nm or more. This is because emission wavelength region of III—V group system semiconductor laser, which is presently available, inexpensive and stable, is only in the red to infrared region. However, oscillation of II—VI group system semiconductor laser in the green and blue regions is confirmed in experimental level, and it is sufficiently expected that such a semiconductor laser shall be available inexpensively and stably according to the development of the manufacturing technology of the semiconductor laser. In such a case, the necessity that at least two layers should have spectral sensitivity maximum in the region of 670 nm or more becomes small.

In such a scanning exposure, the time of exposure of silver halide in a photographic material is the time necessary for exposure of a micro area. The minimum unit for controlling the quantity of light from each digital data is in general used as this micro area and which is called a pixel. Therefore, exposure time per pixel is varied according to the size of the pixel. The size of the pixel depends on the density of the pixel and the practical range of the density of the pixel is from 50 to 2,000 dpi. The exposure time is defined as the time necessary to expose the size of the pixel with the density of this pixel being 400 dip, and preferred exposure time is $10^{-4}$ sec or less and more preferably $10^{-6}$ sec or less.

The silver halide grains for use in the present invention include silver bromide, silver chloride, silver iodide, silver chlorobromide, silver chloroiodide, silver iodobromide and silver chloroiodobromide. Other silver salt, for example, silver thiocyanate, silver sulfide, silver selenide, silver carbonate, silver phosphate, or organic acid silver may be contained as separate grains or as a part of silver halide grains. When speedup of development and desilvering (bleaching, fixing and bleach-fixing) processes is desired, silver halide grains of a high silver chloride content is preferably used, while when a moderate development inhibition is desired, it is preferred to contain silver iodide. The desired content of silver iodide is varied according to the kinds of photographic materials.

The high silver chloride emulsion for use in the present invention preferably has such a structure that a silver bromide localized phase is present inside and/or on the surface of the silver halide grains in the form of a layer or a non-layer. The halide composition of the above localized phases is preferably such that the silver bromide content is at least 10 mol %, more preferably exceeding 20 mol %. The silver bromide content of the silver bromide localized phases can be analyzed according to the X-ray diffraction method (for example, *Shin-Jikken Kaaaku Koza* 6, *Kozo Kaiseki* (*New Experimental Chemistry Course* 6, *Analysis of Structure*), edited by Nippon Kagaku Kai, published by Maruzen) or the like. These localized phases can be present inside the grains, at edges, corners or on planes of the grain surface. One preferred example of the localized phase is that formed by epitaxial growth at the corners of the grains.

Also, it is effective to further increase the silver chloride content of a silver halide emulsion to reduce the replenishing amount of the development processing solution. In such a case, substantially a pure silver chloride emulsion having a silver chloride content of from 98 mol % to 100 mol % is also preferably used.

The value obtained by dividing the equivalent-circle diameter by the grain thickness is called an aspect ratio. The shape of a tabular grain is prescribed by the aspect ratio. Tabular grains having the aspect ratio of 1 or more can be used in the present invention. The average aspect ratio of 80% or more of the entire projected area of the grains is preferably 1 or more and not larger than 100, more preferably 2 or more and not larger than 20, and particularly preferably 3 or more and not larger than 10. The shape of tabular grains may be triangular, hexagonal or spherical. The equilateral hexagon having six sides of almost equal lengths as disclosed in U.S. Pat. No. 4,797,354 is preferred.

Emulsions for use in the present invention may be either a polydisperse emulsion having a broad grain size distribution or a monodisperse emulsion having a narrow grain size distribution, and they can be selected according to the purpose. As a criterion of grain size distribution, a variation coefficient of the equivalent-circle diameter or the equivalent-sphere diameter is used in some case. When monodisperse emulsions are used, emulsions having a variation coefficient of 25% or less, more preferably 20% or less, and still more preferably 15% or less are preferably used.

Various additives are used in the photographic material of the present invention as described above, and additives other than the above can be used according to purposes.

These additives are disclosed in *Research Disclosure,* Item 17643 (December, 1978), ibid., Item 18716 (November, 1979) and ibid., Item 307105 (November, 1989) in detail, and the related locations of the disclosures are also shown in the table below.

TABLE 1

| | Type of Additives | RD 17643 | RD 18716 | RD 307105 |
|---|---|---|---|---|
| 1. | Chemical Sensitizers | page 23 | page 648, right column | page 996 |
| 2. | Sensitivity Increasing Agents | — | page 648, right column | — |
| 3. | Spectral Sensitizers and Supersensitizers | pages 23–24 | page 648, right column to page 649, right column | pages 996, right column to page 998, right column |
| 4. | Whitening Agents | page 24 | — | page 998, right column |
| 5. | Antifoggants and Stabilizers | pages 24–25 | page 649, right column | page 998, right column to page 1000, right column |
| 6. | Light Absorbers, Filter Dyes, and Ultraviolet Absorbers | pages 25–26 | page 649, right column to page 650, left column | page 1003, left column to page 1003, right column |
| 7. | Antistaining Agents | page 25, right column | page 650, left to right columns | — |
| 8. | Color image Stabilizers | page 25 | | |
| 9. | Hardening Agents | page 26 | page 651, left column | page 1004, right column to page 1005, left column |
| 10. | Binders | page 26 | page 651, left column | page 1003, right column to page 1004, right column |
| 11. | Plasticizers and Lubricants | page 27 | page 650, right column | page 1006, left column to page 1006, right column |
| 12. | Coating Aids and Surfactants | pages 26–27 | page 650, right column | page 1005, left column to page 1006, left column |
| 13. | Antistatic Agents | page 27 | page 650, right column | page 1006, right column to page 1007, left column |

The total coating amount of silver of the photographic material of the present invention is preferably from 0.003 to 12 g per $m^2$ in terms of silver. When the photographic material is a transmitting material such as a color negative film, the silver coating amount is preferably from 1 to 12 g, more preferably from 3 to 10 g. When the material is a reflective material such as a color paper, the total coating amount is preferably from 0.003 to 1 g in view of rapid processing and the reduction of replenishing rate. In this case, the coating amount of silver is preferably from 0.001 to 0.4 g per one light-sensitive layer. In particular, when the photographic material of the present invention is intensification processed, the total silver coating amount is preferably from 0.003 to 0.3 g, more preferably from 0.01 to 0.1 g, and particularly preferably from 0.01 to 0.05 g. In this case, the coating amount of silver is preferably from 0.001 to 0.1 g, more preferably from 0.003 to 0.03 g, per one light-sensitive layer.

In the present invention, if the coating silver amount of each light-sensitive layer is less than 0.001 g, the dissolution of silver salt proceeds and sufficient color density cannot be obtained. In the case of intensification processe is conducted, if the amount exceeds 0.1 g, $D_{min}$ increases and foams are generated leading to deterioration of images.

The total coating amount of gelatin of the photographic material of the present invention is from 1.0 to 30 g, preferably from 2.0 to 20 g, per $m^2$. In the film swelling of the photographic material of the present invention in an alkali solution of pH 12, the time to reach the swollen film thickness of ½ of the saturated swollen film thickness (90% of the maximum swollen film thickness) is preferably 15 sec. or less, more preferably 10 sec. or less. The swelling factor [(maximum swollen film thickness−film thickness)/film thickness×100] is preferably from 50 to 300%, particularly preferably from 100 to 200%.

In the present invention, a processing solution is coated on the surface of a photographic material by a coating apparatus according to the present invention. Therefore, the photographic material must be easily wet by the processing solution. In the present invention, for improving the wettability of the surface of the photographic material, it is preferred to coat a surfactant on the farthest hydrophilic colloid layer from the support side of the photographic material. Betaine-based surfactants and surfactants containing fluorine atoms are preferably used for this purpose. It is also preferred to incorporate a hydrophilic polymer to the farthest hydrophilic colloid layer from the support side of the photographic material with a view to improving the wettability by making the processing solution percolate through the photographic material easily. Preferred hydrophilic polymers are acrylic acid polymers, polyvinyl alcohols, acrylic acid/vinyl alcohol copolymers, etc.

The coating apparatus for use in the present invention is described in detail below.

The coating apparatus is provided with a plurality of nozzle pores for jetting and coating an alkaline processing solution on the surface of the photographic material. Three droplets jetted from these nozzle pores are coated on the photographic material in contiguous to eath other so as not to leave space among them.

Therefore, an even coated film can be formed on the surface of the photographic material even using a coating apparatus of a non-contact type with the photographic material.

Pitch P among nozzle pores contiguous to each other is preferred to be $(\sqrt{3})\cdot D/2$ or less.

Here, D represents the diameter of one droplet of the alkaline processing solution coated on the photographic material and is obtained by the following equation:

$$D = 2\cdot \mathrm{Sin}\theta\left\{\frac{3\cdot V}{\pi\cdot[2^{-3}\cdot\cos\theta+(\cos\theta)^3]}\right\}^{1/3}$$

wherein V represents the volume of one droplet of the alkaline processing solution jetted from a plurality of nozzle pores, and θ represents the contact angle of the droplet at the time when the alkaline processing solution is coated on the photographic material.

Accordingly, from the relationship between the pitch P among nozzle pores contiguous to each other and the diameter D of one droplet of the alkaline processing solution, droplets can be coated on the photographic material in contiguous to eath other so as not to leave space among them.

The constitution of the apparatus for use in the present invention is described below.

As shown in FIG. 1, jetting tank 312 which constitutes one part of coating apparatus 310 is arranged at the counter position to conveyance route A of photographic material 16 of processing solution coating part 50.

Also as shown in FIG. 1, processing solution bottle 332 for reserving the processing solution for feeding to jetting tank 312 is arranged at the left lower position of jetting tank 312, and filter 334 for filtering the processing solution is arranged at the upper position of processing solution bottle 332. Water conveying pipe 342 equipped with pump 336 en route connects processing solution bottle 332 and filter 334.

Further, sub tank 338 for reserving the processing solution convyed from processing solution bottle 332 is arranged at the right side of jetting tank 312, and from filter 334 water conveying pipe 344 reaches to sub tank 338.

Accordingly, when pump 336 works, the processing solution is conveyed from processing solution bottle 332 to filter 334 side, at the same time, processing solution filtered through filter 334 is conveyed to sub tank 338 and reserved once in sub tank 338.

Further, water conveying pipe 346 connecting sub tank 338 and jetting tank 312 is arranged between them, and the processing solution conveyed from processing solution bottle 332 by means of pump 336 via filter 334, sub tank 338 and water conveying pipe 346 is filled in jetting tank 312.

Tray 340 connected with processing solution bottle 332 by means of circulating pipe 348 is arranged under jetting tank 312. The processing solution overflowed from jetting tank 312 is collected in tray 340 and returned back to processing solution bottle 332 via circulating pipe 348. Circulating pipe 348 is connected with sub tank 338 with protruding into sub tank 338, and the processing solution collected unnecessarily in sub tank 338 is returned to processing solution bottle 332.

Figure 3:
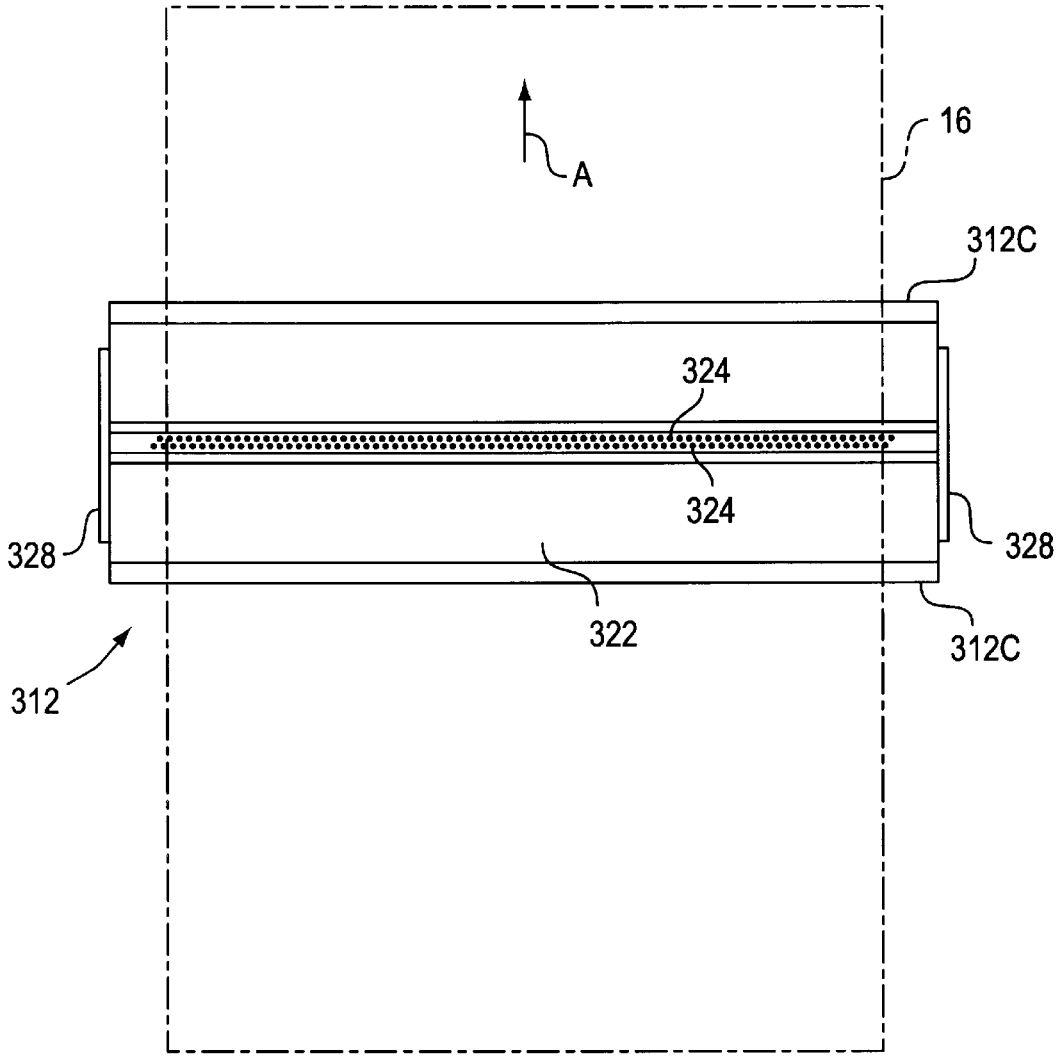
FIG. 3 is a bottom view showing the state of conveyance of a photographic material under the jetting tank according to the first embodiment of the present invention.
Figure 5:
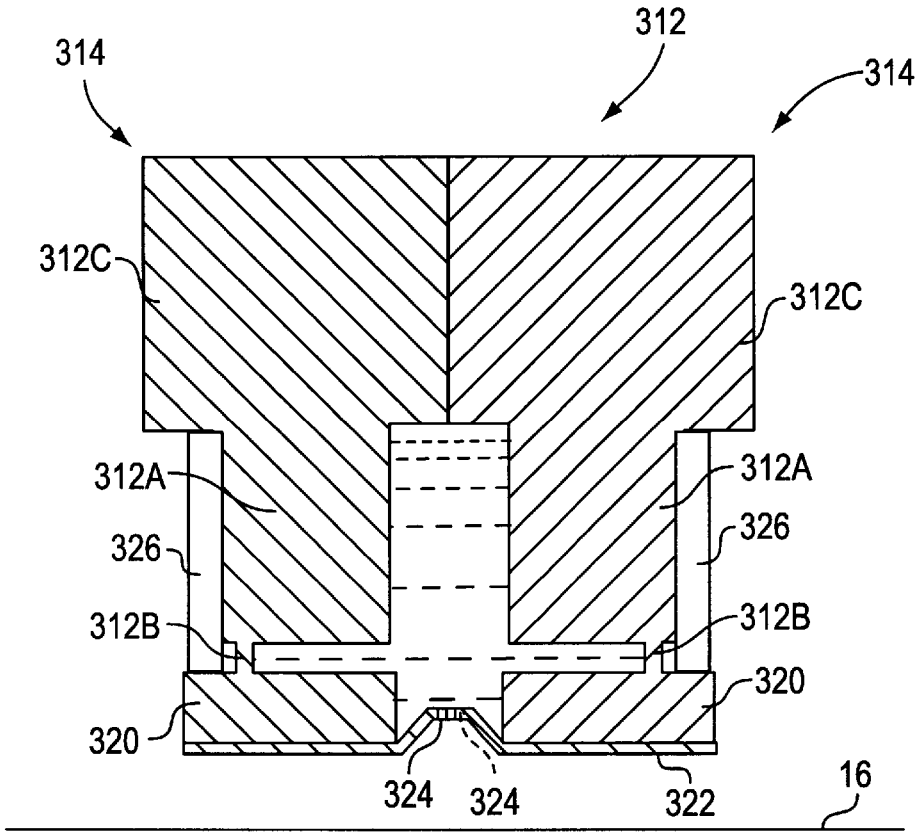
FIG. 5 is a cross sectional view of the jetting tank according to the first embodiment of the present invention.

Further, as shown in FIGS. 3 and 5, nozzle plate 322 which is molded by bending an elastic deformable rectangular thin plate is installed at the counter position to conveyance route A of photographic material 16, which is a part of the wall of jetting tank 312.

Figure 2:
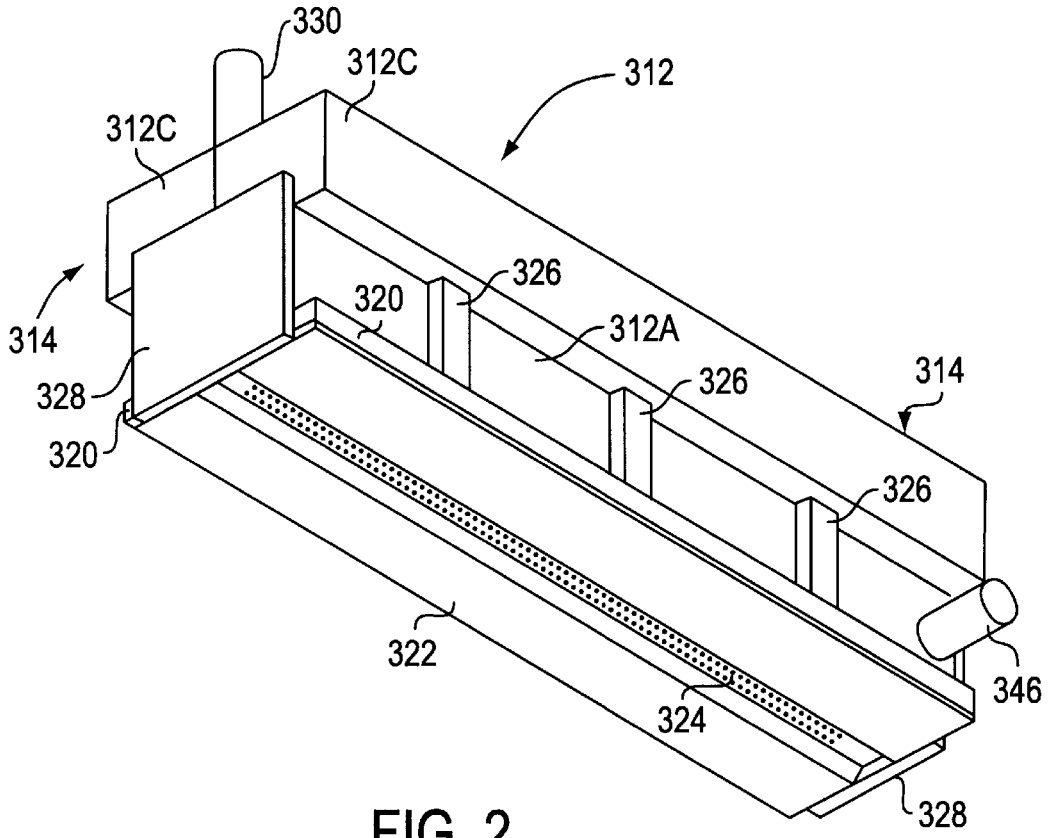
FIG. 2 is an enlarged oblique view of the jetting tank according to the first embodiment of the present invention.
Figure 4:
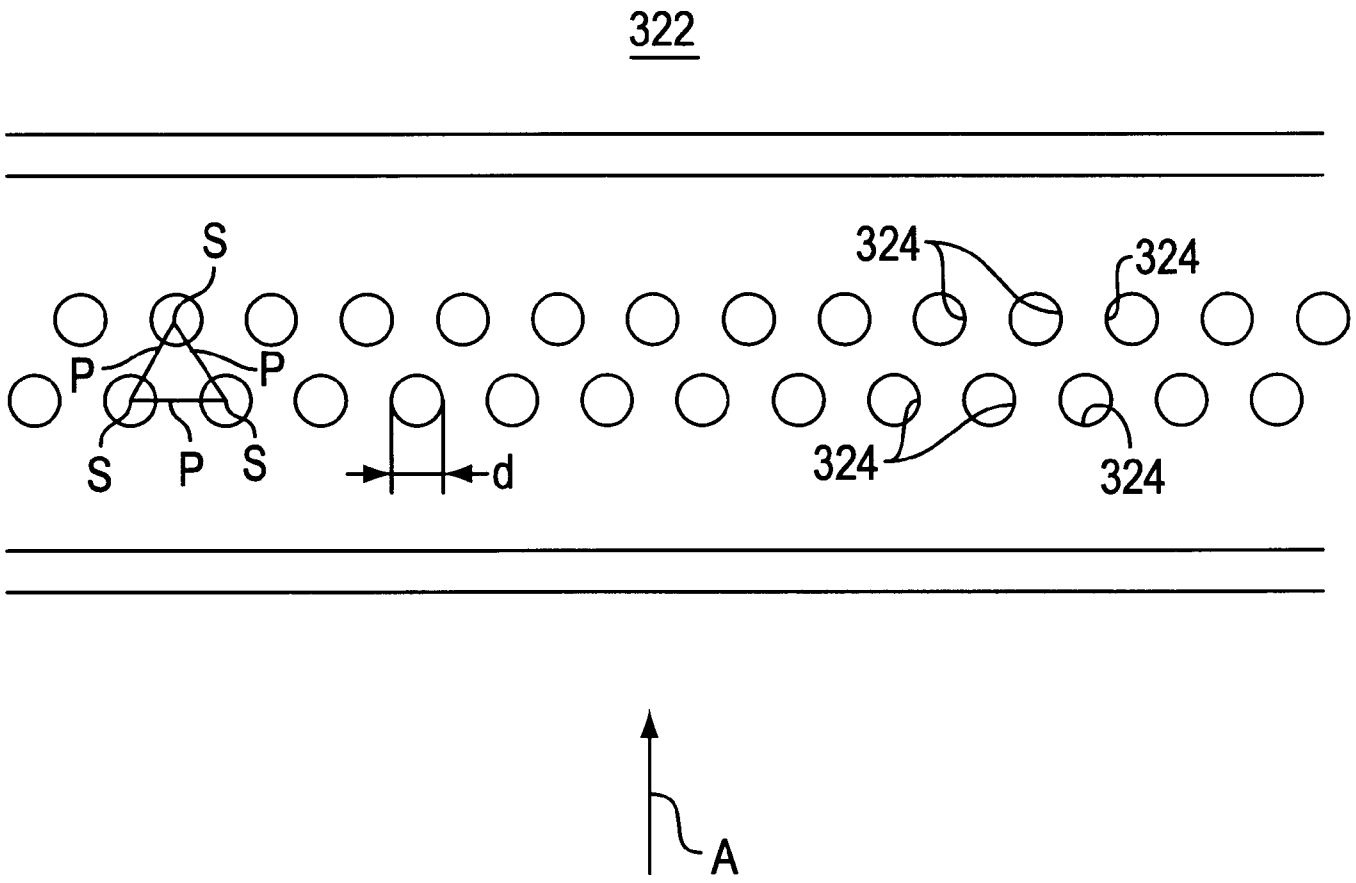
FIG. 4 is an enlarged view of the main part of FIG. 3.

As shown in FIGS. 2 and 4, nozzle plate 322 is provided with a plurality of nozzle pores 324 (a diameter of several ten micrometers) for jetting the processing solution filled in jetting tank 312, nozzle pores are arranged with constant intervals along by the direction intersecting conveyance route A of photographic material 16 in the entire width of photographic material 16 in a straight line in cross-stich-like two rows. According to this methanism, the processing solution in jetting tank 312 can be jetted on photographic material 16 by nozzle pores 324.

Further, as shown in FIG. 4, each nozzle pore 324 is formed in the shape of a cirle having the same inside diameter d and water droplet L having almost the same volume is jetted from each nozzle pore 324. Three nozzle pores 324 in contiguous to eath other are arranged on nozzle plate 322 in the constitution such that each center S of nozzle pore 324 makes the apex of an equilateral triangle.

As shown in FIGS. 1 and 2, exhaust pipe 330 extends from the upper part of jetting tank 312, and this exhaust pipe 330 communicates with the inside and outside of jetting tank 312. A valve to open and close exhaust pipe 330, which is not shown in the figures, is installed on the midway of exhaust pipe 330, and the inside of jetting tank 312 can communicate with and shut out the outside air by opening and closing movement of the valve.

Figure 6:
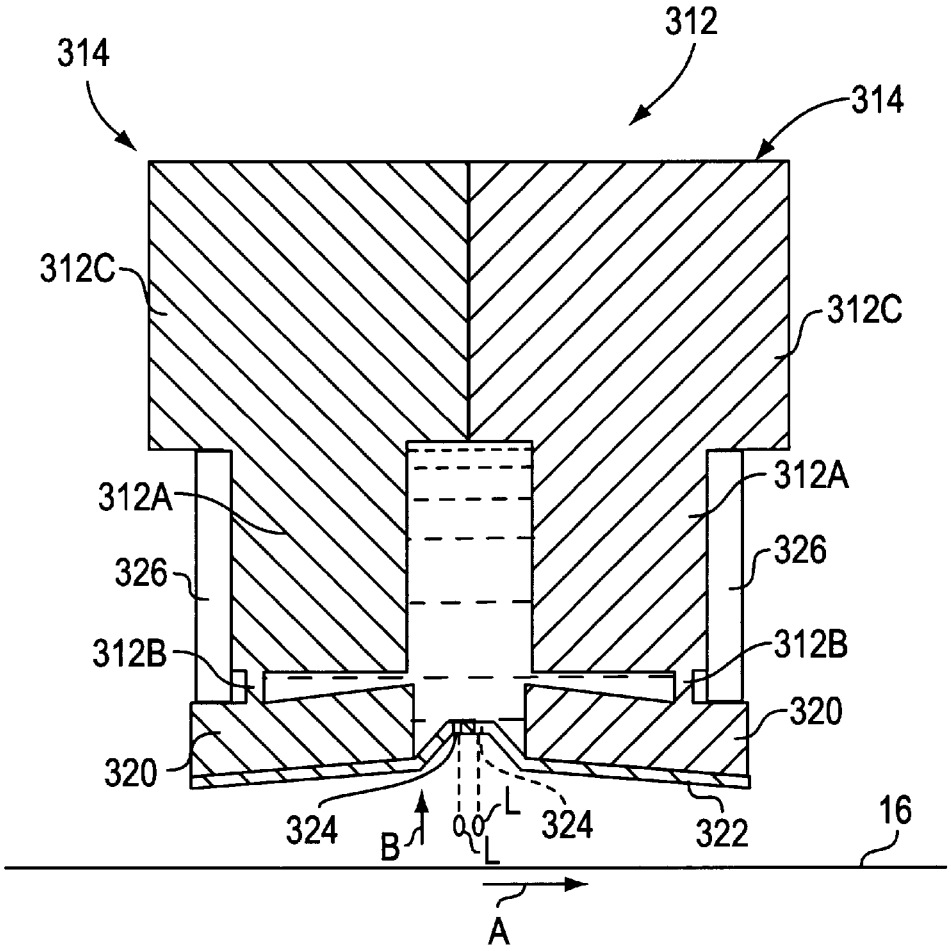
FIG. 6 is a cross sectional view showing the state of jetting a processing solution from the jetting tank according to the first embodiment of the present invention.

As shown in FIG. 6, both ends of nozzle plate 322 which is positioned in the orthogonal direction to the machine direction of a plurality of nozzle pores 324 arranged linearly are connected to a pair of lever plates 320 with an adhesive or the like, thereby nozzle plate 322 and lever plates 320 are linked. A pair of lever plates 320 are fixed to a pair of side walls 312A of jetting tank 312 via a pair of slender width supporters 312B provided at the lower parts of a pair of side walls 312A.

On the other hand, a part of each of a pair of top walls 312C which forms top face of jetting tank 312 by connecting with each other protrudes to the outer side of jetting tank 312, and a plurality of piezoelectric elements 326 (three per each side in the embodiment of the present invention), which are actuators, are arranged at the underside of top walls 312C. The under surfaces of piezoelectric elements 326 are adhered to the outer side of lever plate 320, thereby piezoelectric elements 326 and lever plate 320 are linked.

Accordingly, piezoelectric elements 326, lever plate 320 and supporter 312B constitute lever mechanism. When the outer side of lever plate 320 is moved by piezoelectric elements 326, the inner side of lever plate 320 moves in the opposite direction to the movement of the outer side. Further, piezoelectric elements 326 are made of laminated, e.g., piezoelectric ceramics, axial displacement of piezoelectric elements 326 is made large, and are connected to the electric source (not shown in the Figs.) whose voltage application timing is controlled by a controller (not shown in the figs.). The above-described valve for opening and closing of exhaust pipe 330 is connected to this controller and opening and closing movement of the valve is also controlled by this controller.

On the other hand, lever plate 320, side wall 312A, supporter 312B and top wall 312C constitute one part of frame 314 formed integrally, and as shown in FIG. 6, a pair of frames 314 are overlapped and screwed by volts (not shown in the figs.) to form the outside frame of jetting tank 312 comprising a pair of lever plates 320, a pair of side walls 312A, a pair of top walls 312C and a pair of supporter 312B with being arranged at counter positions.

Further, thin sealing plates 328 are adhered to the parts partitioned by the left and right ends of nozzle plate 322 positioned in the machine direction of nozzle pores 324 and the ends of a pair of frames 314.

Moreover, insides of sealing plates 328 are filled with an elastic adhesive, e.g., a siliicone rubber adhesive, so as not to leak the solution from the gaps foremd by left and right ends of nozzle plate 322, ends of a pair of frames 314 and sealing plates 328. Thus, the gaps in jetting tank 312 are sealed with an elastic adhesive without hindering the movement of left and right ends of nozzle plate 322. Left and right ends of jetting tank 312 may be sealed with only an elastic adhesive without using thin sealing plates 328.

From the above, as shown in FIG. 6, when electricity is sent to piezoelectric elements 326 from the electric source, with the movement of piezoelectric elements 326 which extend to move lever plates 320 with making supporters 312B axes, piezoelectric elements 326 displace nozzle plate 322 while deforming nozzle plate 322 in such a manner that piezoelectric elements 326 raise the center part of nozzle plate 322 in the direction of arrow B. According to the deformation of nozzle plate 322, the pressure of the processing solution in jetting tank 312 is increased, a small amount of processing solution droplets L are jetted linearly in one lot from nozzle pores 324 arranged in two rows.

Further, by repeating turning on of electricity to piezoelectric elements 326 to extend piezoelectric elements 326 repeatedly, it becomes possible for nozzle pores 324 to continuously jet droplets L.

Figure 7:
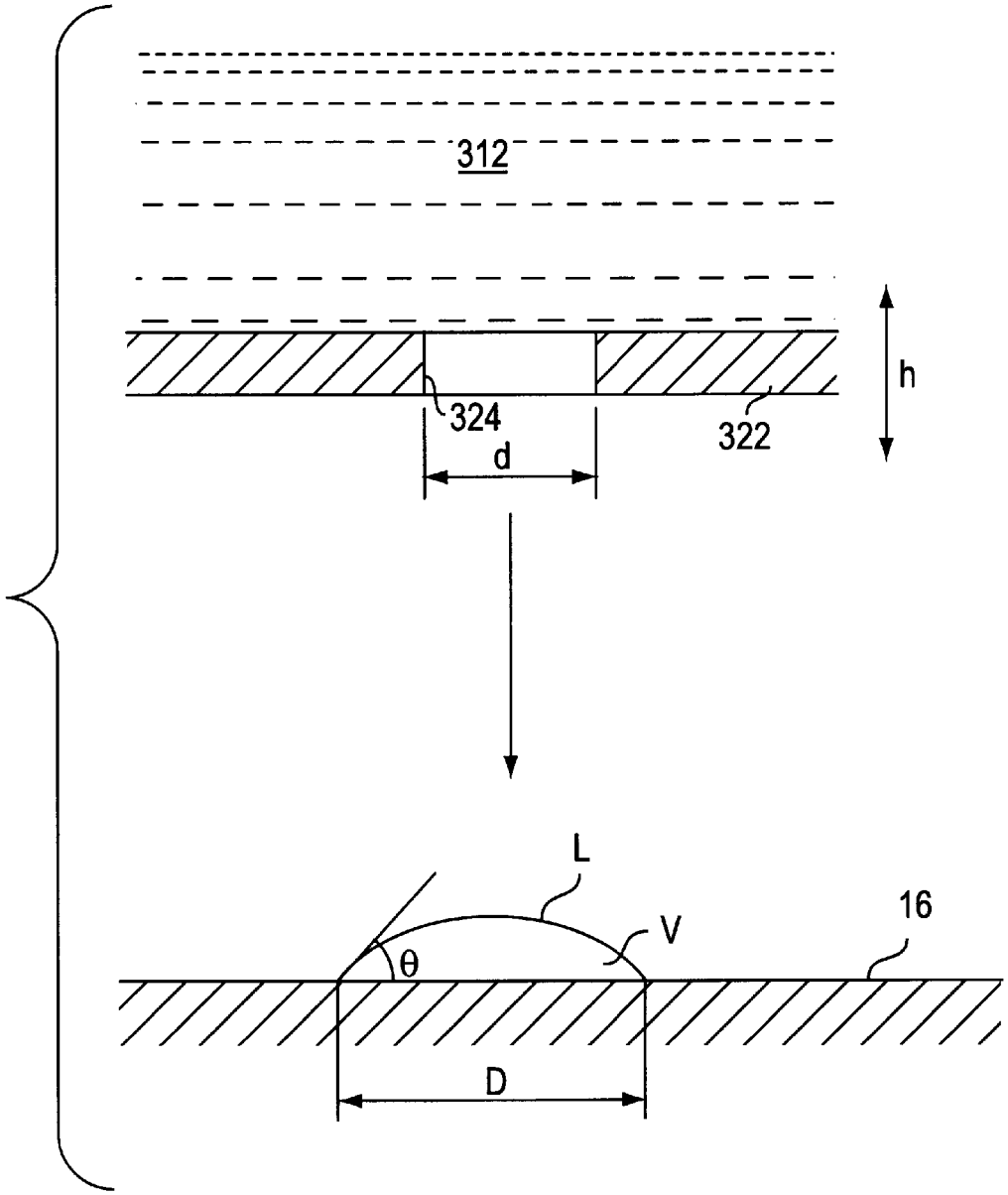
FIG. 7 is a conceptual cross sectional view showing the state of a droplet coated on a photographic material jetted from the nozzle pore of the jetting tank according to the first embodiment of the present invention.

As shown in FIG. 7, the diameter D of one droplet L on photographic material 16 is obtained from the above equation taking the volume of one droplet L jetted from a nozzle pore as V, and the contact angle of the droplet of the processing solution coated on photographic material 16 as θ.

Figure 12:
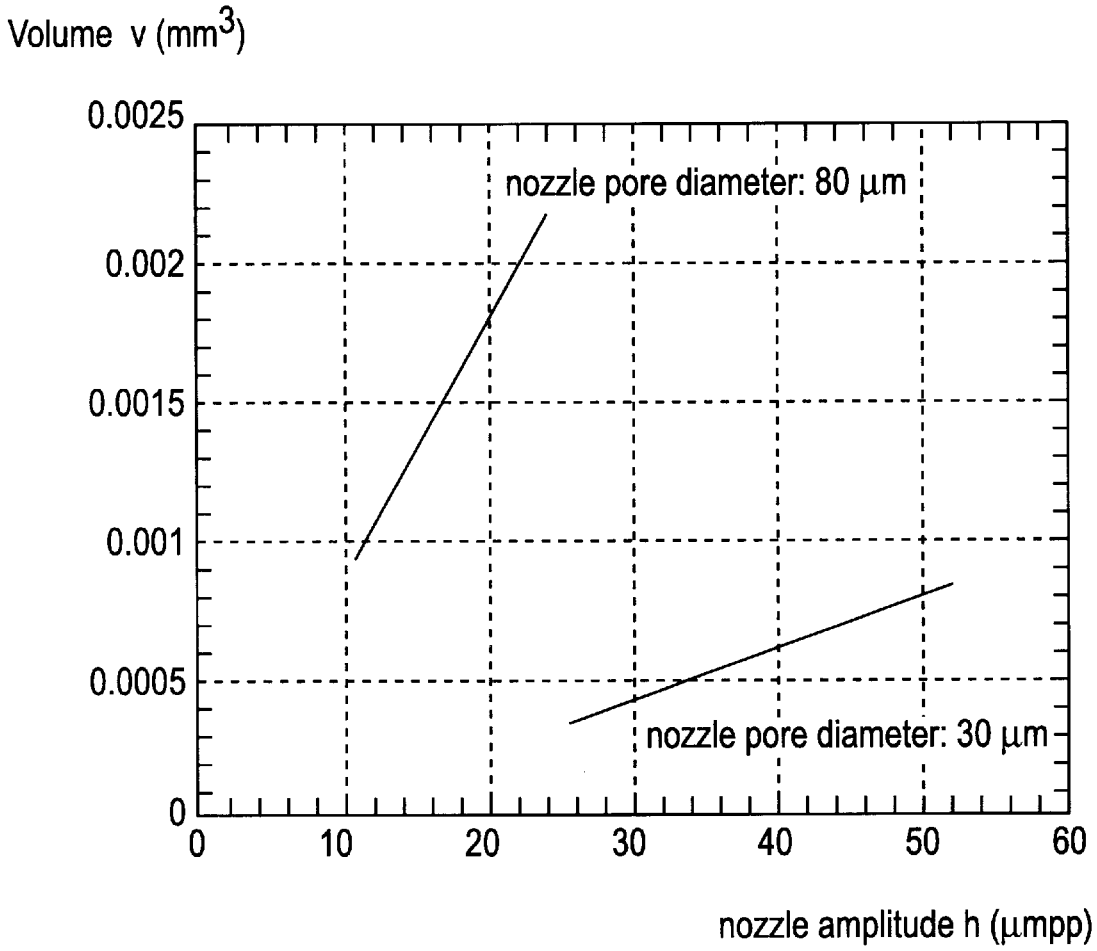
FIG. 12 is a graph showing the relationship between the volume of one droplet and the nozzle amplitude depending on the nozzle pore diameter.

The volume V of one droplet L can be obtained from FIG. 12 which shows the experiment results obtained by changing conditions of oscillation width (nozzle amplitude h) of the places corresponding to nozzle pores 324 when nozzle plate 322 is displaced by piezoelectric elements 326. Data of nozzle pores 324 having the inside diameter d of 30 μm and 80 μm are shown in FIG. 12.

The processing solution is coated on photographic material 16 in such a manner that three droplets L jetted from nozzle pores 324 coated on photographic material 16 in contiguous to each other do not leave space among them.

Figure 10:
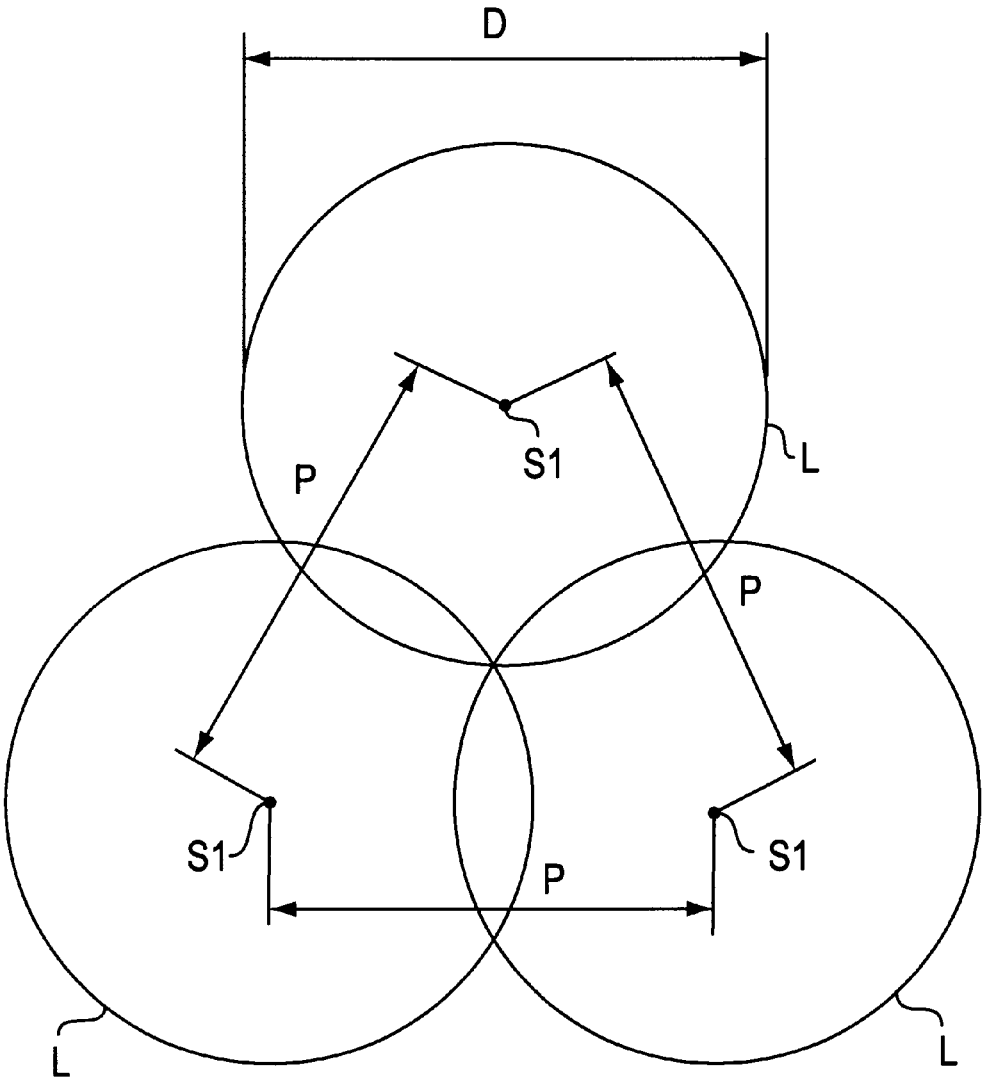
FIG. 10 is an enlarged conceptual view showing three droplets taken out of the photographic material of the state being coated with droplets jetted from nozzle pores of the jetting tank according to the first embodiment of the present invention.

That is, as shown in FIG. 10, as pitch which is the distance between centers S1 of droplets L is equal to pitch P which is the distance between centers S of nozzle pores 324 contiguous to each other, when this pitch P is the value obtained by the following equation, three droplets L are coated on photographic material 16 in contiguous to each other so as not to leave space among them.

$$P \leqq \frac{\sqrt{3}}{2} \cdot D$$

Figure 8:
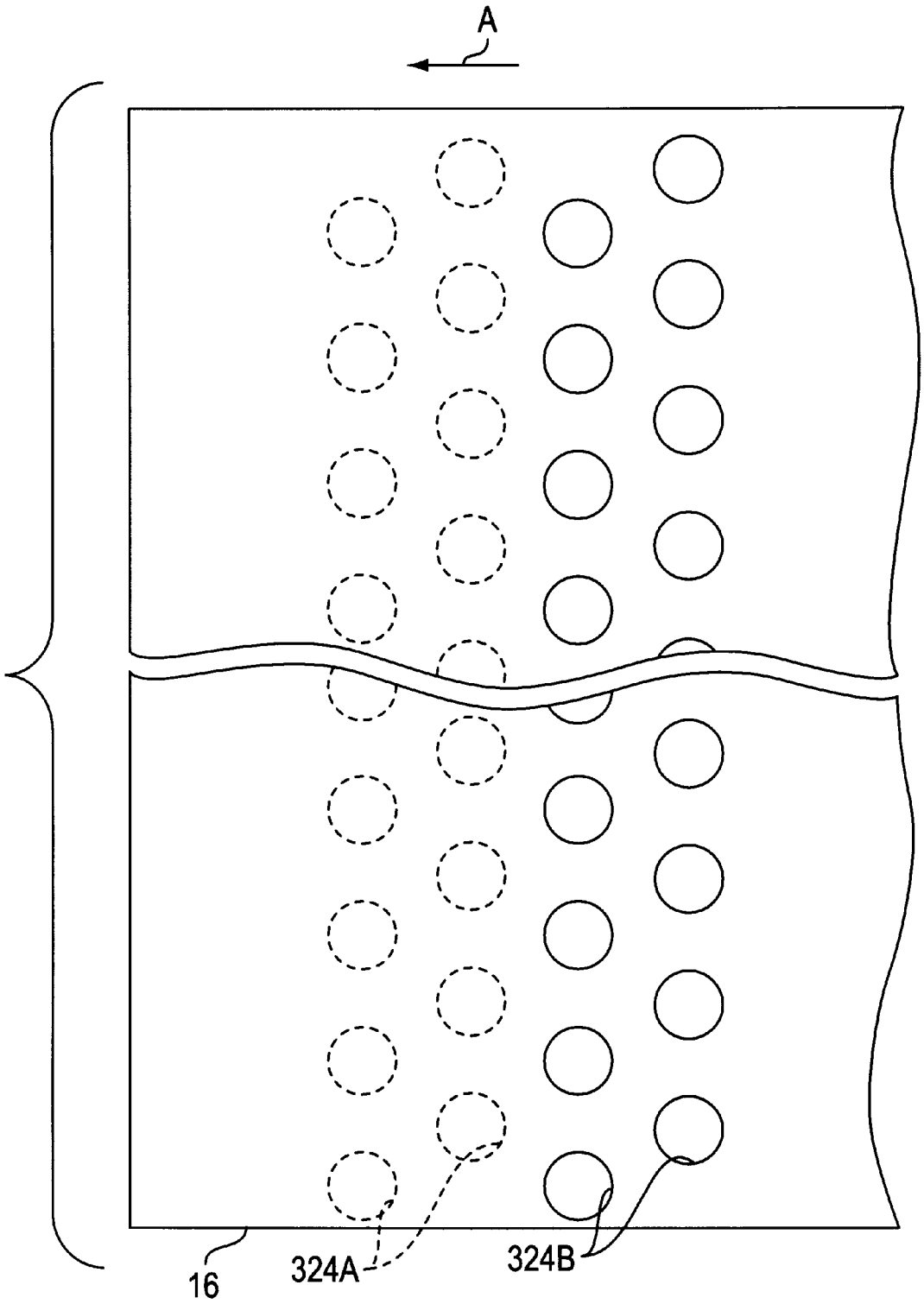
FIG. 8 is an explanatory view showing the position of nozzle pores of the jetting tank according to the first embodiment of the present invention projected on a photographic material.
Figure 9:
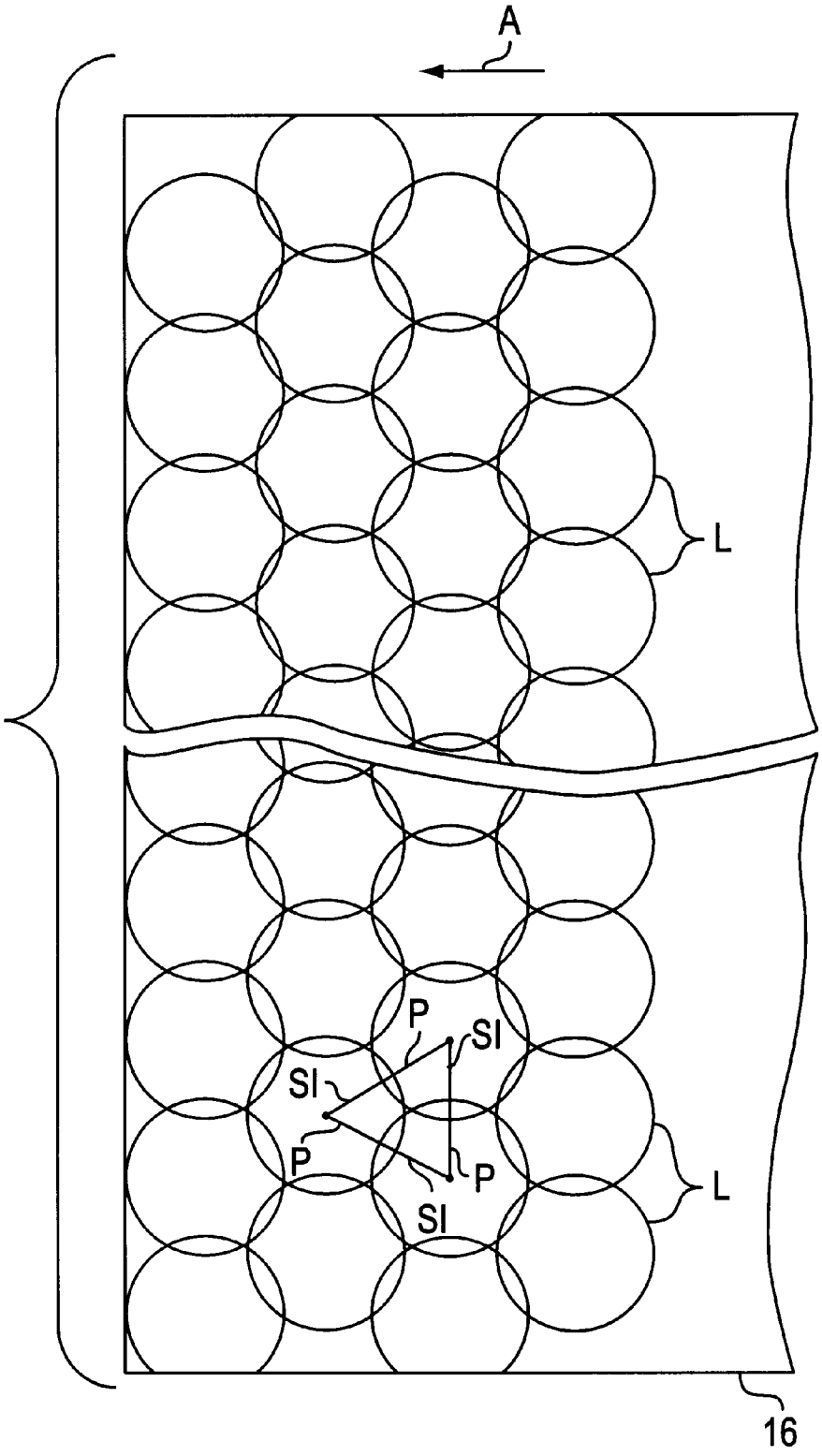
FIG. 9 is a plan view showing the photographic material of the state being coated with droplets jetted from nozzle pores of the jetting tank according to the first embodiment of the present invention.

Further, by jetting the processing solution with appropriate timing to the conveying speed of photographic material 16, i.e., by jetting the processing solution at the instant when nozzle pores 324 are positioned above the part shown by broken line 324A in FIG. 8, then by jetting the processing solution at the instant when nozzle pores 324 are positioned above the part shown by continuous line 324B in FIG. 8, and by jetting droplets L repeatedly, droplets L can be coated on the surface of photographic material 16 with the arrangement of lines connecting each center S1 forming the equilateral triangle as shown in FIG. 9.

However, in practice, if droplets L after being jetted and coated contact and interfere with each other on the surface of photographic material 16, as droplets have a nature to cohere to decrease the surface energy, droplets L overlapped mutually immediately cohere to be unified as a whole.

The behavior and action of photographic material 16 at the time when the processing solution is being coated by jetting from jetting tank 312 are described below.

In the first place, the valve of exhaust pipe 330 is closed by the controller. When the processing solution is jetted from nozzle plate 322 at this state, all piezoelectric elements 326 are deformed so as to extend all piezoelectric elements 326 at the same time by applying voltage to piezoelectric elements 326 by turning on of electricity to piezoelectric elements 326 from the electric source controlled by a controller.

When piezoelectric elements 326 are deformed in this manner, displacement is transferred to nozzle plate 322 via the rounding movement making supporters 312B of a pair of lever plates 320 as axes, and nozzle plate 322 are displaced so as to apply pressure to the processing solution in jetting tank 312. As a result, as shown in FIG. 7, the processing solution filled in jetting tank 312 can be jetted from nozzle pores 324 in misty state and coated on photographic material 16 during conveying.

Conjointly with the conveying speed of photographic material 16, by jetting the processing solution from nozzle pores 324 several times with the arbitrary timing, the processing solution can be coated on the entire surface of photographic material 16.

At this time, a plurality of nozzle pores 324 for jetting the processing solution are arranged in two rows along the entire width of photographic material 16. As described above, volume V of droplet L jetted from nozzle pores 324 can be obtained from the inside diameter d of nozzle pore 324 and nozzle amplitude h.

As a result, when pitch P among nozzle pores 324 is within the value obtained by the above equation, as each of three droplets coated on photographic material 16 in contiguous to each other has diameter D, these droplets L are coated on photographic material 16 in contiguous to each other so as not to leave space among them.

Accordingly, from the relationship between diameter D of one droplet L and pitch P among nozzle pores 324 in contiguous to each other, etc., droplets L can be coated uniformly on photographic material 16 in contiguous to each other so as not to leave space among them. Therefore, an even coated film can be formed on the surface of photographic material 16 even using jetting tank 312 of a non-contact type with photographic material 16.

That is, coating unevenness can be prevented by arranging nozzle pores 324 so as to be able to cohere all droplets, and forming uniform coherent liquid film on photographic material 16 immediately after jetting.

By coating the processing solution on photographic material 16 in such a manner that each center S1 of droplet L after coated makes the apex of an equilateral triangle and the centroid of this equilateral triangle is completely covered by three droplets L, it becomes possible to cohere all the droplets with the least amount of the solution.

Thus, an even coating film can be formed on photographic material 16 without causing deterioration of image recording apparatus 10 per se and image quality due to a contaminated processing solution.

On the other hand, due to the constitution of the coating apparatus comprising jetting tank 312 provided with nozzle pores 324 for jetting the processing solution, not only coating with a small amount of processing solution can be realized but also drying time can be reduced as compared with a coating apparatus of the structure of coating by immersing a photographic material in a processing solution preserved in a tank.

Further, as jetting tank 312 is provided with a plurality of nozzle pores 324 in the entire width of photographic material 16, and the processing solution is jetted from these nozzle pores 324 at the same time by displacement by piezoelectric elements 326, the processing solution can be coated in one lot in a wide range on the entire width of photographic material 16. Thus, it is not necessary to scan nozzle plate 322 on the two dimensional plane, at the same time, it is possible to coat a large area within a short period of time resulting in the reduction of coating time.

Further, both ends of nozzle plate 322 orthogonal to the machine direction of a plurality of nozzle pores 324 are connected to a pair of lever plates 320, nozzle plate 322 and piezoelectric elements 326 are linked via lever plates 320. Thus, a plurality of nozzle pores 324 arranged linearly can be displaced in one lot with the same displacement amount along by the machine direction of nozzle pores 324 resulting in further even coating of the processing solution on photographic material 16.

On the other hand, as it is sufficient for nozzle plate 322 to be provided with a plurality of nozzle pores 324, integration technique is not necessary, as a result, coating apparatus 310 can be produced at low cost.

Further, the processing solution in jetting tank 312 is gradually decreased by jetting the processing solution from nozzle pores 324 of nozzle plate 322, but sub tank 338 has the function of feeding the processing solution to maintain the water level in jetting tank 312 constant. Accordingly, hydraulic pressure in jetting tank 312 during vaporization can be maintained constant by feeding of the processing solution from sub tank 338, thus continuous jetting can be ensured.

Figure 11:
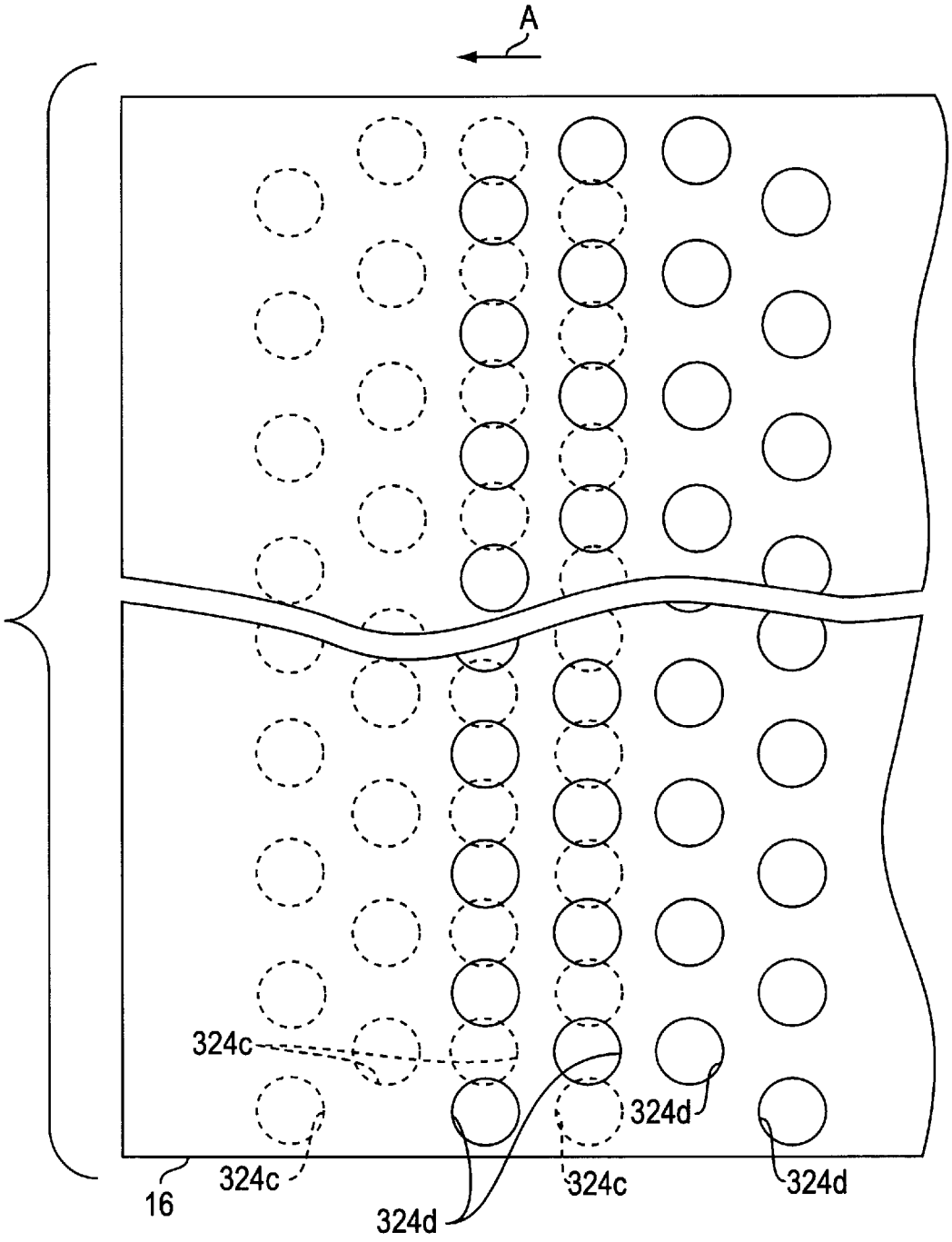
FIG. 11 is an explanatory view showing the position of nozzle pores of the jetting tank according to the second embodiment of the present invention projected on a photographic material.

Next, the position of nozzle pores 324 of jetting tank 312 according to the second embodiment of the present invention projected on photographic material 16 is shown in FIG. 11, which is described below. Further, the same symbols are given to the same members as the members used in the first embodiment and duplicated explanation are omitted.

As shown in FIG. 11, on nozzle plate 322 of jetting tank 312 according to the embodiment of the present invention, the pattern comprising a plurality of nozzle pores 324 for jetting the processing solution with constant intervals along by the direction intersecting conveyance route A of photographic material 16 in a straight line in cross-stitch-like two rows is formed repeatedly.

That is, in the second embodiment, nozzles are arranged in four rows and jetting of droplets L is performed repeatedly with the timing shown by broken line 324C and by continuous line 324D. Due to this constitution, the same function as in the first embodiment can be obtained, in addition, redundancy of vaporization by jetting can be improved.

That is, even if any nozzle of nozzle pores 324 clogs, other nozzles compensate for that place, therefore, coherence unevenness does not occur.

In the first embodiment of the present invention, nozzle pores 324 are arranged in two rows in such a manner that lines connecting each center S of nozzle pore 324 make an equilateral triangle, but nozzle pores are not necessarily arranged at positions where lines connecting each center S of nozzle pore 324 make an equilateral triangle in two rows. For example, two rows of nozzles may be arranged apart by some rows. Further, nozzle row is not limited to two rows but may be three or more. By the increase of nozzle row, it becomes possible to reduce driving frequency of the actuator.

Further, the relationship between pitch P and diameter D of droplet L was described with reference to threshold value. However, in practice, it is thought that nozzle pores are arranged more densely than the above embodiments so that all the droplets cohere when unevenness of flying direction is maximum and the diameters of droplets L are minimum taking into consideration unevenness of flying direction of droplets L and tolerance of droplet diameter of droplets L.

On the other hand, it is thought to be appropriate that volume V of droplets L which can be applied is from 0.00001 to 0.01 $mm^3$, the contact angle $\theta$ is 40° or less, the liquid film thickness formed on photographic material 16 is from 1 to 100 $\mu$m, preferably from 5 $\mu$m to 50 $\mu$m.

Further, in the first and second embodiments, nozzle row is arranged in the orthogonal direction to the conveying direction but it is not necessary to limit to orthogonal and it may be arranged in the oblique direction to the conveying direction.

Further, as a used-only-once processing solution is used in the present invention, the temperature of the processing solution may be higher than that used in usual tank processing, preferably from 20 to 80° C., more preferably from 30 to 50° C. For maintaining the temperature within this range during processing, it is preferred to adjust the temperature of not only the processing solution but the photographic material.

It is preferred that the coating apparatus for use in the present invention is an integrated image-forming apparatus comprising a photographic material magazine for storing photographic materials, an exposure part, a conveying part, a temperature controlling part after processing solution coating, a bleach-fixing part, a washing apparatus, and a drying part. Besides the above, the apparatus of the present invention preferably integrates a squeegee for squeezing out a surplus processing solution, a nip roller for conveying photographic materials, or a cutter for cutting a rolled photographic material to a sheet-like material.

Processing compounds and processing methods for use in the present invention are described below. In the present invention, a photographic material is, after development (silver development/cross oxidation of incorporated reducing agents, etc.), subjected to desilvering processing and washing or stabilizing processing according to processing. Further, there is a case where the processing for color intensification such as alkali investment is conducted after washing or stabilizing process.

Development processing in the present invention is described below.

In the present invention, a color-forming reducing agent is incorporated in a photographic material and color development processing is conducted using an alkaline processing solution substantially free of a color-forming developing agent. The alkaline processing solution for use in the present invention is substantially free of a color-forming developing agent. The alkaline processing solution may contain other components, e.g., alkali, halogen, a chelating agent, etc. For maintaining processing stability, the processing solution preferably not contain a reducing agent in some cases. In such a case, it is preferred that the processing solution does not substantially contain an auxiliary developing agent, hydroxylamines and sulfite.

Here, "does not substantially contain" means that the content is preferably 0.5 mmol/liter or less, more preferably 0.1 mmol/liter or less, and particularly preferably not contain at all.

The pH of the processing solution for use in the present invention is preferably from 9 to 14, particularly preferably from 10 to 13.

Intensification processing can be conducted after development. Hydrogen peroxide or compounds which release hydrogen peroxide are preferred as compounds used for intentisifcation from the environmental protection. As compounds which release hydrogen peroxide, perboric acid and percarboxylic acid are particularly preferred.

These compounds are preferably used in an amount of from 0.005 to 1 mol/liter, more preferably from 0.01 to 0.5 mol/liter, and particularly preferably from 0.02 to 0.25 mol/liter.

In the present invention, a processing solution is coated on the surface of a photographic material by a coating apparatus according to the present invention. Accordingly, the photographic material must be easily wet by the processing solution. In the present invention, for improving the wettability of the surface of the photographic material, the surface tension of the processing solution is preferably reduced. An organic solvent such as methanol, ethanol, or isopropyl alcohol may be added to the processing solution. It is possible to add a surfactant to the processing solution to reduce the surface tension of the processing solution. However, when the coating apparatus of the present invention is used, foaming in the coating apparatus is not preferred. Accordingly, it is preferred that the processing solution does not contain a surfactant in this point.

Processing time of the entire processing step, i.e., from development step to drying step, is preferably 360 sec. or less, more preferably 120 sec. or less, and particularly preferably from 20 to 90 sec. Here, processing time means the time required from the time when the processing solution is coated on the photographic material to the time when the photographic material comes out from the drying part of the processor.

Various additives are used in the processes according to the present invention. These additives are disclosed in *Research Disclosure,* Item 36544 (September, 1994) in detail, and the related locations of the disclosures are also shown below.

| Kind of Additives | Pages |
|---|---|
| Antifoggant | 537 |
| Chelating agent | 537, right column |
| Buffer | 537, right column |
| Surfactant | 538, left column and 539, left column |

-continued

| Kind of Additives | Pages |
|---|---|
| Bleaching agent | 538 |
| Bleaching accelerator | 538, right column to 539, left column |
| Chelating agent for bleaching | 539, left column |
| Rehalogenating agent | 539, left column |
| Fixing agent | 539, right column |
| Preservative for fixing agent | 539, right column |
| Chelating agent for fixing | 540, left column |
| Surfactant for stabilization | 540, left column |
| Scum preventing agent for stabilization | 540, right column |
| Chelating agent for stabilization | 540, right column |
| Fungicide, biocide | 540, right column |
| Color image stabilizer | 540, right column |

EXAMPLE 1

Preparation of Photographic Material

The surface of a paper support laminated on both sides with polyethylene was corona discharged. The support was provided with a gelatin undercoat layer containing sodium dodecylbenzenesulfonate, and further, various photographic constituting layers described below were coated to prepare a multilayer color photographic paper (100) shown below. The coating solutions were prepared in the following manner.

Coating Solution for First Layer

Twenty-three (23) g of a coupler (C-21), 16 g of a color-forming reducing agent (I-32), 80 g of a solvent (Solv-1) were dissolved in ethyl acetate, and this solution was dispersed in an emulsified condition into 400 g of a 16% aqueous solution of gelatin containing 10% sodium dodecylbenzenesulfonate and citric acid to obtain an emulsified dispersion A. On the other hand, silver chlorobromide emulsion A was prepared (cubic form, a mixture in a ratio of 3/7 (silver mol ratio) of large grain size emulsion A having an average grain size of 0.88 $\mu$m and small grain size emulsion A having an average grain size of 0.70 $\mu$m, variation coefficients of the grain size distribution of the large grain size emulsion and the small grain size emulsion of 0.08 and 0.10, respectively, both emulsions containing 0.3 mol % of silver bromide localized at a part of the grain surface with the substrate being silver chloride). The blue-sensitive Sensitizing Dyes A, B and C shown below were added in an amount of $1.4\times10^{-4}$ mol, respectively, per mol of silver, to large grain size emulsion A, and $1.7\times10^{-4}$ mol, respectively, per mol of silver, to small grain size emulsion A. Chemical ripening was conducted optimally by addition of a sulfur sensitizer and a gold sensitizer. The foregoing emulsified dispersion A was mixed with this silver chlorobromide emulsion A and dissolved to obtain a coating solution for the first layer having the composition described below. The coating amount of the emulsion indicates the coating amount in terms of silver.

The coating solutions for the second layer to the seventh layer were prepared in the same manner as the coating solution for the first layer. 1-Oxy-3,5-dichloro-s-triazine sodium salt was used as a gelatin hardening agent in each layer.

Further, Cpd-12, Cpd-13, Cpd-14 and Cpd-15 were added to each layer so that the total coating amount became 15.0 mg/m$^2$, 60.0 mg/m$^2$, 5.0 mg/m$^2$ and 10.0 mg/m$^2$, respectively.

The spectral sensitizing dyes described below were used in the silver chlorobromide emulsion of each light-sensitive emulsion layer.

Sensitizing Dyes for Blue-Sensitive Emulsion Layer:

Sensitizing Dye A

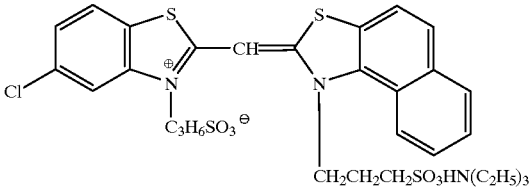

Sensitizing Dye B

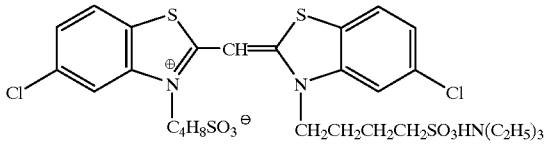

Sensitizing Dye C

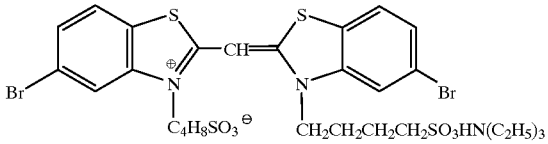

(each in an amount of $1.4\times10^{-4}$ mol per mol of the silver halide to the large grain size emulsion, and each in an amount of $1.7\times10^{-4}$ mol per mol of the silver halide to the small grain size emulsion)

Sensitizing Dyes for Green-Sensitive Emulsion Layer:

Sensitizing Dye D

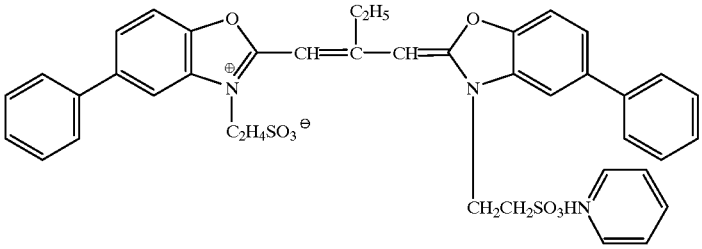

(in an amount of $3.0\times10^{-4}$ mol per mol of the silver halide to the large grain size emulsion and in an amount of $3.6\times10^{-4}$ mol per mol of the silver halide to the small grain size emulsion)

Sensitizing Dye E

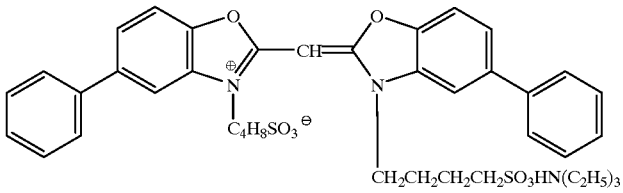

(in an amount of $4.0\times10^{-5}$ mol per mol of the silver halide to the large grain size emulsion and in an amount of $7.0\times10^{-5}$ mol per mol of the silver halide to the small grain size emulsion)

Sensitizing Dye F

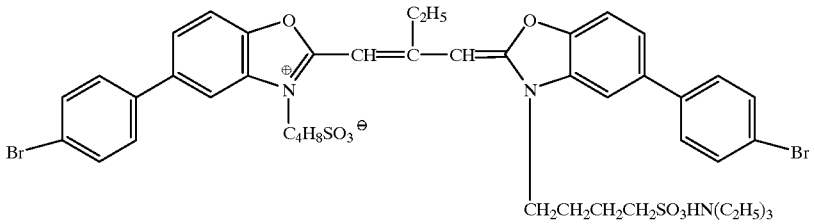

(in an amount of $2.0\times10^{-4}$ mol per mol of the silver halide to the large grain size emulsion and in an amount of $2.8\times10^{-4}$ mol per mol of the silver halide to the small grain size emulsion)

Sensitizing Dyes for Red-Sensitive Emulsion Layer:

Sensitizing Dye G

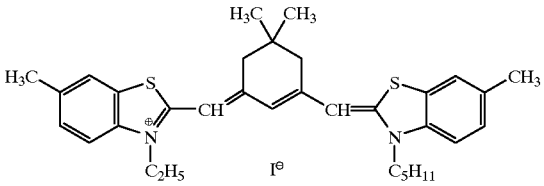

Sensitizing Dye H

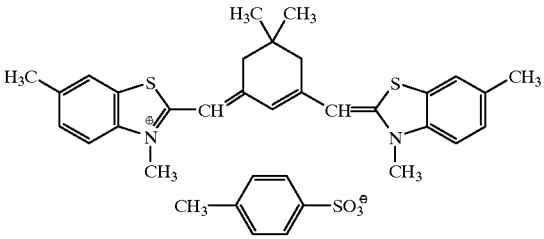

(each in an amount of $5.0\times10^{-5}$ mol per mol of the silver halide to the large grain size emulsion, and each in an amount of $8.0\times10^{-5}$ mol per mol of the silver halide to the small grain size emulsion)

Further, the following compound was added to the red-sensitive emulsion layer in an amount of $2.6\times10^{-3}$ mol per mol of the silver halide.

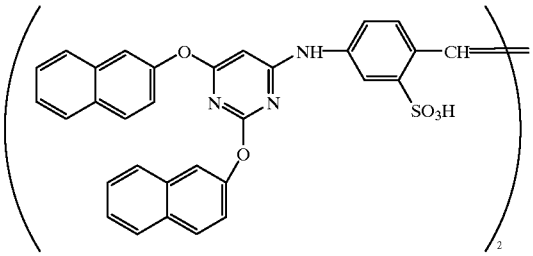

Further, 1-(5-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of the silver halide.

Further, 1-(5-methylureidophenyl)-5-mercaptotetrazole was added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of the silver halide.

Moreover, the following dyes were added to the emulsion layers for preventing irradiation.

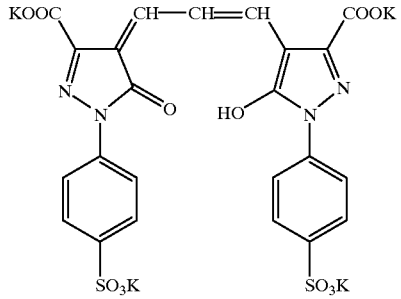

(10 mg/m$^2$)

and

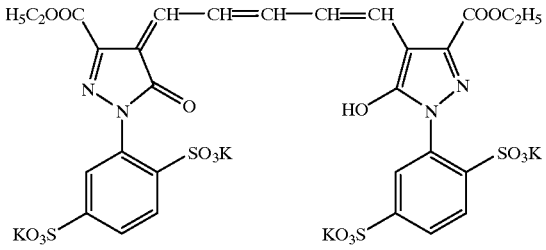

Layer Composition

The composition of each layer is described below. The numeral represents the coating amount (g/m$^2$). The numeral for silver halide emulsion represents the coating amount in terms of silver.

Support

Polyethylene-laminated paper (a brightening agents (I) and (II) described below, a white pigment ($TiO_2$, 15 wt %) and a blue dye (ultramarine) were added to the polyethylene of the first layer side).

First Layer (blue-sensitive emulsion layer)

| | |
|---|---|
| Silver Chlorobromide Emulsion A described above | 0.20 |
| Gelatin | 1.50 |
| Yellow Coupler (C-21) | 0.23 |
| Color Forming Reducing Agent (I-32) | 0.16 |
| Solvent (Solv-1) | 0.80 |

Second Layer (color mixture preventing layer)

| | |
|---|---|
| Gelatin | 1.09 |
| Color Mixing Preventive (Cpd-6) | 0.11 |
| Solvent (Solv-2) | 0.19 |
| Solvent (Solv-3) | 0.07 |
| Solvent (Solv-4) | 0.25 |
| Solvent (Solv-5) | 0.09 |
| 1,5-Diphenyl-3-pyrazolidone (fine particle solid dispersion) | 0.03 |

Third Layer (green-sensitive emulsion layer)

| | |
|---|---|
| Silver Chlorobromide Emulsion B (a cubic form, a mixture in a ratio of ⅓ (silver mol ratio) of large grain size emulsion B having the average grain size of 0.55 μm and small grain size emulsion B having an average grain size of 0.39 μm; variation coefficients of the grain size distribution were 0.10 and 0.08, respectively, both of them contained 0.8 mol % of silver bromide localized at a part of the grain surface, and the remaining substrate being comprising silver chloride) | 0.20 |
| Gelatin | 1.50 |
| Magenta Coupler (C-56) | 0.24 |
| Color Forming Reducing Agent (I-32) | 0.16 |
| Solvent (Solv-1) | 0.80 |

Fourth Layer (color mixture preventing layer)

| | |
|---|---|
| Gelatin | 0.77 |
| Color Mixing Preventive (Cpd-6) | 0.08 |
| Solvent (Solv-1) | 0.14 |
| Solvent (Solv-3) | 0.05 |
| Solvent (Solv-4) | 0.14 |
| Solvent (Solv-5) | 0.06 |
| 1,5-Diphenyl-3-pyrazolidone (fine particle solid dispersion) | 0.02 |

Fifth Layer (red-sensitive emulsion layer)

| | |
|---|---|
| Silver Chlorobromide Emulsion C (a cubic form, a mixture in a ratio of ¼ (silver mol ratio) of large grain size emulsion C having an average grain size of 0.50 μm and small grain size emulsion C having an average grain size of 0.41 μm; variation coefficients of the grain size distribution were 0.09 and 0.11, respectively, both of them contained 0.8 mol % of silver bromide localized at a part of the grain surface, and the remaining substrate being comprising silver chloride, and further, potassium hexachloroiridate(IV) in the total amount of 0.3 mg and potassium ferrocyanide in the total amount of 1.5 mg, respectively, per mol of the silver were contained in the inside and at the silver bromide localized phase of the grain) | 0.20 |
| Gelatin | 0.15 |
| Cyan Coupler (C-43) | 0.21 |
| Color Forming Reducing Agent (I-16) | 0.20 |
| Solvent (Solv-1) | 0.80 |

Sixth Layer (ultraviolet absorbing layer)

| | |
|---|---|
| Gelatin | 0.64 |
| Ultraviolet Absorber (UV-1) | 0.39 |
| Color Image Stabilizer (Cpd-7) | 0.05 |
| Solvent (Solv-6) | 0.05 |

Seventh Layer (protective layer)

| | |
|---|---|
| Gelatin | 1.01 |
| Acryl-Modified Copolymer of Polyvinyl Alcohol (modification degree: 17%) | 0.04 |
| Liquid Paraffin | 0.02 |
| Wettability Improver (Cpd-8) | 0.3 |
| Surfactant (Cpd-1) | 0.01 |

(Cpd-1) Surfactant

A 7/3 mixture (weight ratio) of

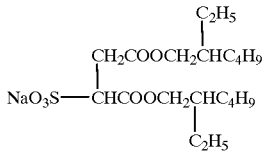

and

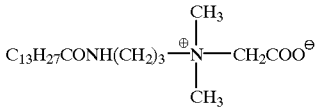

Cpd-2 Preservative

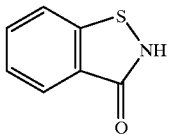

Cpd-3 Preservative

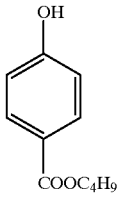

(Cpd-4) Preservative

1/1/1/1 mixture (by weight ratio) of a/b/c/d

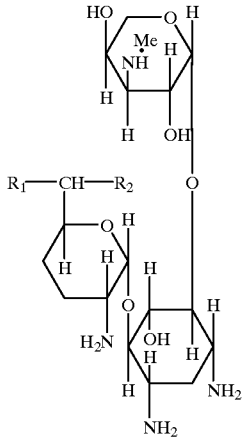

| | $R_1$ | $R_2$ |
|---|---|---|
| a | -Me | -NHMe |
| b | -Me | $-NH_2$ |
| c | -H | $-NH_2$ |

(Cpd-5) Preservative

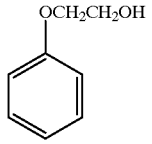

(Solv-1) Solvent

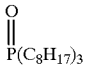

(Cpd-7) Color Image Stabilizer

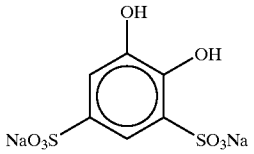

(Cpd-8) Wettability Improver

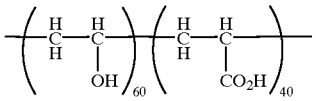

Average molecular weight: 1,000,000

(Cpd-9) Wettability Improver

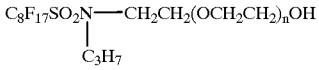

n = 15

(Cpd-10) Wettability improver

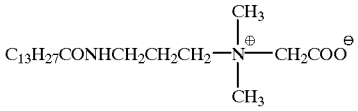

(Cpd-6) Color Mixing Preventive

1/1/1 mixture (by weight ratio) of (1)/(2)/(3)

(1)

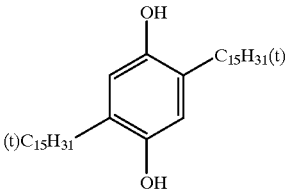

-continued (2)

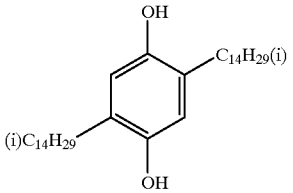

(3)

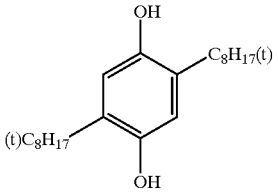

(Solv-2) Solvent

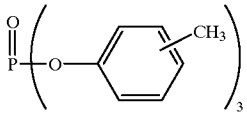

(Solv-3) Solvent

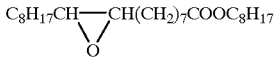

(Solv-4) Solvent

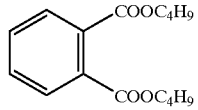

(Solv-5) Solvent

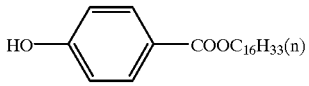

(Solv-6) Solvent

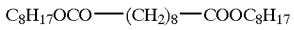

(UV-1) Ultraviolet Absorber

1/2/2/3/1 mixture (by weight ratio) of (1)/(2)/(3)/(4)/(5)

(1)

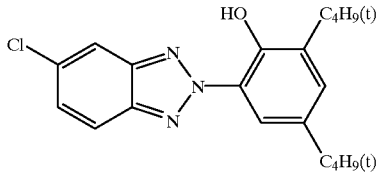

(2)

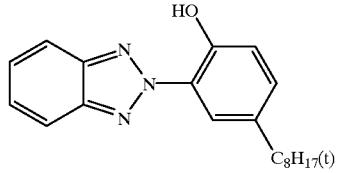

-continued (3)

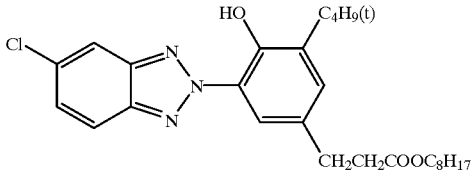

(4)

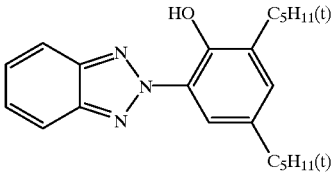

(5)

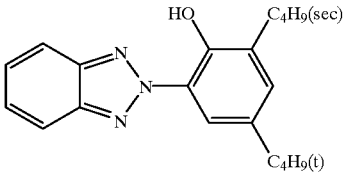

Brightening Agent (II)

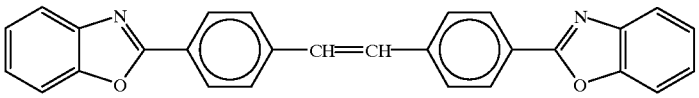

Brightening Agent (I)

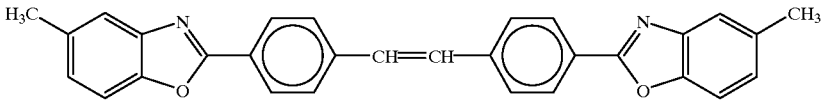

II/I=20/80 (by weight ratio), content: 15 mg/m$^2$, proportion to polyethylene: 0.08 wt %

Sample Nos. (101) to (106) were prepared in the same manner as the preparation of Sample No. (100) except that the coupler and the color-forming reducing agent were replaced as shown in Table a.

Processing Step 1

The above-prepared Sample No. (100) was subjected to uniform exposure with white light so that area ratio reached 30%, then the sample was running processed until the color developing replenisher was replenished two times of the amount of the color developing tank capacity.

| Step | Processing Temperature (° C.) | Processing Time (sec) | Replenishing Rate* (ml) | Tank Capacity (liter) |
|---|---|---|---|---|
| Color Development | 40 | 30 | 50 | 3 |
| Bleach-Fixing | 35 | 45 | 50 | 5 |
| Rinsing (1) | 35 | 20 | — | 2 |
| Rinsing (2) | 35 | 20 | — | 2 |
| Rinsing (3) | 35 | 20 | — | 2 |

-continued

| Step | Processing Temperature (° C.) | Processing Time (sec) | Replenishing Rate* (ml) | Tank Capacity (liter) |
|---|---|---|---|---|
| Rinsing (4) | 35 | 30 | 90 | 3 |
| Drying | 70–80 | 60 | | |

*Replenishing rate per m$^2$ of the photographic material Rinsing was conducted in a 4-tank countercurrent system from rinsing (4) to rinsing (1).

Developing Solution

| | |
|---|---|
| Water | 600 ml |
| Potassium Phosphate | 40 g |
| KCl | 5 g |
| Benzotriazole | 0.02 g |
| Hydroxyethylidene-1,1-diphosphonic Acid (30%) | 4 ml |
| Water to make | 1,000 ml |
| pH (25° C., adjusted with potassium hydroxide) | 12 |

Bleach-Fixing Solution

| | |
|---|---|
| Water | 600 ml |
| Ammonium Thiosulfate | 93 ml |

-continued

| | |
|---|---|
| (700 g/liter) | |
| Ammonium Sulfite | 40 g |
| Ammonium Ethylenediamine-tetraacetato Ferrate | 55 g |
| Ethylenediaminetetraacetic Acid | 2 g |
| Nitric Acid (67%) | 30 g |
| Water to make | 1,000 ml |
| pH (25° C., adjusted with acetic acid and aqueous ammonia) | 5.8 |

Rinsing Solution

| | |
|---|---|
| Chlorinated Sodium Isocyanurate | 0.02 g |
| Deionized Water (electric conductivity: 5 μS/cm or less) | 1,000 ml |
| pH | 6.5 |

Each of the above prepared samples was gradation exposed using FWH-type sensitometer (color temperature of the light source: 3,200° K) manufactured by Fuji Photo Film Co., Ltd. through a three color separation filter for sensitometry.

Each of the exposed samples was processed according to the above steps using fresh solution and the above running solution.

Processing Step 2

Sample Nos. (100) to (106) were subjected to the same exposure as above, then coating was carried out using the coating apparatus according to the present invention (the temperature of the processing solution was maintained at 40° C.). For the comparison with Processing Step 1, the coating amount of the processing solution was 50 cc/m$^2$. After the processing solution was coated, samples were allowed to stand on a heat panel at 40° C. for 30 seconds. Bleach-fixing step, rinsing step and drying step were the same as in Processing Step 1.

In Processing Step 2, the following processing solution, which causes less nozzle clogging, was used taking the amount of alkali consumed in gelatin into consideration. Bleach-fixing solution and rinsing solution were the same as those used in Processing Step 1.

Developing Solution (alkali activated solution)

| | |
|---|---|
| Water | 600 ml |
| KOH | 14 g |
| KCl | 2.5 g |
| Benzotriazole | 0.02 g |
| Hydroxyethylidene-1,1-diphosphonic Acid (30%) | 4 ml |
| Water to make | 1,000 ml |
| pH | (without adjusting pH) |

With respect to samples processed according to Step 1 using a fresh solution, samples processed according to Step 1 using a running solution, and samples processed according to Step, density was measured by blue light, green light and red light. The maximum color densities according to respective processes are described as D1F, D1R, and D2, when the sensitivity at density 0.2 of the sample processed according to Processing Step 1 using fresh solution is taken as 100, sensitivity at density 0.5 of the sample processed according to Processing Step 1 using running solution and the sample processed according to Processing Step 2 are respectively described as $S_{0.2}$1R and $S_{0.2}$2, and when the sensitivity at density 1.5 of the sample processed according to Processing Step 1 using fresh solution is taken as 100, sensitivity at density 1.5 of the sample processed according to Processing Step 1 using running solution and the sample processed according to Processing Step 2 are respectively described as $S_{1.5}$1R and $S_{1.5}$2. The results obtained are shown in Table a, however, as to Sample Nos. (105) and (106), sensitivities were measured at density 0.8.

TABLE A

| Sample No. | Light-Sensitive Layer | Coupler | Precursor* of Color Developing Agent | D1F | D1R | D2 | $S_{0.1}$1R | $S_{0.2}$2 | $S_{1.5}$1R | $S_{1.5}$2 |
|---|---|---|---|---|---|---|---|---|---|---|
| 100 | Blue | C-21 | I-32 | 2.31 | 2.18 | 2.31 | 112 | 100 | 92 | 100 |
| | Green | C-56 | I-32 | 2.48 | 2.35 | 2.48 | 114 | 100 | 90 | 100 |
| | Red | C-43 | I-16 | 1.56 | 1.52 | 1.56 | 113 | 100 | 89 | 100 |
| 101 | Blue | C-2 | I-1 | 1.95 | 1.86 | 1.95 | 113 | 100 | 92 | 100 |
| | Green | C-28 | I-1 | 2.51 | 2.43 | 2.51 | 115 | 100 | 94 | 100 |
| | Red | C-42 | I-1 | 2.01 | 1.93 | 2.01 | 115 | 100 | 94 | 100 |
| 102 | Blue | C-21 | I-27 | 2.46 | 2.34 | 2.46 | 112 | 100 | 91 | 100 |
| | Green | C-56 | I-27 | 2.43 | 2.30 | 2.43 | 116 | 100 | 94 | 100 |
| | Red | C-43 | I-16 | 1.56 | 1.52 | 1.56 | 113 | 100 | 89 | 100 |
| 103 | Blue | C-2 | I-16 | 2.06 | 1.95 | 2.06 | 114 | 100 | 93 | 100 |
| | Green | C-56 | I-16 | 2.01 | 1.91 | 2.01 | 113 | 100 | 92 | 100 |
| | Red | C-43 | I-16 | 1.56 | 1.52 | 1.56 | 113 | 100 | 89 | 100 |
| 104 | Blue | C-14 | I-16 | 2.21 | 2.14 | 2.21 | 118 | 100 | 87 | 100 |
| | Green | C-40 | I-16 | 1.55 | 1.51 | 1.55 | 119 | 100 | 88 | 100 |
| | Red | C-44 | I-16 | 1.54 | 1.51 | 1.54 | 118 | 100 | 87 | 100 |
| 105 | Blue | D-81 | I-19 | 1.04 | 0.96 | 1.04 | 109 | 100 | 96 | 100 |
| | Green | D-82 | I-19 | 0.95 | 0.85 | 0.95 | 107 | 100 | 95 | 100 |
| | Red | D-83 | I-19 | 0.93 | 0.86 | 0.93 | 106 | 100 | 94 | 100 |
| 106 | Blue | D-81 | I-20 | 0.98 | 0.89 | 0.98 | 107 | 100 | 96 | 100 |
| | Green | D-82 | I-21 | 0.92 | 0.84 | 0.92 | 107 | 100 | 96 | 100 |
| | Red | D-83 | I-15 | 0.90 | 0.82 | 0.90 | 105 | 100 | 95 | 100 |

As is apparent from the results in Table a, when general photographic materials are processed according to a method of immersing the photographic material in a processing solution (tank process), gradation fluctuation occurs by running processing. On the contrary, when processing is conducted using the coating apparatus according to the present invention, gradation is almost equal to the case where a fresh solution is used in tank processing. In this case the used amount of the processing solution is almost the same with the amount used in tank processing. When the coating apparatus according to the present invention is used, although the processing solution is used only once, the amount of the waste solution is almost the same with that in tank solution, moreover, fresh solution processing can be effected. Thus, when the coating apparatus of the processing solution according to the present invention is used, processing can be effected with a small amount of fresh solution, and as processing can be always carried out with a fresh solution, gradation fluctuation does not occur even by running processing, therefore, stable processing can be ensured always.

Further, when the processing solution according to the present invention which is used in the example is used in the coating apparatus according to the present invention, blank area due to coating failure of the processing solution caused by nozzle clogging does not occur. Further, unevenness of density due to deviation of the coating solution hardly occurs.

EXAMPLE 2

Sample No. (200) was prepared in the same manner as the preparation of Sample No. (100) except that silver chlorobromide emulsions A, B and C in the first, third and fifth layers were respectively replaced with silver chlorobromide emulsions D, E and F shown below and the coating amounts of silver were respectively changed to 0.01 g, 0.01 g and 0.015 g per $m^2$.

Silver Chlorobromide Emulsion D:

A cubic form, a mixture in a ratio of 3/7 (silver mol ratio) of large grain size emulsion D having an average grain size of 0.20 μm and small grain size emulsion D having an average grain size of 0.10 μm; variation coefficients of the grain size distribution were 0.08 and 0.10, respectively, both of them contained 0.3 mol % of silver bromide localized at a part of the grain surface, and the remaining substrate being comprising silver chloride, and chemical ripening of this emulsion was optimally conducted using a sulfur sensitizer and a gold sensitizer.

Blue-sensitive sensitizing dyes A, B and C used in Example 1 was added to silver chlorobromide emulsion D in the following amounts:

Sensitizing dyes A, B and C were added each in an amount of $7.0\times10^{-4}$ mol per mol of the silver halide to large grain size emulsion D and in an amount of $8.5\times10^{-4}$ mol per mol of the silver halide to small grain size emulsion D.

Silver Chlorobromide Emulsion E:

A cubic form, a mixture in a ratio of 1/3 (silver mol ratio) of large grain size emulsion B having an average grain size of 0.10 μm and small grain size emulsion B having an average grain size of 0.08 μm; variation coefficients of the grain size distribution were 0.10 and 0.08, respectively, both of them contained 0.8 mol % of silver bromide localized at a part of the grain surface, and the remaining substrate being comprising silver chloride.

Green-sensitive sensitizing dyes D, E and F used in Example 1 was added to silver chlorobromide emulsion E in the following amounts:

Sensitizing dye D was added in an amount of $1.5\times10^{-3}$ mol per mol of the silver halide to the large grain size emulsion and in an amount of $8\times10^{-3}$ mol per mol of the silver halide to the small grain size emulsion, Sensitizing dye E was added in an amount of $2.0\times10^{-4}$ mol per mol of the silver halide to the large grain size emulsion and in an amount of $3.5\times10^{-4}$ mol per mol of the silver halide to the small grain size emulsion, and Sensitizing dye F was added in an amount of $1.0\times10^{-3}$ mol per mol of the silver halide to the large grain size emulsion and in an amount of $1.4\times10^{-3}$ mol per mol of the silver halide to the small grain size emulsion.

Silver Chlorobromide Emulsion F:

A cubic form, a mixture in a ratio of 1/4 (silver mol ratio) of large grain size emulsion C having an average grain size of 0.10 μm and small grain size emulsion C having an average grain size of 0.08 μm; variation coefficients of the grain size distribution were 0.09 and 0.11, respectively, both of them contained 0.8 mol % of silver bromide localized at a part of the grain surface, and the remaining substrate being comprising silver chloride.

Red-sensitive sensitizing dyes G and H used in Example 1 was added to silver chlorobromide emulsion F in the following amounts:

Sensitizing dyes G and H were added each in an amount of $2.5\times10^{-4}$ mol per mol of the silver halide to the large grain size emulsion and in an amount of $4.0\times10^{-4}$ mol per.

Sample Nos. (201) to (203) were in the same manner as the preparation of Sample No. (200) except that the color-forming reducing agent and the coupler were replaced as shown below.

| Sample No. | | Color-Forming Reducing Agent | Dye-Forming Coupler |
|---|---|---|---|
| 201 | Blue-sensitive layer | I-1 | C-2 |
| | Green-sensitive layer | I-1 | C-28 |
| | Red-sensitive layer | I-1 | C-42 |
| 202 | Blue-sensitive layer | I-61 | C-14 |
| | Green-sensitive layer | I-61 | C-40 |
| | Red-sensitive layer | I-61 | C-44 |
| 203 | Blue-sensitive layer | D-19 | C-81 |
| | Green-sensitive layer | D-19 | C-82 |
| | Red-sensitive layer | D-19 | C-83 |

Samples were subjected to the same exposure as in Example 1 with the exposure time of 10 times, then processed as follows.

Processing Step 2

| Processing Step | Processing Temperature (°C.) | Processing Time (sec) |
|---|---|---|
| Development | 40 | — |
| Intensification (coating was conducted using the coating apparatus according to the present invention, coating amount of the solution was 50 ml/$m^2$) | | |
| Leaving on heat panel | 40 | 30 |
| Washing | 40 | 90 |
| Stabilization | 30 | 15 |
| Drying | 70 | 60 |

Developing Intensification Solution

| | |
|---|---|
| Water | 800 ml |
| Sodium 5-Sulfosalicylate | 50 g |
| Benzotriazole | 0.02 g |
| KCl | 2.5 g |
| Hydroxyethylidene-1,1-diphosphonic Acid (30% aq. soln.) | 4 ml |
| Hydrogen Peroxide (30% aq. soln.) | 30 ml |
| Water to make | 1,000 ml |
| pH | 11.5 |

Stabilizing Solution

| | |
|---|---|
| Potassium Carbonate | 15 g |
| Sodium 2-Mercaptobenzimidazole-5-sulfonate | 1 g |
| Hydroxyethylidene-1,1-diphosphonic Acid (30% aq. soln.) | 1 ml |
| 5-Chloro-2-methyl-4-isothiazolin-3-one | 0.02 g |
| Water to make | 1,000 ml |
| pH | 9.5 |

When processing was conducted by the coating apparatus according to the present invention using a photographic material from which silver was largely decreased, the image having high maximum density and high sensitivity as in Example 1 was obtained.

EXAMPLE 3

Processing and evaluation were carried out using Sample Nos. (100) to (106) used in Example 1 in the same manner as in Example 1 except that exposure was conducted as described below.

Exposure

Three-types of laser beams were used, that is, the wavelength of YAG solid state laser (oscillation wavelength: 946 nm) using a semiconductor laser GaAlAs (oscillation wavelength: 808.5 nm) as an excitation light source converted with SHG crystal of $KNbO_3$ to 473 nm, the wavelength of $YVO_4$ solid state laser (oscillation wavelength: 1,064 nm) using a semiconductor laser GaAlAs (oscillation wavelength: 808.7 nm) as an excitation light source converted with SHG crystal of KTP to 532 nm, and AlGaInP (oscillation wavelength: about 670 nm, manufactured by Toshiba Co., Ltd., Type No. TOLD9211). Laser beam can successively scanning expose a color photographic paper transferring vertically to scanning direction by rotating polyhedron. Using this device, by changing the light amount, the relation between density (D) of a photographic material and log E (light amount (E)) was searched. Light amounts of laser beams of three wavelengths were modulated using an external modulator and exposure amount was controlled. In this time, scanning exposure was conducted at 400 dpi, and an average exposure time per pixel was about $5\times10^{-8}$ sec. For restraining the fluctuation of light amount due to changes of temperature, the temperature of semiconductor laser was maintained constant using Peltier element.

As a result, in the image obtained by high intensity digital exposure, the image having high maximum density and high sensitivity as in Example 1 was obtained by the processing using the coating apparatus and coating solution according to the present invention.

EFFECT OF THE INVENTION

According to the present invention, a color photographic image excellent in a color-forming ability, a storage stability, a color image stability and a hue can be easily obtained. Moreover, according to the present invention, the reduction of waste solution and the reduction of fluctuation by processing can be realized.

While the invention has been described in detail and with reference to specific examples thereof, it will be apparent to one skilled in the art that various changes and modifications can be made therein without departing from the spirit and scope thereof.

What is claimed is:

1. A method for forming a color image which comprises color development processing a silver halide color photographic material with an alkaline processing solution substantially free of a color-forming developing agent by using a coating apparatus comprising a plurality of nozzle pores for coating by jetting droplets of the processing solution, which comprises coating said photographic material by jetting three droplets contiguous to each other from the nozzle pores, so as not to leave space among the three droplets coated on said photographic material, wherein said photographic material comprises a support having provided thereon at least one photographic constituting layer, said at least one photographic constituting layer containing at least one dye-forming coupler and at least one color-forming reducing agent selected from the group consisting of color-forming reducing agents represented by formulas (I) and (II):

(I)

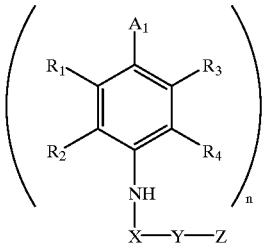

(II)

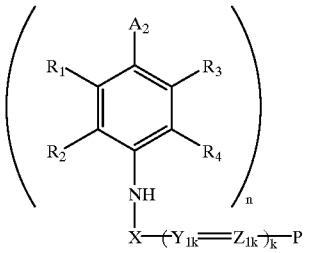

wherein $R_1$, $R_2$, $R_3$ and $R_4$ each represents a hydrogen atom or a substituent; $A_1$ and $A_2$ each represents a hydroxyl group or a substituted amino group; X represents a divalent or more linking group selected from the group consisting of —CO—, —SO—, —$SO_2$—, and —PO<; $Y_{1k}$ and $Z_{1k}$ each represents a nitrogen atom or a group represented by —$CR_5$=, wherein $R_5$ represents a hydrogen atom or a substituent; k represents 0 or an integer of 1 or more; P represents a proton dissociable group or a group capable of becoming a cation, and has a function of forming a dye from a coupler including a substituent bonded to the coupling site thereof by the breaking of the N—X bond caused by electron transfer from P and the elimination of the substituent after an oxidation product formed by the oxidation-reduction reaction of the compound represented by formula (II) with the exposed silver halide is coupled with the coupler; Y represents a divalent linking group; Z represents a nucleophilic group which can attack X when the compound represented by formula (I) is oxidized; and n is 1 or 2 when X represents —PO<, and n is 1 when X represents other group; and at least two atoms or substituents selected arbitrarily from $R_1$ and $R_2$, $R_3$ and $R_4$, and $Y_{1k}$, $Z_{1k}$ and P may be respectively independently bonded to form a ring.

2. The method for forming a color image as claimed in claim 1, wherein said coating apparatus has a pitch P among nozzle pores contiguous to each other of $(\sqrt{3})\cdot D/2$ or less, wherein diameter D of one droplet of the alkaline processing solution coated on the photographic material is obtained by the following equation taking the volume of one droplet of the alkaline processing solution jetted from a plurality of nozzle pores as V, and the contact angle of the droplet at the time when the alkaline processing solution is coated on the photographic material as θ:

$$D = 2\cdot \mathrm{Sin}\theta\left\{\frac{3\cdot V}{\pi\cdot[2^{-3}\cdot\cos\theta+(\cos\theta)^3]}\right\}^{1/3}$$

3. The method for forming a color image as claimed in claim 1, wherein the liquid film thickness of the alkaline processing solution coated on the photographic material is 50 μm or less.

4. The method for forming a color image as claimed in claim 1, wherein the processing is carried out using the photographic material having the total coating amount of silver of all the coated layers of from 0.003 to 0.3 g/m$^2$ in terms of silver with the alkaline processing solution substantially free of a color-forming developing agent but containing hydrogen peroxide.

5. The method for forming a color image as claimed in claim 1, wherein the exposure time per one pixel is from $10^{-8}$ to $10^{-4}$ sec. and exposure is carried out by scanning exposure in which adjacent rasters are overlapped.

6. The method for forming a color image as claimed in claim 1, wherein a diffusible dye which is formed by said at least one dye-forming coupler in said photographic material is a diffusible dye having at least one dissociable group having pKa of 12 or less.

7. The method for forming a color image as claimed in claim 1, wherein a diffusible dye which is formed by said at least one dye-forming coupler in said photographic material is a diffusible dye which is dissolved in an alkali solution of pH 11 at 25° C. in concentration of $1\times10^{-5}$ mol/liter.

8. The method for forming a color image as claimed in claim 1, wherein a diffusible dye which is formed by said at least one dye-forming coupler in said photographic material is a diffusible dye having a diffusion constant of $1\times10^{-8}$ m$^2$/s$^{-1}$ or more, when the diffusible dye is dissolved in concentration of $1\times10^{-4}$ mol/liter in an alkali solution of pH 11 at 25° C.

9. A method for forming a color image which comprises color development processing a silver halide color photographic material with an alkaline processing solution substantially free of a color-forming developing agent by using a coating apparatus comprising a plurality of nozzle pores for coating by jetting droplets of the processing solution, which comprises coating said photographic material by jetting three droplets contiguous to each other from the nozzle pores, so as not to leave space among the three droplets coated on said photographic material, wherein said photographic material comprises a support having provided thereon at least one photographic constituting layer, said at least one photographic constituting layer containing at least one dye-forming coupler and at least one color-forming reducing agent represented by formula (III):

$$R^{11}—NHNH—X^0—R^{12} \quad \text{(III)}$$

wherein $R^{11}$ represents an aryl group which may have a substituent or a heterocyclic group which may have a substituent; $R^{12}$ represents an alkyl group which may have a substituent, an alkenyl group which may have a substituent, an alkynyl group which may have a substituent, an aryl group which may have a substituent or a heterocyclic group which may have a substituent; $X^0$ represents —$SO_2$—, —CO—, —COCO—, —CO—O—, —CONH($R^{13}$)—, —COCO—O—, —COCO—N($R^{13}$)— or —$SO_2$—NH($R^{13}$)—; $R^{13}$ represents a hydrogen atom, an alkyl group which may have a substituent, an alkenyl group which may have a substituent, an alkynyl group which may have a substituent, an aryl group which may have a substituent or a heterocyclic group which may have a substituent.

10. The method for forming a color image as claimed in claim 9, wherein the compound represented by formula (III) is represented by formula (IV) or (V):

(IV)

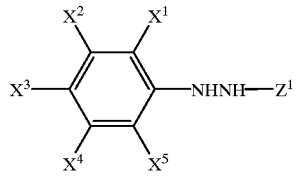

(V)

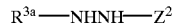

wherein $Z^1$ represents an acyl group, a carbamoyl group, an alkoxycarbonyl group, or an aryloxycarbonyl group; $Z^2$ represents a carbamoyl group, an alkoxycarbonyl group, or an aryloxycarbonyl group; $X^1$, $X^2$, $X^3$, $X^4$ and $X^5$ each represents a hydrogen atom or a substituent, provided that the sum of Hammett's substituent constant σp values of $X^1$, $X^3$ and $X^5$ and Hammett's substituent constant σm values of $X^2$ and $X^4$ is from 0.80 to 3.80; and $R^{3a}$ represents a heterocyclic group.

11. The method for forming a color image as claimed in claim 10, wherein the compound represented by formula (IV) or (V) is represented by formula (VI) or (VII):

(VI)

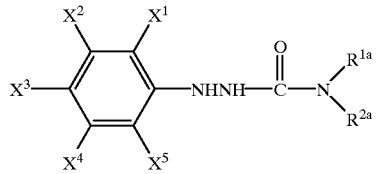

(VII)

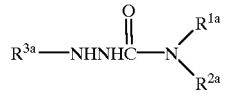

wherein $R^{1a}$ and $R^{2a}$ each represents a hydrogen atom or a substituent; $X^1$, $X^2$, $X^3$, $X^4$ and $X^5$ each represents a hydrogen atom or a substituent, provided that the sum of Hammett's substituent constant σp values of $X^1$, $X^3$ and $X^5$ and Hammett's substituent constant σm values of $X^2$ and $X^4$ is from 0.80 to 3.80; and $R^{3a}$ represents a heterocyclic group.

12. The method for forming a color image as claimed in claim 11, wherein the compound represented by formula (VI) or (VII) is represented by formula (VIII) or (IX):

(VIII)

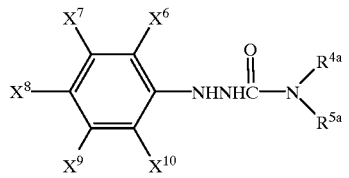

(IX)

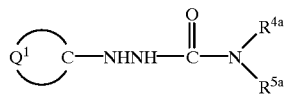

wherein $R^{4a}$ and $R^{5a}$ each represents a hydrogen atom or a substituent, and either $R^{4a}$ or $R^{5a}$ represents a hydrogen atom; $X^6$, $X^7$, $X^8$, $X^9$ and $X^{10}$ each represents a hydrogen atom, a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group, or a heterocyclic group, provided that the sum of Hammett's substituent constant σp values of $X^6$, $X^8$ and $X^{10}$ and Hammett's substituent constant am values of $X^7$ and $X^9$ is from 1.20 to 3.80; and $Q^1$ and C each represents a nonmetallic atomic group necessary to form a nitrogen-containing 5- to 8-membered heterocyclic ring.

13. The method for forming a color image as claimed in claim 9, wherein a diffusible dye which is formed by said at least one dye-forming coupler in said photographic material is a diffusible dye having at least one dissociable group having pKa of 12 or less.

14. The method for forming a color image as claimed in claim 9, wherein a diffusible dye which is formed by said at least one dye-forming coupler in said photographic material is a diffusible dye which is dissolved in an alkali solution of pH 11 at 25° C. in concentration of $1\times10^{-5}$ mol/liter.

15. The method for forming a color image as claimed in claim 9, wherein a diffusible dye which is formed by said at least one dye-forming coupler in said photographic material is a diffusible dye having a diffusion constant of $1\times10^{-8}$ $m^2/s^{-1}$ or more, when the diffusible dye is dissolved in concentration of $1\times10^{-4}$ mol/liter in an alkali solution of pH 11 at 25° C.

* * * * *